US007956833B2

(12) United States Patent
Ito et al.

(10) Patent No.: US 7,956,833 B2
(45) Date of Patent: Jun. 7, 2011

(54) DISPLAY DRIVER, ELECTRO-OPTICAL DEVICE, AND ELECTRONIC INSTRUMENT

(75) Inventors: Satoru Ito, Okaya (JP); Hisanobu Ishiyama, Chino (JP); Motoaki Nishimura, Fujimi-machi (JP); Kazuhiro Maekawa, Chino (JP); Haruo Kamijo, Shiojiri (JP); Hironori Kobayashi, Asahi-mura (JP); Isamu Moriya, Chino (JP)

(73) Assignee: Seiko Epson Corporation, Tokyo (JP)

( * ) Notice: Subject to any disclaimer, the term of this patent is extended or adjusted under 35 U.S.C. 154(b) by 752 days.

(21) Appl. No.: 11/808,901

(22) Filed: Jun. 13, 2007

(65) Prior Publication Data

US 2008/0001876 A1 Jan. 3, 2008

(30) Foreign Application Priority Data

Jun. 16, 2006 (JP) ..... 2006-167169
Mar. 20, 2007 (JP) ..... 2007-073054

(51) Int. Cl.
*G09G 3/36* (2006.01)

(52) U.S. Cl. ..... 345/87

(58) Field of Classification Search ..... None
See application file for complete search history.

(56) References Cited

U.S. PATENT DOCUMENTS 5,016,982 A * 5/1991 Fergason et al. ..... 349/33
6,407,732 B1 * 6/2002 Stiens et al. ..... 345/204
6,650,310 B2 * 11/2003 Yoon ..... 345/87
7,012,599 B2 * 3/2006 Sun ..... 345/211
7,369,187 B2 * 5/2008 Park ..... 349/38
7,385,581 B2 * 6/2008 Kojima et al. ..... 345/96
7,800,601 B2 * 9/2010 Miura ..... 345/204
2002/0109653 A1 * 8/2002 Kudo et al. ..... 345/87
2004/0130544 A1 * 7/2004 Sun ..... 345/211
2005/0088394 A1 * 4/2005 Chung ..... 345/96
2005/0088395 A1 * 4/2005 Chung ..... 345/98
2006/0022929 A1 * 2/2006 Hashimoto et al. ..... 345/96
2006/0103618 A1 * 5/2006 Miura ..... 345/96
2007/0205970 A1 * 9/2007 Tang et al. ..... 345/87
2008/0001876 A1 * 1/2008 Ito et al. ..... 345/87

(Continued)

FOREIGN PATENT DOCUMENTS

JP A 2002-244622 8/2002

(Continued)

OTHER PUBLICATIONS

U.S. Appl. No. 11/902,626, in the name of Kamijo et al., filed Sep. 24, 2007.

(Continued)

*Primary Examiner* — Bipin Shalwala
*Assistant Examiner* — Daniel Bedell
(74) *Attorney, Agent, or Firm* — Oliff & Berridge, PLC

(57) ABSTRACT

A display driver includes a common electrode charge storage switch provided between a first capacitor element connection node to which one end of a first capacitor element can be connected and a common electrode voltage output node to which a voltage of a common electrode opposite to a pixel electrode of an electro-optical device through an electro-optical material is supplied, a source charge storage switch provided between a second capacitor element connection node to which one end of a second capacitor element can be connected and a source voltage output node to which a voltage of a source line of the electro-optical device is supplied, and a node short circuit switch provided between the common electrode voltage output node and the source voltage output node.

7 Claims, 39 Drawing Sheets

U.S. PATENT DOCUMENTS

| | | | | |
|---|---|---|---|---|
| 2008/0068316 | A1* | 3/2008 | Maekawa | 345/87 |
| 2008/0303773 | A1* | 12/2008 | Chen | 345/96 |

FOREIGN PATENT DOCUMENTS

| | | |
|---|---|---|
| JP | A 2004-354758 | 12/2004 |
| JP | A-2008-070412 | 3/2008 |
| JP | A-2008-076625 | 4/2008 |
| JP | A-2008-076626 | 4/2008 |
| JP | A-2008-083286 | 4/2008 |
| JP | A-2008-096479 | 4/2008 |
| JP | A-2008-107800 | 5/2008 |
| JP | A-2008-116917 | 5/2008 |

OTHER PUBLICATIONS

U.S. Appl. No. 11/898,595, in the name of Maekawa, filed Sep. 13, 2007.

U.S. Appl. No. 11/907,216, in the name of Nishimura, filed Oct. 10, 2007.

* cited by examiner

DISPLAY DRIVER, ELECTRO-OPTICAL DEVICE, AND ELECTRONIC INSTRUMENT

Japanese Patent Application No. 2006-167169 filed on Jun. 16, 2006 and Japanese Patent Application No. 2007-73054 filed on Mar. 20, 2007, are hereby incorporated by reference in their entirety.

BACKGROUND OF THE INVENTION

The present invention relates to a display driver, an electro-optical device, and an electronic instrument.

As a liquid crystal display (LCD) panel (display panel in a broad sense; electro-optical device in a broader sense) used for an electronic instrument such as a portable telephone, a simple matrix type LCD panel and an active matrix type LCD panel using a switch element such as a thin film transistor (hereinafter abbreviated as "TFT") are known.

The power consumption of the simple matrix type LCD panel can be easily reduced in comparison with the active matrix type LCD panel. However, it is difficult to increase the number of colors and display a video image using the simple matrix type LCD panel. The active matrix type LCD panel is suitable for increasing the number of colors and displaying a video image. However, it is difficult to reduce the power consumption of the active matrix type LCD panel.

The simple matrix type LCD panel and the active matrix type LCD panel are driven so that the polarity of the voltage applied to a liquid crystal (electro-optical material in a broad sense) forming a pixel is alternately changed. As such an alternating driving method, a line inversion driving method and a field inversion drive (frame inversion driving) method are known. In the line inversion driving method, the polarity of the voltage applied to the liquid crystal is reversed in units of one or more scan lines. In the field inversion driving method, the polarity of the voltage applied to the liquid crystal is reversed in field (frame) units.

In this case, a method of changing a common electrode voltage (common voltage) supplied to a common electrode opposite to a pixel electrode forming a pixel at the inversion drive timing can reduce the voltage level applied to the pixel electrode.

When using the above alternating driving method, power consumption is increased accompanying charging and discharging the liquid crystal. In order to solve this problem, JP-A-2002-244622 discloses technology of reducing power consumption by initializing charges stored in the liquid crystal to zero by short-circuiting two electrodes provided on either side of the liquid crystal during inversion drive, thereby causing the voltage to transition to the intermediate point of the voltage before short-circuiting the electrodes, for example. JP-A-2004-354758 discloses technology of reducing power consumption by reducing a change in potential of a source line when changing a common electrode voltage by applying a precharge potential to the source line in a first precharge period before a pixel electrode write period and a second precharge period before changing the common electrode voltage.

However, the technologies disclosed in JP-A-2002-244622 and JP-A-2004-354758 have a problem in which the effect of reducing power consumption varies depending on the voltage applied to the source line. Therefore, the effect of reducing the amount of charges by charging and discharging the common electrode of which the polarity of the voltage is reversed may be insufficient. According to the technology disclosed in JP-A-2002-244622, the amount of charging and discharging may be increased by short-circuiting the electrodes provided on either side of the liquid crystal depending on the relationship between the voltage applied to the source line and the polarity of the common electrode voltage, whereby the effect of reducing power consumption may be impaired.

Therefore, when recycling supplied charges, it is desirable that the source line and the common electrode be driven while reliably reducing power consumption using a simple configuration.

On the other hand, priority may be given to a reduction in chip size and mounting area of a display driver and the like at the expense of the effect of reducing power consumption to some extent depending on the application field of the display driver. This applies to the case of applying a display driver and the like to a product for which the customer (manufacturer of electronic instrument) desires to reduce the cost of a display driver or an LCD panel including the display driver, for example.

Therefore, it is desirable that a display driver and the like be provided which make it possible to give priority to a reduction in power consumption or a reduction in cost corresponding to the customer's demand. Specifically, it is desirable that power consumption be minimized at the expense of a cost reduction effect to some extent (priority is given to reduction in power consumption) or cost be minimized at the expense of a power consumption reduction effect to some extent (priority is given to reduction in cost) using a simple configuration. It becomes possible to satisfy various users' demands using one type of display driver by providing such a display driver and the like, whereby the manufacturing cost can be further reduced.

SUMMARY

According to one aspect of the invention, there is provided a display driver for driving an electro-optical device, the display driver comprising:

a common electrode charge storage switch provided between a first capacitor element connection node to which one end of a first capacitor element can be connected and a common electrode voltage output node to which a voltage of a common electrode opposite to a pixel electrode of the electro-optical device through an electro-optical material is supplied;

a source charge storage switch provided between a second capacitor element connection node to which one end of a second capacitor element can be connected and a source voltage output node to which a voltage of a source line of the electro-optical device is supplied; and a node short circuit switch provided between the common electrode voltage output node and the source voltage output node.

According to another aspect of the invention, there is an electro-optical device comprising:

a plurality of source lines;

a plurality of gate lines;

a plurality of pixel electrodes, each of the pixel electrodes being specified by one of the source lines and one of the gate lines;

a common electrode opposite to the pixel electrodes;

a common electrode charge storage switch provided between a first capacitor element connection node to which one end of a first capacitor element can be connected and a common electrode voltage output node to which a common electrode voltage applied to the common electrode is supplied;

a common line electrically connected with a second capacitor element connection node to which one end of a second capacitor element can be connected;

a node short circuit switch provided between the common electrode voltage output node and the common line;

a first source short circuit switch provided between a first source output node, to which a voltage output to a first source line of the source lines is supplied, and the common line;

a second source short circuit switch provided between a second source output node, to which a voltage output to a second source line of the source lines is supplied, and the common line; and a source charge storage switch provided between the common line and the second capacitor element connection node.

According to a further aspect of the invention, there is provided an electronic instrument comprising the above display driver.

According to a further aspect of the invention, there is provided an electronic instrument comprising the above electro-optical device.

DETAILED DESCRIPTION OF THE EMBODIMENT

Figure 1:
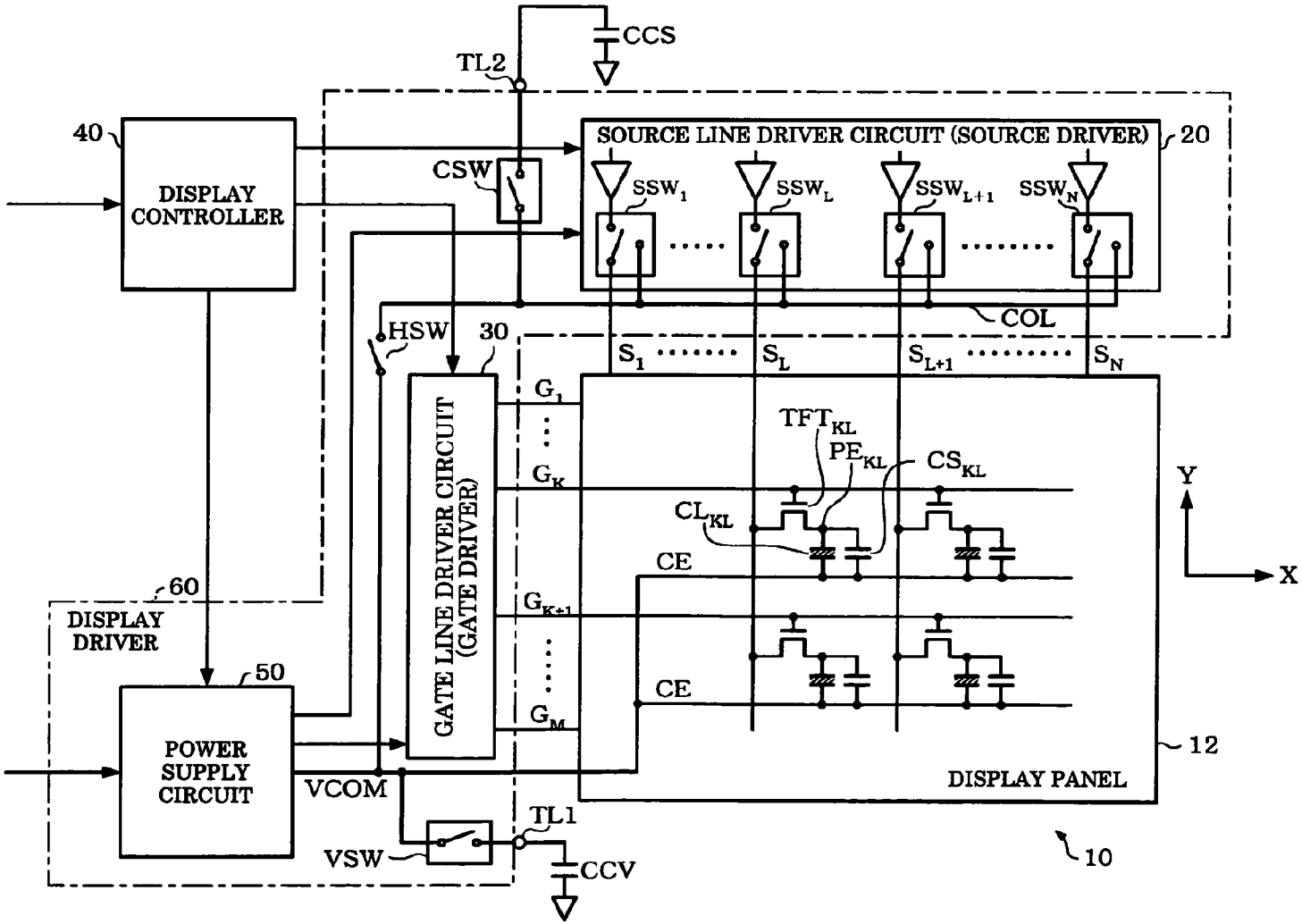
FIG. 1 is a block diagram of a configuration example of a liquid crystal device according to one embodiment of the invention.

The invention may provide a display driver, an electro-optical device, and an electronic instrument which can reduce power consumption by recycling charges and allow priority to be given to a reduction in power consumption or a reduction in cost using a simple configuration.

According to one embodiment of the invention, there is provided a display driver for driving an electro-optical device, the display driver comprising:

a common electrode charge storage switch provided between a first capacitor element connection node to which one end of a first capacitor element can be connected and a common electrode voltage output node to which a voltage of a common electrode opposite to a pixel electrode of the electro-optical device through an electro-optical material is supplied;

a source charge storage switch provided between a second capacitor element connection node to which one end of a second capacitor element can be connected and a source voltage output node to which a voltage of a source line of the electro-optical device is supplied; and a node short circuit switch provided between the common electrode voltage output node and the source voltage output node.

In the display driver according to this embodiment, in a first operation mode, after setting the node short circuit switch in a conducting state while setting the common electrode charge storage switch and the source charge storage switch in a nonconducting state, the common electrode may be driven by supplying the common electrode voltage to the common electrode voltage output node, and the source line may be driven by supplying a voltage corresponding to display data to the source line.

In the display driver according to this embodiment, in a second operation mode, the node short circuit switch is set in a nonconducting state, the common electrode may be driven by supplying the common electrode voltage to the common electrode voltage output node in a state in which the common electrode voltage output node and the first capacitor element connection node are electrically disconnected using the common electrode charge storage switch after electrically connecting the common electrode voltage output node and the first capacitor element connection node using the common electrode charge storage switch, and the source line may be driven by supplying a voltage corresponding to display data to the source line in a state in which the source voltage output node and the second capacitor element connection node are electrically disconnected using the source charge storage switch after electrically connecting the source voltage output node and the second capacitor element connection node using the source charge storage switch.

According to the above embodiment, one end of the first capacitor element and the common electrode voltage output node can be set at the same potential through the common electrode charge storage switch. According to the above embodiment, one end of the second capacitor element and the source voltage output node can be set at the same potential through the source charge storage switch. According to the above embodiment, the common electrode voltage output node and the source voltage output node can be set at the same potential. Specifically, the nodes can be set at the same potential without charging and discharging the nodes using the power supply circuit, and the nodes can be set at a desired potential by charging and discharging the nodes using the power supply circuit after setting the nodes at the same potential. Therefore, power consumption can be reduced.

This allows charge recycle control of the common electrode and the source line using the first and second capacitor elements or charge recycle control which sets the common electrode voltage output node and the source voltage output node at the same potential to be realized using a simple configuration. Therefore, a display driver can be provided which can reduce power consumption by recycling charges and allows priority to be given to a reduction in power consumption or a reduction in cost using a simple configuration.

In the display driver according to this embodiment, a period in which the source voltage output node is electrically connected with the second capacitor element connection node may coincide with (overlap) a period in which the common electrode voltage output node is electrically connected with the first capacitor element connection node.

According to the above embodiment, since the amount of charges supplied from the outside can be reduced when changing the source output and when changing the common electrode voltage, power consumption can be further reduced.

The display driver according to this embodiment may comprise:

an operation mode setting register in which control data corresponding to the first or second operation mode is set;

wherein the operation mode corresponding to the control data may be designated.

The display driver according to this embodiment may comprise:

an external setting terminal;

wherein the operation mode corresponding to a state of a signal supplied to the external setting terminal may be designated.

According to the above embodiment, a driver circuit can be provided which allows switching between the first and second operation modes using a further simple configuration.

The display driver according to this embodiment may comprise:

a common line which is electrically connected with the source voltage output node and of which one end is electrically connected with the source charge storage switch;

a first source short circuit switch provided between a first source output node to which a voltage output to a first source line of the electro-optical device is supplied and the common line;

a second source short circuit switch provided between a second source output node to which a voltage output to a second source line of the electro-optical device is supplied and the common line; and a discharge transistor connected with the common line;

wherein the discharge transistor may be used in common to discharge the first and second source lines.

According to the above embodiment, the source lines can be discharged using a simple configuration, whereby deterioration in pixels can be prevented.

In the display driver according to this embodiment, in a select period of the pixel electrode of the electro-optical device, the first and second source lines may be discharged through the discharge transistor in a state in which the first and second source short circuit switches are set in a conducting state.

According to the above embodiment, a display OFF control operation can be performed using a simple configuration without supplying a specific OFF voltage.

The display driver according to this embodiment may comprise:

a common electrode voltage generation circuit which generates the common electrode voltage; and a source line driver circuit for driving the first or second source line of the electro-optical device based on display data;

wherein, in a first operation mode, the source line driver circuit may supply a voltage corresponding to the display data to the first or second source line and the common electrode voltage generation circuit may supply the common electrode voltage to the common electrode in a state in which the source voltage output node and the common electrode voltage output node are electrically disconnected after setting outputs of the source line driver circuit and the common electrode voltage generation circuit in a high impedance state and electrically connecting the source voltage output node and the common electrode voltage output node.

In the display driver according to this embodiment, in a second operation mode, the source line driver circuit may supply a voltage corresponding to the display data to the first or second source line in a state in which the first or second source output node and the second capacitor element connection node are electrically disconnected after electrically connecting the first or second source output node and the second capacitor element connection node in a state in which the output of the source line driver circuit is set in a high impedance state, and the common electrode voltage generation circuit may supply the common electrode voltage to the common electrode in a state in which the common electrode voltage output node and the first capacitor element connection node are electrically disconnected after electrically connecting the common electrode voltage output node and the first capacitor element connection node in a state in which the output of the common electrode voltage generation circuit is set in a high impedance state.

The display driver according to this embodiment may comprise:

a demultiplexer for separating a time-division multiplexed voltage of each source output node into a plurality of output voltages;

wherein each of the output voltages may be supplied to each of the source lines of the electro-optical device.

The above embodiment may be applied to drive an electro-optical device in which the data signal is time-division multiplexed.

According to another embodiment of the invention, there is provided an electro-optical device comprising:

a plurality of source lines;

a plurality of gate lines;

a plurality of pixel electrodes, each of the pixel electrodes being specified by one of the source lines and one of the gate lines;

a common electrode opposite to the pixel electrodes;

a common electrode charge storage switch provided between a first capacitor element connection node to which one end of a first capacitor element can be connected and a common electrode voltage output node to which a common electrode voltage applied to the common electrode is supplied;

a common line electrically connected with a second capacitor element connection node to which one end of a second capacitor element can be connected;

a node short circuit switch provided between the common electrode voltage output node and the common line;

a first source short circuit switch provided between a first source output node, to which a voltage output to a first source line of the source lines is supplied, and the common line;

a second source short circuit switch provided between a second source output node, to which a voltage output to a second source line of the source lines is supplied, and the common line; and a source charge storage switch provided between the common line and the second capacitor element connection node.

In the electro-optical device according to this embodiment, in a first operation mode, after setting the node short circuit switch in a conducting state while setting the common electrode charge storage switch and the source charge storage switch in a nonconducting state, the common electrode may be driven by supplying the common electrode voltage to the common electrode voltage output node, and the first or second source line may be driven by supplying a voltage corresponding to display data to the first or second source line.

In the electro-optical device according to this embodiment, in a second operation mode, the node short circuit switch is set in a nonconducting state, the common electrode may be driven by supplying the common electrode voltage to the common electrode voltage output node in a state in which the common electrode voltage output node and the first capacitor element connection node are electrically disconnected using the common electrode charge storage switch after electrically connecting the common electrode voltage output node and the first capacitor element connection node using the common electrode charge storage switch, and the first or second source line may be driven by supplying a voltage corresponding to display data to the first or second source line in a state in which the common line and the second capacitor element connection node are electrically disconnected using the source charge storage switch after electrically connecting the common line and the second capacitor element connection node using the source charge storage switch.

In the electro-optical device according to this embodiment, a period in which the common electrode voltage output node is electrically connected with the first capacitor element connection node may coincide with (overlap) a period in which the first or second source voltage output node is electrically connected with the second capacitor element connection node.

The electro-optical device according to this embodiment may comprise:

a discharge transistor connected with the common line;

wherein the discharge transistor may be used in common to discharge the first and second source lines.

In the electro-optical device according to this embodiment, in a select period of the pixel electrode, the first and second source lines may be discharged through the discharge transistor in a state in which the first and second source short circuit switches are set in a conducting state.

The electro-optical device according to this embodiment may comprise:

a demultiplexer for separating a time-division multiplexed voltage of each source output node into a plurality of output voltages;

wherein each of the output voltages may be supplied to each of the source lines.

According to a further embodiment of the invention, there is provided an electronic instrument comprising the above display driver.

According to the above embodiment, an electro-optical device can be provided which can reduce power consumption by recycling charges and allows priority to be given to a reduction in power consumption or a reduction in cost using a simple configuration.

According to a further embodiment of the invention, there is provided an electronic instrument comprising the above electro-optical device.

According to the above embodiment, an electronic instrument can be provided which can reduce power consumption by recycling charges and allows priority to be given to a reduction in power consumption or a reduction in cost using a simple configuration.

Embodiments of the invention are described below in detail with reference to the drawings. Note that the embodiments described below do not in any way limit the scope of the invention laid out in the claims. Note that all of the elements of the embodiments described below should not necessarily be taken as essential requirements for the invention.

1. Liquid Crystal Device

FIG. 1 shows an example of a block diagram of a liquid crystal device according to this embodiment.

A liquid crystal device 10 (liquid crystal display device; display device in a broad sense) includes a display panel 12 (liquid crystal display (LCD) panel in a narrow sense), a source line driver circuit 20 (source driver in a narrow sense), a gate line driver circuit 30 (gate driver in a narrow sense), a display controller 40, and a power supply circuit 50. The liquid crystal device 10 need not necessarily include all of these circuit blocks. The liquid crystal device 10 may have a configuration in which some of the circuit blocks are omitted.

The display panel 12 (electro-optical device in a broad sense) includes a plurality of gate lines (scan lines), a plurality of source lines (data lines), and a plurality of pixel electrodes each of which is specified by the gate line and the source line. In this case, an active matrix type liquid crystal device may be formed by connecting a thin film transistor TFT (switching element in a broad sense) with the source line and connecting the pixel electrode with the thin film transistor TFT.

In more detail, the display panel 12 is formed on an active matrix substrate (e.g. glass substrate). A plurality of gate lines $G_1$ to $G_M$ (M is a positive integer of two or more), arranged in a direction Y in FIG. 1 and extending in a direction X, and a plurality of source lines $S_1$ to $S_N$ (N is a positive integer of two or more), arranged in the direction X and extending in the direction Y, are disposed on the active matrix substrate. A thin film transistor $TFT_{KL}$ (switching element in a broad sense) is provided at a position corresponding to the intersection of the gate line $G_K$ ($1 \leqq K \leqq M$, K is a positive integer) and the source line $S_L$ ($1 \leqq L \leqq N$, L is a positive integer).

A gate electrode of the thin film transistor $TFT_{KL}$ is connected with the gate line $G_K$, a source electrode of the thin film transistor $TFT_{KL}$ is connected with the source line $S_L$, and a drain electrode of the thin film transistor $TFT_{KL}$ is connected with a pixel electrode $PE_{KL}$. A liquid crystal capacitor $CL_{KL}$ (liquid crystal element) and a storage capacitor $CS_{KL}$ are formed between the pixel electrode $PE_{KL}$ and a common electrode CE opposite to the pixel electrode $PE_{KL}$ through a liquid crystal (electro-optical material in a broad sense). The liquid crystal is sealed between the active matrix substrate, on which the thin film transistor $TFT_{KL}$, the pixel electrode $PE_{KL}$, and the like are formed, and a common substrate on which the common electrode CE is formed. The transmissivity of the pixel changes depending on the voltage applied between the pixel electrode $PE_{KL}$ and the common electrode CE.

The voltage level of a common electrode voltage VCOM (high-potential-side voltage VCOMH and low-potential-side voltage VCOML) applied to the common electrode CE is generated by a common electrode voltage generation circuit included in the power supply circuit 50. The common electrode CE may be formed in a stripe pattern corresponding to each gate line instead of forming the common electrode CE over the entire common substrate.

The source line driver circuit 20 drives the source lines $S_1$ to $S_N$ of the display panel 12 based on display data. The gate line driver circuit 30 scans (sequentially drives) the gate lines $G_1$ to $G_M$ of the display panel 12.

The display controller 40 controls the source line driver circuit 20, the gate line driver circuit 30, and the power supply circuit 50 according to the content set by a host (not shown) such as a central processing unit (CPU). In more detail, the display controller 40 supplies an operation mode setting or a vertical synchronization signal or a horizontal synchronization signal generated therein to the source line driver circuit 20 and the gate line driver circuit 30, and controls the power supply circuit 50 regarding the polarity inversion timing of the voltage level of the common electrode voltage VCOM applied to the common electrode CE, for example.

The power supply circuit 50 generates various voltage levels (grayscale voltages) necessary for driving the display panel 12 and the voltage level of the common electrode voltage VCOM of the common electrode CE based on a reference voltage supplied from the outside.

In the liquid crystal device 10 having such a configuration, the source line driver circuit 20, the gate line driver circuit 30, and the power supply circuit 50 cooperate to drive the display panel 12 based on display data supplied from the outside under control of the display controller 40.

In FIG. 1, a display driver 60 may be formed as a semiconductor device (integrated circuit or IC) by integrating the source line driver circuit 20, the gate line driver circuit 30, and the power supply circuit 50. The display driver 60 shown in FIG. 1 may have a configuration in which the gate line driver circuit 30 is omitted. In FIG. 1, it suffices that the display driver 60 according to this embodiment include the source line driver circuit 20 and the common electrode voltage generation circuit of the power supply circuit 50.

The display driver 60 includes a plurality of source output switch circuits $SSW_1$ to $SSW_N$, each of which is provided between the source line and an output buffer which drives the source line. The output of the output buffer is connected with a first terminal of each source output switch circuit. The source line is connected with a second terminal of each source output switch circuit. One end of a common line COL is connected with a third terminal of each source output switch circuit. The source output switch circuits $SSW_1$ to $SSW_N$ are ON/OFF-controlled at the same time using a common control signal (not shown).

The display driver 60 may include a first capacitor element connection terminal TL1 and a common electrode charge storage switch VSW. The common electrode charge storage switch VSW is provided between the output of the common electrode voltage generation circuit of the power supply circuit 50 (common electrode voltage output node to which the common electrode voltage VCOM is supplied) and the first capacitor element connection terminal TL1. One end of a first capacitor element CCV is electrically connected with the first capacitor element connection terminal TL1. A specific power supply voltage (e.g. system ground power supply voltage VSS) is supplied to the other end of the first capacitor element CCV. In FIG. 1, the first capacitor element CCV is provided outside the display driver 60. Note that the first capacitor element CCV may be provided in the display driver 60.

The display driver 60 may include a source charge storage second capacitor element connection terminal TL2 and a source charge storage switch CSW. The source charge storage switch CSW is provided between the other end of the common line COL and the second capacitor element connection terminal TL2. When the source charge storage switch CSW is set in a conducting state, the source output switch circuits $SSW_1$ to $SSW_N$ electrically connect the source lines $S_1$ to $S_N$ with the common line COL, respectively.

In other words, the common line COL includes a second capacitor element connection node. One end of a second capacitor element CCS is electrically connected with the second capacitor element connection terminal TL2. A specific power supply voltage (e.g. system ground power supply voltage VSS) is supplied to the other end of the second capacitor element CCS. In FIG. 1, the second capacitor element CCS is provided outside the display driver 60. Note that the second capacitor element CCS may be provided in the display driver 60.

When the common electrode charge storage switch VSW is set in a conducting state, the output of the common electrode voltage generation circuit of the power supply circuit 50 is set in a high impedance state.

The display driver 60 may include a node short circuit switch HSW. The node short circuit switch HSW is provided between the common line COL and the common electrode voltage output node.

The display driver 60 recycles (or reuses) charges from the common electrode CE or the source lines $S_1$ to $S_N$ using the common electrode charge storage switch VSW, the source charge storage switch CSW, and the node short circuit switch HSW depending on the operation mode. In more detail, the display driver 60 performs control in a state in which the common electrode charge storage switch VSW is in a non-conducting state in the operation mode in which charges are recycled by ON/OFF control of the node short circuit switch HSW. The display driver 60 performs control in a state in which the node short circuit switch HSW is in a nonconducting state in the operation mode in which charges are recycled by ON/OFF control of the common electrode charge storage switch VSW and the source charge storage switch CSW.

In FIG. 1, the liquid crystal device 10 includes the display controller 40. Note that the display controller 40 may be provided outside the liquid crystal device 10. Or, the host may be provided in the liquid crystal device 10 together with the display controller 40. Some or all of the source line driver circuit 20, the gate line driver circuit 30, the display controller 40, and the power supply circuit 50 may be formed on the display panel 12.

Figure 2:
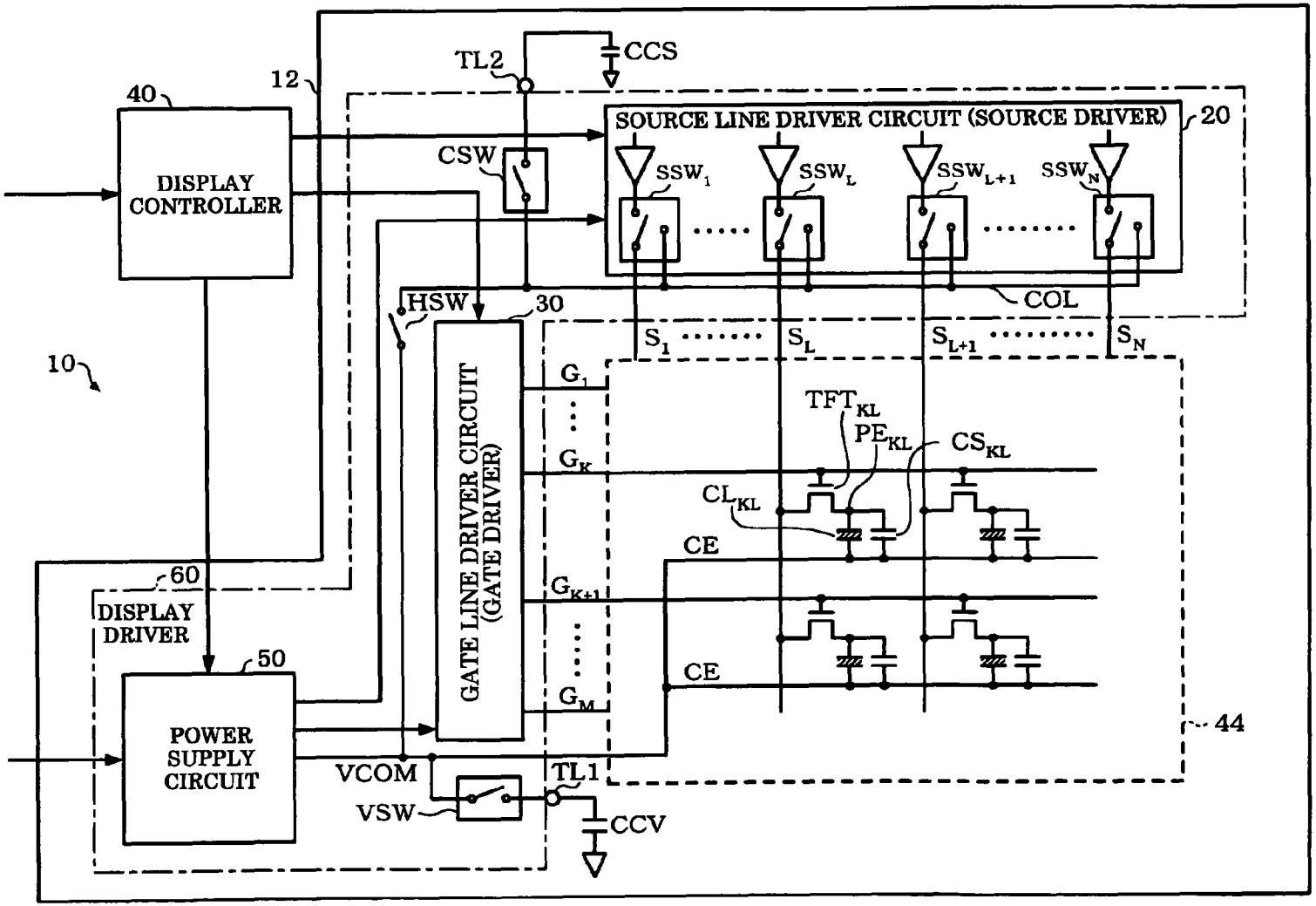
FIG. 2 is a block diagram of a configuration example of another liquid crystal device according to one embodiment of the invention.

FIG. 2 is a block diagram showing another configuration example of the liquid crystal device according to this embodiment.

In FIG. 2, the display driver 60 including the source line driver circuit 20, the gate line driver circuit 30, and the power supply circuit 50 is formed on the display panel 12 (on a panel substrate). Specifically, the display panel 12 may be configured to include a plurality of gate lines, a plurality of source lines, a plurality of pixels (pixel electrodes) each of which is specified by one of the gate lines and one of the source lines, a source line driver circuit which drives the source lines, and a gate line driver circuit which scans the gate lines. The pixels are formed in a pixel formation region 44 of the display panel 12. Each pixel may include a thin film transistor TFT of which the source is connected with the source line and the gate is connected with the gate line, and a pixel electrode connected with the drain of the thin film transistor TFT.

In FIG. 2, at least one of the gate line driver circuit 30 and the power supply circuit 50 may be omitted from the display panel 12.

In FIG. 1 or 2, the display driver 60 may include the display controller 40. In FIG. 1 or 2, the display driver 60 may be a semiconductor device in which either the source line driver circuit 20 or the gate line driver circuit 30 and the power supply circuit 50 are integrated.

2. Display Driver

The main configuration of the display driver 60 shown in FIG. 1 or 2 is described below.

Figure 3:
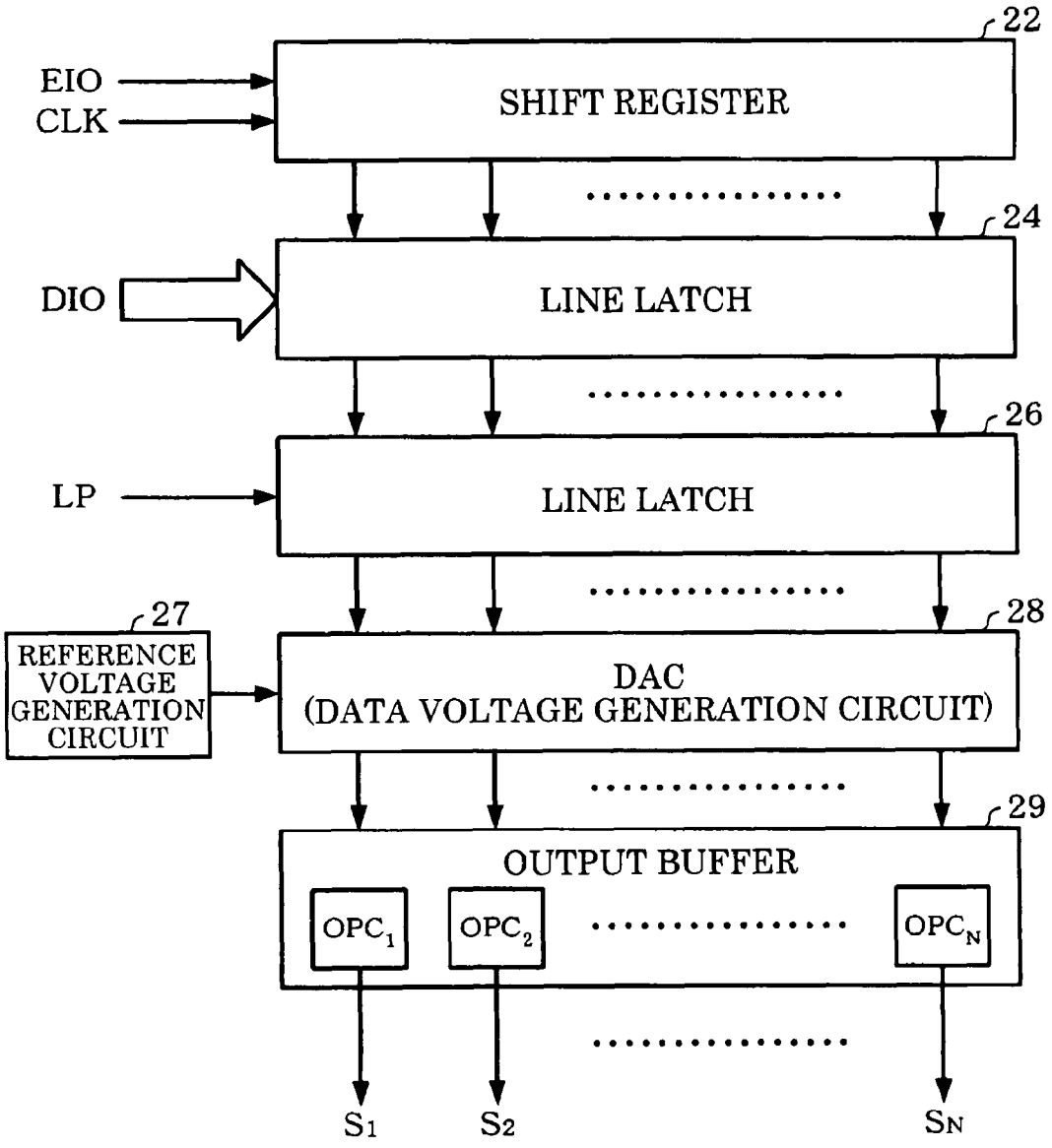
FIG. 3 is a block diagram of a configuration example of a source line driver circuit shown in FIG. 1 or 2.

FIG. 3 is a block diagram showing a configuration example of the source line driver circuit 20 shown in FIG. 1 or 2.

The source line driver circuit 20 includes a shift register 22, a line latch 24, a digital-to-analog converter (DAC) 28 (data voltage generation circuit in a broad sense), and an output buffer 29.

The shift register 22 includes a plurality of flip-flops provided corresponding to the source lines and sequentially connected. The shift register 22 holds an enable input-output signal EIO in synchronization with a clock signal CLK, and sequentially shifts the enable input-output signal EIO to the adjacent flip-flops in synchronization with the clock signal CLK.

Display data (DIO) is input to the line latch 24 from the display controller 40 in units of 18 bits (6 bits(display data)× 3(each color of RGB)), for example. The line latch 24 latches the display data (DIO) in synchronization with the enable input-output signal EIO sequentially shifted by each flip-flop of the shift register 22.

The line latch 26 latches the display data in horizontal scan units latched by the line latch 24 in synchronization with a horizontal synchronization signal LP supplied from the display controller 40.

A reference voltage generation circuit 27 generates 64 reference voltages. The 64 reference voltages generated by the reference voltage generation circuit 27 are supplied to the DAC 28.

The DAC 28 (data voltage generation circuit) generates an analog data voltage supplied to each source line. In more detail, the DAC 28 selects one of the reference voltages from the reference voltage generation circuit 27 based on the digital display data from the line latch 26, and outputs an analog data voltage corresponding to the digital display data.

The output buffer 29 buffers the data voltage from the DAC 28, and drives the source line by outputting the data voltage to the source line. In more detail, the output buffer 29 includes operational amplifier circuit blocks $OPC_1$ to $OPC_N$ provided in source line units and including a voltage-follower-connected operational amplifier. The operational amplifier circuit block subjects the data voltage from the DAC 28 to impedance conversion and outputs the resulting data voltage to the source line.

FIG. 3 employs a configuration in which the digital display data is subjected to digital-analog conversion and output to the source line through the output buffer 29. Note that a configuration may also be employed in which an analog image signal is sampled/held and output to the source line through the output buffer 29.

Figure 4:
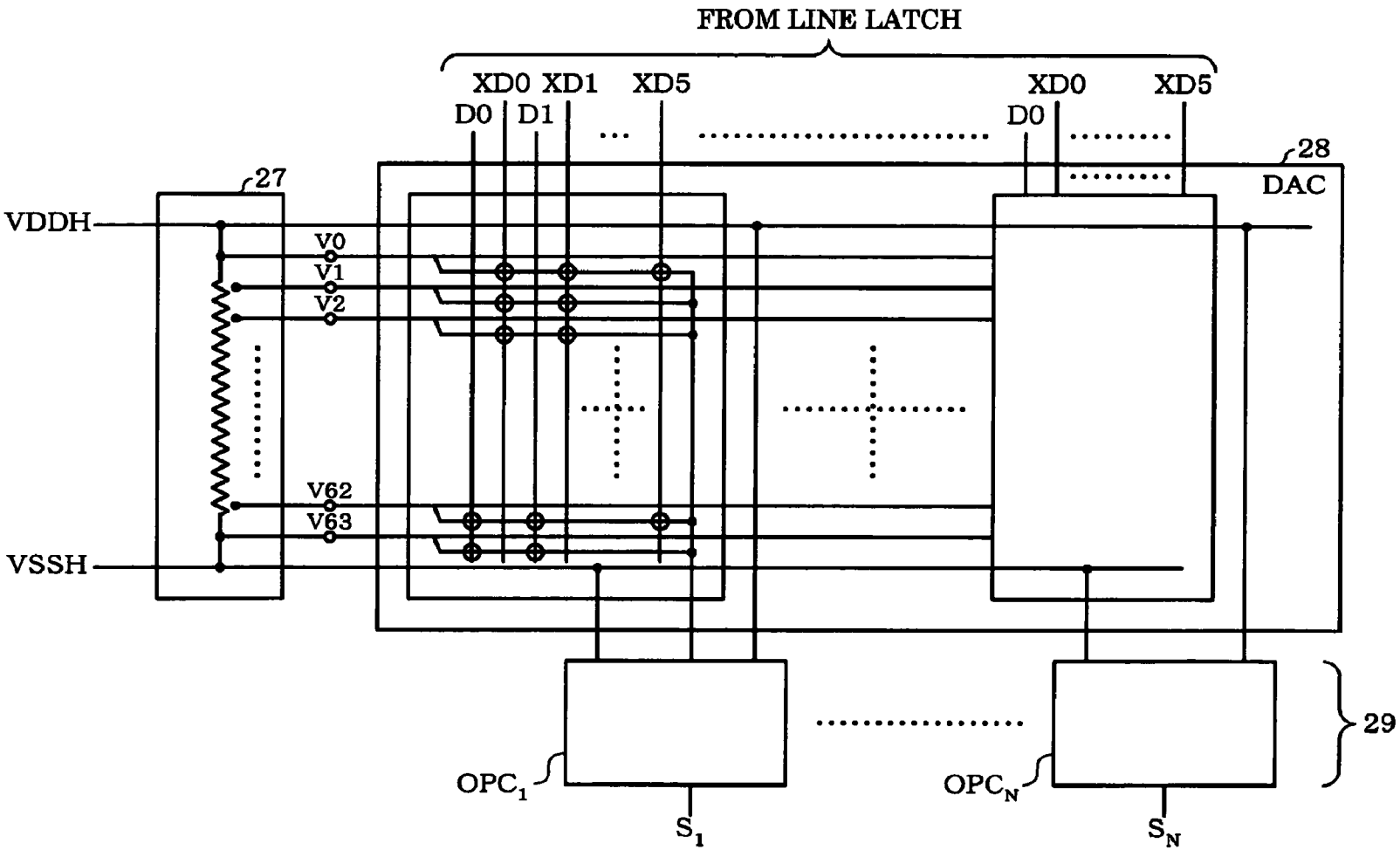
FIG. 4 is a view showing a configuration of a reference voltage generation circuit, a DAC, and an output buffer shown in FIG. 3.

FIG. 4 shows a configuration example of the reference voltage generation circuit 27, the DAC 28, and the output buffer 29 shown in FIG. 3. In FIG. 4, the display data is 6-bit data D0 to D5, and inversion data of each bit of the display data is indicated by XD0 to XD5. In FIG. 4, the same sections as in FIG. 3 are indicated by the same symbols. Description of these sections is appropriately omitted.

The reference voltage generation circuit 27 generates the 64 reference voltages by dividing voltages VDDH and VSSH generated by the power supply circuit 50 using resistors. The reference voltages respectively correspond to grayscale values indicated by the six-bit display data. The reference voltage is supplied in common to the source lines $S_1$ to $S_N$.

The DAC 28 includes decoders provided in source line units. The decoders respectively output the reference voltage corresponding to the display data to the operational amplifier circuit blocks $OPC_1$ to $OPC_N$.

FIGS. 3 and 4 illustrate a configuration example when the display data is supplied in line units. Note that the display driver 60 may include a display memory which stores the display data for at least one frame.

Figure 5:
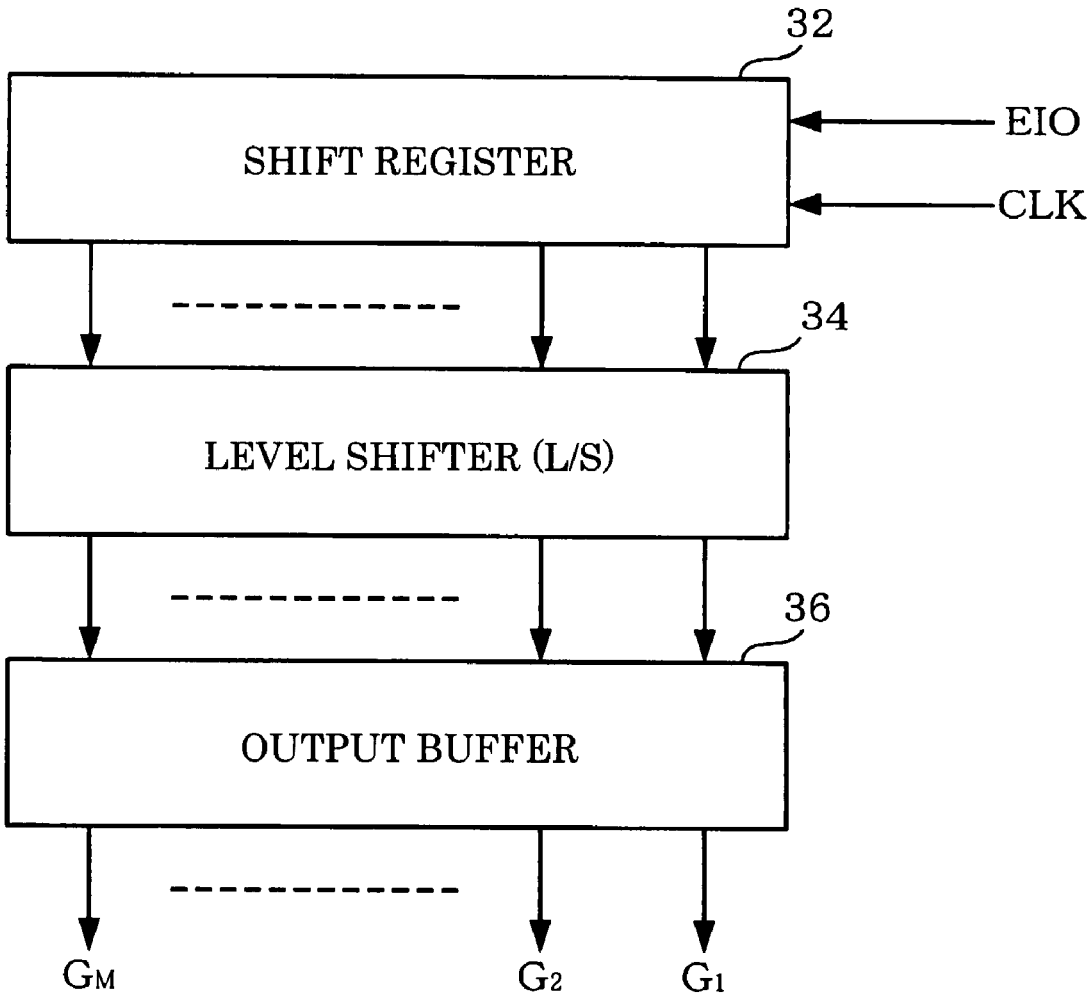
FIG. 5 is a block diagram of a configuration example of a gate line driver circuit shown in FIG. 1 or 2.

FIG. 5 shows a configuration example of the gate line driver circuit 30 shown in FIG. 1 or 2.

The gate line driver circuit 30 includes a shift register 32, a level shifter 34, and an output buffer 36.

The shift register 32 includes a plurality of flip-flops provided corresponding to the gate lines and sequentially connected. The shift register 32 holds the enable input-output signal EIO in the flip-flop in synchronization with the clock signal CLK, and sequentially shifts the enable input-output signal EIO to the adjacent flip-flops in synchronization with the clock signal CLK. The enable input-output signal EIO input to the shift register 32 is the vertical synchronization signal supplied from the display controller 40.

The level shifter 34 shifts the voltage level from the shift register 32 to the voltage level corresponding to the liquid crystal element of the display panel 12 and the transistor capability of the thin film transistor TFT. Since a high voltage level is required as the above voltage level, a high voltage process is used for the level shifter 34 differing from other logic circuit sections.

The output buffer 36 buffers the scan voltage shifted by the level shifter 34, and drives the gate lines by outputting the scan voltage to the gate lines.

Figure 6:
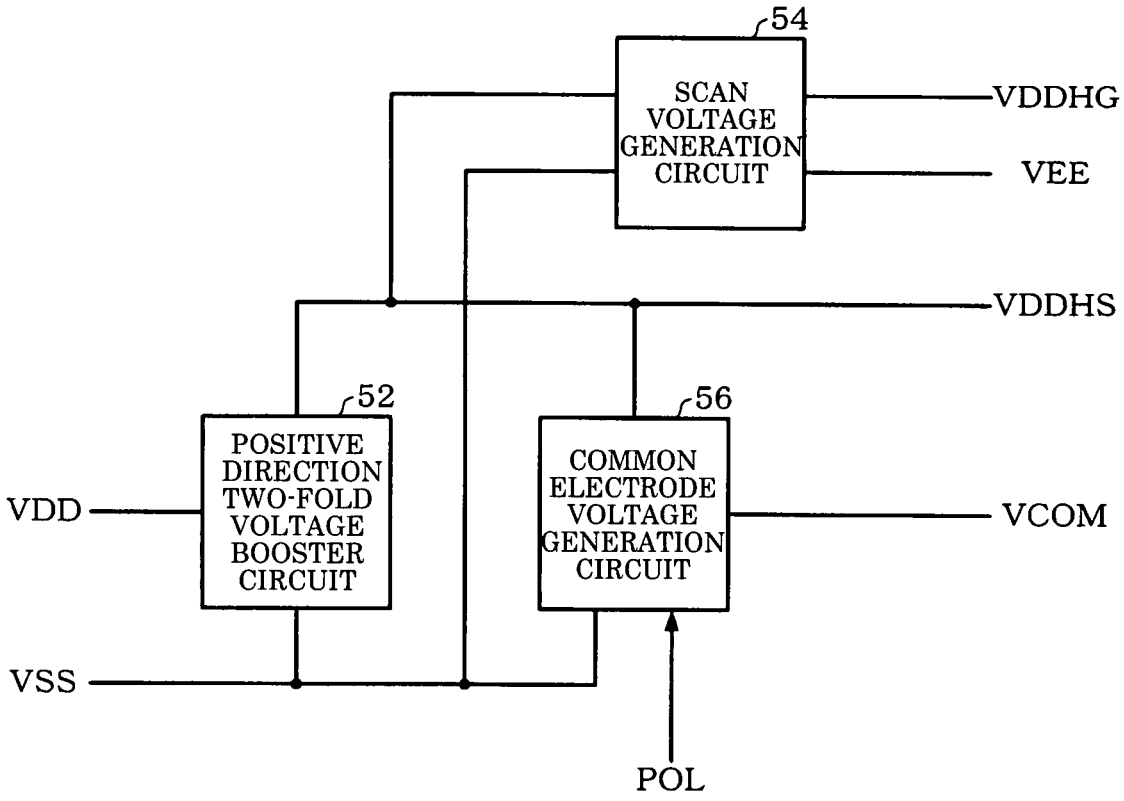
FIG. 6 is a block diagram showing a configuration example of a power supply circuit shown in FIG. 1 or 2.

FIG. 6 shows a configuration example of the power supply circuit 50 shown in FIG. 1 or 2.

The power supply circuit 50 includes a positive-direction two-fold voltage booster circuit 52, a scan voltage generation circuit 54, and a common electrode voltage generation circuit 56. A system ground power supply voltage VSS and a system power supply voltage VDD are supplied to the power supply circuit 50.

The system ground power supply voltage VSS and the system power supply voltage VDD are supplied to the positive-direction two-fold voltage booster circuit 52. The positive-direction two-fold voltage booster circuit 52 generates a power supply voltage VDDHS by increasing the system power supply voltage VDD by a factor of two in the positive direction with respect to the system ground power supply voltage VSS. Specifically, the positive-direction two-fold voltage booster circuit 52 increases the voltage difference between the system ground power supply voltage VSS and the system power supply voltage VDD by a factor of two. The positive-direction two-fold voltage booster circuit 52 may be formed using a charge-pump circuit. The power supply voltage VDDHS is supplied to the source line driver circuit 20, the scan voltage generation circuit 54, and the common electrode voltage generation circuit 56. It is preferable that the positive-direction two-fold voltage booster circuit 52 output the power supply voltage VDDHS obtained by increasing the system power supply voltage VDD by a factor of two in the positive direction by increasing the system power supply voltage VDD by a factor of two or more and adjusting the voltage level using a regulator.

The system ground power supply voltage VSS and the power supply voltage VDDHS are supplied to the scan voltage generation circuit 54. The scan voltage generation circuit 54 generates a scan voltage. The scan voltage is a voltage applied to the gate line selected by the gate line driver circuit 30. The high-potential-side voltage and the low-potential-side voltage of the scan voltage are respectively voltages VDDHG and VEE.

The common electrode voltage generation circuit 56 generates the common electrode voltage VCOM. The common electrode voltage generation circuit 56 outputs the high-potential-side voltage VCOMH or the low-potential-side voltage VCOML as the common electrode voltage VCOM based on a polarity inversion signal POL. The polarity inversion signal POL is generated by the display controller 40 in synchronization with the polarity inversion timing.

Figure 7:
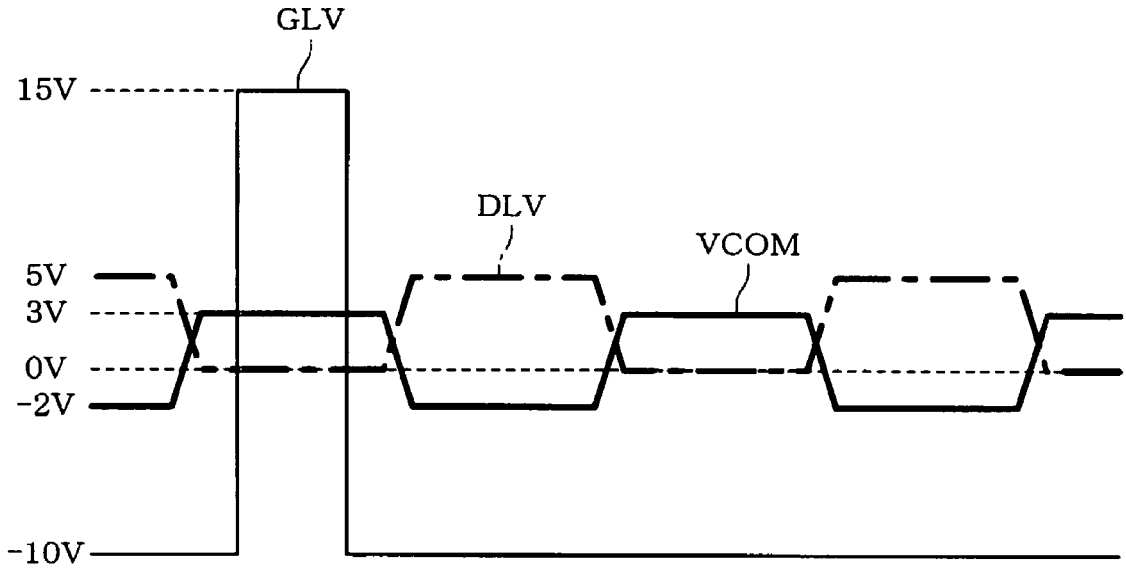
FIG. 7 is a view showing an example of a drive waveform of a display panel shown in FIG. 1 or 2.

FIG. 7 shows an example of a drive waveform of the display panel 12 shown in FIG. 1 or 2.

A grayscale voltage DLV corresponding to the grayscale value of the display data is applied to the source line. In FIG. 7, the grayscale voltage DLV has an amplitude of 5 V with respect to the system ground power supply voltage VSS (=0 V).

A scan voltage GLV at a low-potential-side voltage VEE (=−10 V) (unselected) or a high-potential-side voltage VDDHG (=15 V) (selected) is applied to the gate line.

The common electrode voltage VCOM at a high-potential-side voltage VCOMH (=3 V) or a low-potential-side voltage VCOML (=−2 V) is applied to the common electrode CE. The polarity of the voltage level of the common electrode voltage VCOM is reversed at a polarity inversion timing with respect to a given voltage. FIG. 7 shows the waveform of the common electrode voltage VCOM during scan line inversion driving. The polarity of the grayscale voltage DLV applied to the source line is also reversed at the polarity inversion timing with respect to a given voltage.

The liquid crystal element deteriorates when a direct-current voltage is applied to the liquid crystal element for a long period of time. This requires a driving method in which the polarity of the voltage applied to the liquid crystal element is reversed in units of specific periods. As such a driving method, a frame inversion driving method, a scan (gate) line inversion driving method, a data (source) line inversion driving method, a dot inversion driving method, and the like can be given.

The frame inversion driving method reduces power consumption, but results in an insufficient image quality. The data line inversion driving method and the dot inversion driving method provide an excellent image quality, but require a high voltage for driving the display panel.

This embodiment employs the scan line inversion driving method, for example. In the scan line inversion driving method, the polarity of the voltage applied to the liquid crystal element is reversed in units of scan periods (in units of gate lines). For example, a positive voltage is applied to the liquid crystal element in the first scan period (gate line), a negative voltage is applied to the liquid crystal element in the second scan period, and a positive voltage is applied to the liquid crystal element in the third scan period. In the subsequent frame, a negative voltage is applied to the liquid crystal element in the first scan period, a positive voltage is applied to the liquid crystal element in the second scan period, and a negative voltage is applied to the liquid crystal element in the third scan period.

In the scan line inversion driving method, the polarity of the voltage level of the common electrode voltage VCOM applied to the common electrode CE is reversed in units of scan periods.

Figure 8:
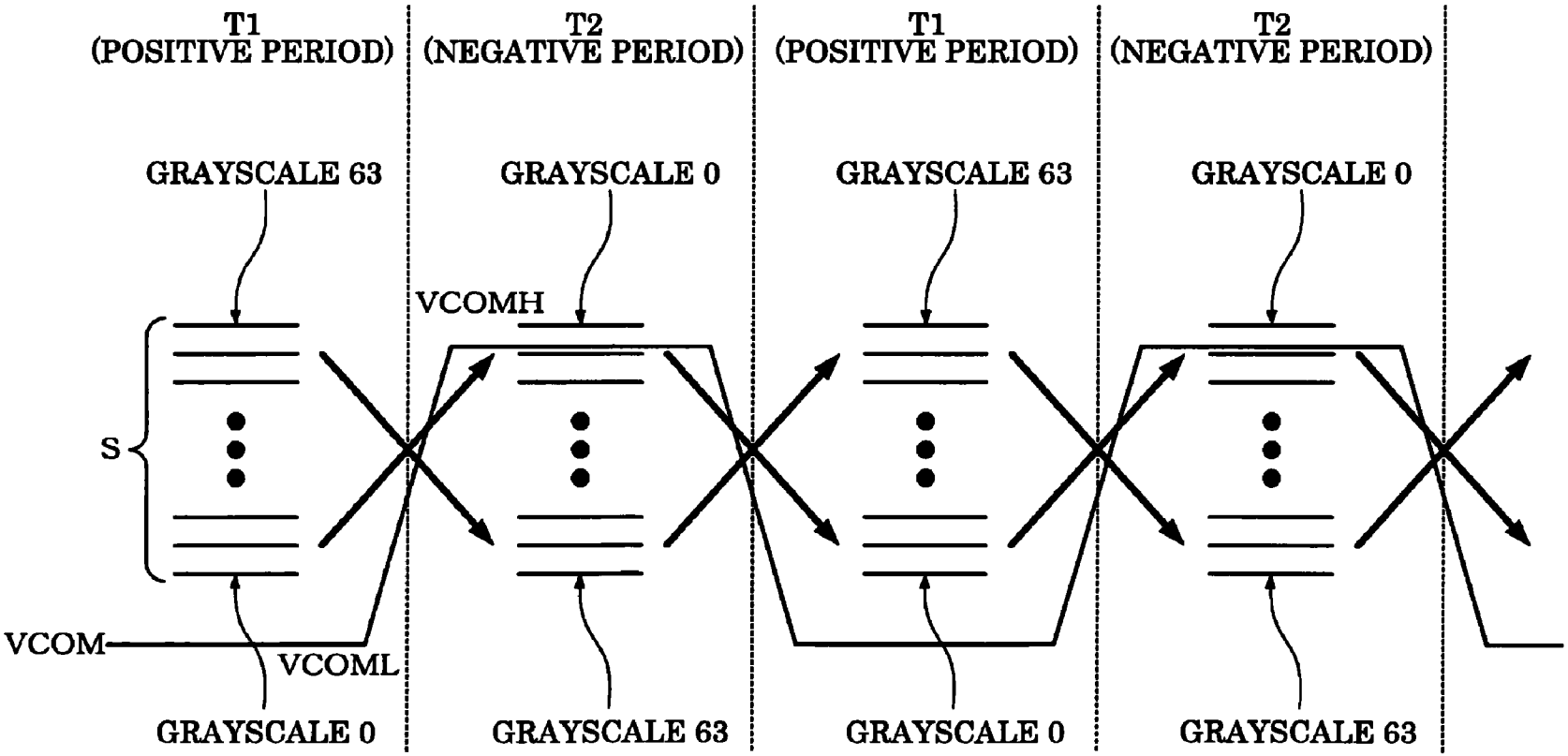
FIG. 8 is a view illustrative of a scan line inversion driving method.

In more detail, the voltage level of the common electrode voltage VCOM is set at the low-potential-side voltage VCOML in a positive period T1 (first period) and is set at the high-potential-side voltage VCOMH in a negative period T2 (second period), as shown in FIG. 8. The polarity of the grayscale voltage applied to the source line is also reversed at the above timing. The low-potential-side voltage VCOML is a voltage level obtained by reversing the polarity of the high-potential-side voltage VCOMH with respect to a given voltage level.

The positive period T1 is a period in which the voltage level of the pixel electrode to which the grayscale voltage is supplied through the source line becomes higher than the voltage level of the common electrode CE. In the period T1, a positive voltage is applied to the liquid crystal element. The negative period T2 is a period in which the voltage level of the pixel electrode to which the grayscale voltage is supplied through the source line becomes lower than the voltage level of the common electrode CE. In the period T2, a negative voltage is applied to the liquid crystal element.

The voltage necessary for driving the display panel can be reduced by reversing the polarity of the common electrode voltage VCOM in this manner. This makes it possible to reduce the withstand voltage of the driver circuit, whereby the manufacturing process of the driver circuit can be simplified, and the manufacturing cost can be reduced.

3. Fundamental Configuration

In this embodiment, the display driver 60 or the LCD panel 12 includes an operation mode register (not shown), and controls charge recycling in the operation mode corresponding to control data set in the operation mode register. Or, the display driver 60 or the LCD panel 12 includes an operation mode setting terminal (external setting terminal) (not shown), and controls charge recycling in the operation mode corresponding to the state of the signal supplied to the operation mode setting terminal from the outside.

3.1 First Operation Mode

Figure 9:
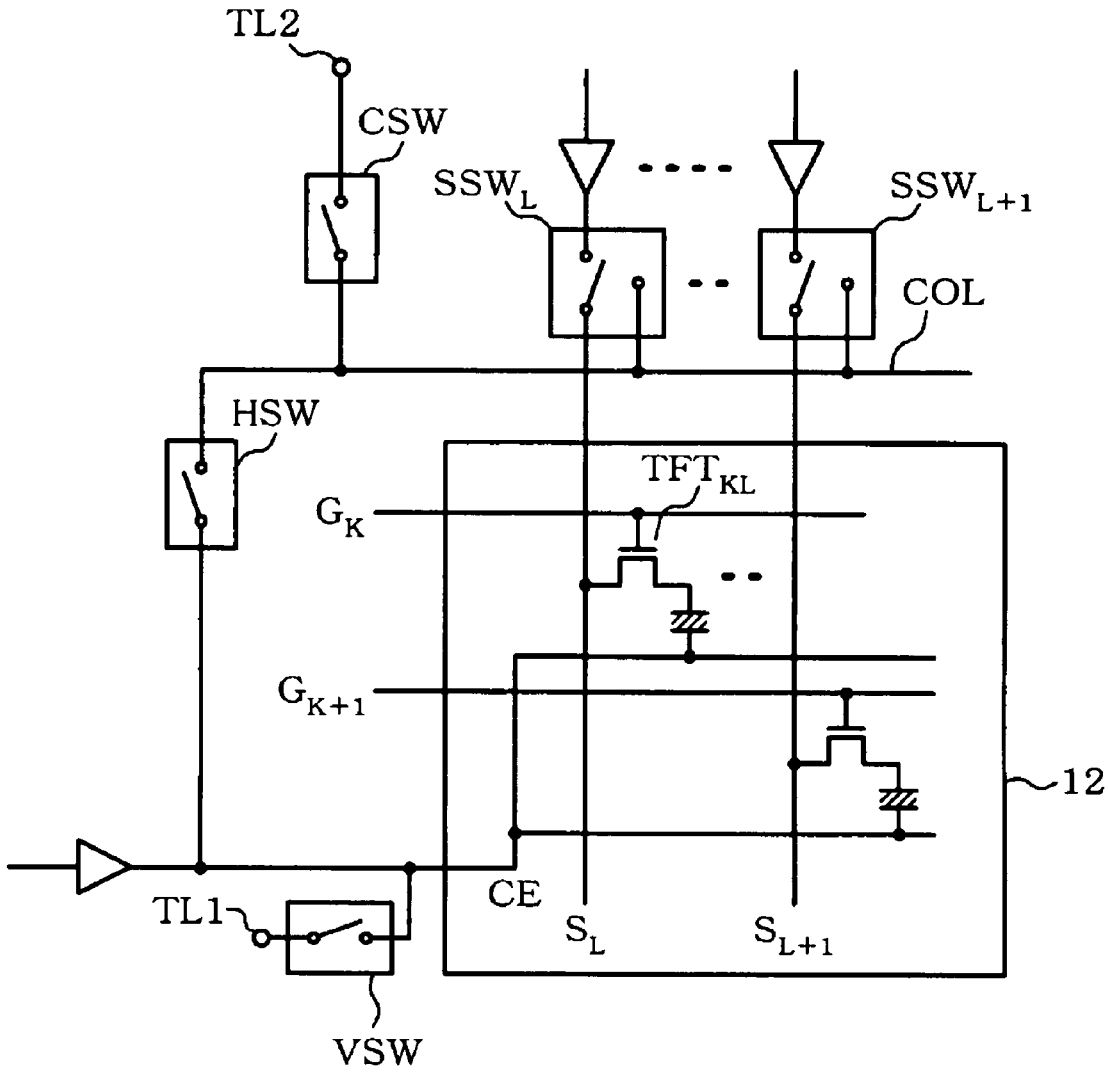
FIG. 9 is a fundamental configuration diagram of the liquid crystal device according to one embodiment of the invention in a first operation mode.

FIG. 9 is a fundamental configuration diagram of the liquid crystal device 10 according to this embodiment in a first operation mode.

In FIG. 9, the same sections as in FIG. 1 or 2 are indicated by the same symbols. Description of these sections is appropriately omitted. FIG. 9 shows an electric equivalent circuit of the pixel provided at the intersection of the gate line $G_K$ and the source line $S_L$ and an electric equivalent circuit of the pixel provided at the intersection of the gate line $G_{K+1}$ and the source line $S_{L+1}$. The electric equivalent circuits of other pixels are the same as those shown in FIG. 9. FIG. 9 shows only the source output switch circuit of the source line driver circuit 20, the source charge storage switch CSW, and the common electrode charge storage switch VSW.

Figure 10:
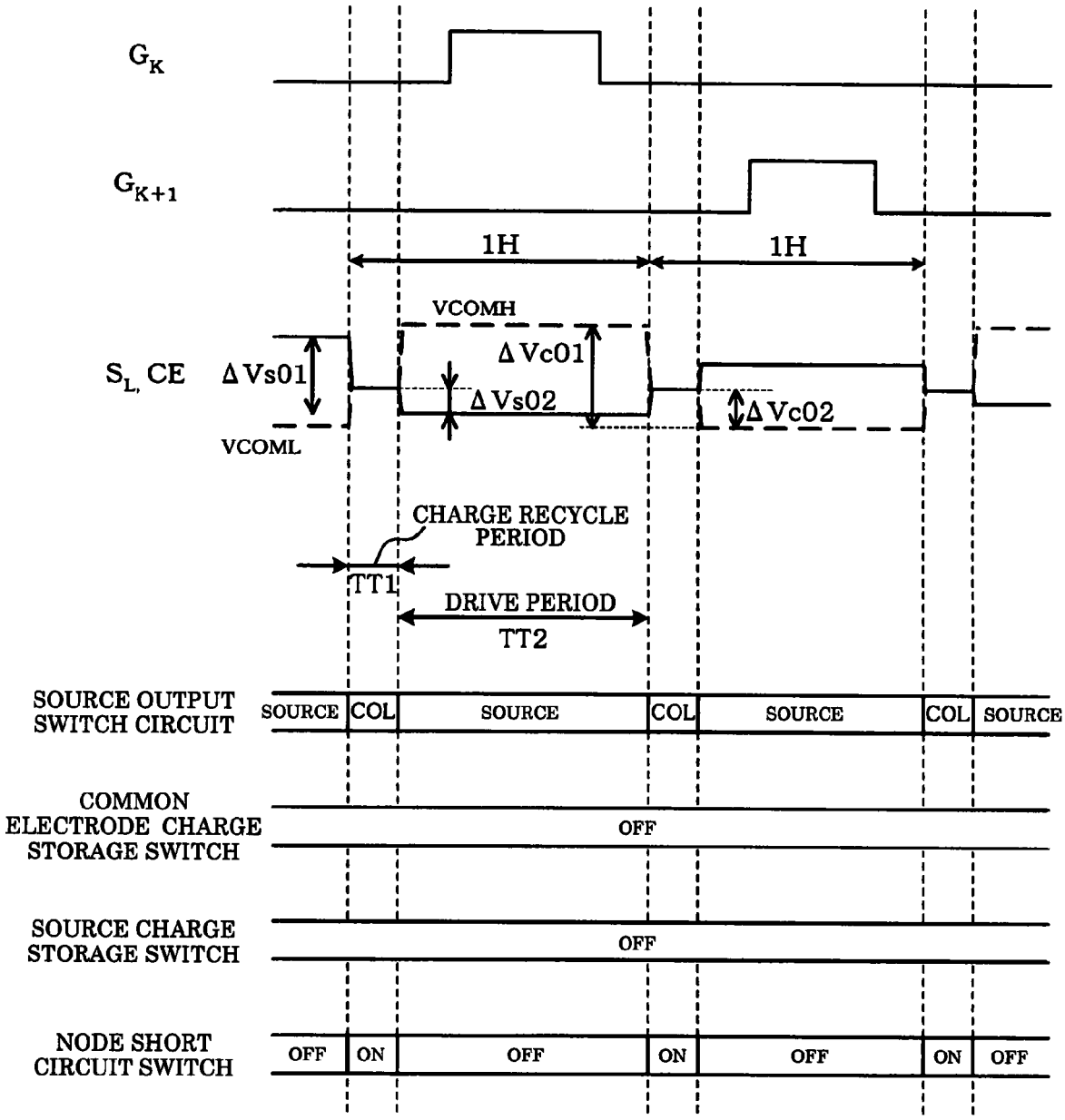
FIG. 10 is a waveform diagram of an operation example of the liquid crystal device shown in FIG. 9.

FIG. 10 is a waveform diagram of an operation example of the liquid crystal device 10 shown in FIG. 9.

FIG. 10 shows the changes in potentials of the gate lines $G_K$ and $G_{K+1}$, the source line $S_L$, and the common electrode CE. Note that the same waveforms apply to other gate lines and source lines. In FIG. 10, the scan voltage is applied to the gate line $G_K$ within one horizontal scan period (1H) which is a select period of the pixel connected with the gate line $G_K$, and the scan voltage is applied to the gate line $G_{K+1}$ within one horizontal scan period which is a select period of the pixel connected with the gate line $G_{K+1}$. Each horizontal scan period includes a charge recycle period provided in the first period and a drive period provided in the second period. The source output switch circuits $SSW_L$ and $SSW_{L+1}$ and the node short circuit switch HSW are switched when the period transitions from the charge recycle period to the drive period and when the period transitions from the drive period to the charge recycle period.

In the charge recycle period (TT1), the source lines $S_L$ and $S_{L+1}$ are electrically connected with the common line COL including the second capacitor element connection node through the source output switch circuits $SSW_L$ and $SSW_{L+1}$, respectively. The node short circuit switch HSW is set in a conducting state while the source charge storage switch CSW and the common electrode charge storage switch VSW remain in a nonconducting state, whereby the common line COL is electrically connected with the output of the common electrode voltage generation circuit (common electrode voltage output node to which the common electrode voltage VCOM is supplied). Therefore, the common line COL is electrically connected with the source lines $S_L$ and $S_{L+1}$ in the charge recycle period so that the source lines $S_L$ and $S_{L+1}$ and the common electrode CE are set at the same potential, whereby charges stored in parasitic capacitors of the source lines $S_L$ and $S_{L+1}$ are charged into the common electrode CE, or charges stored in the common electrode CE are charged into parasitic capacitors of the source lines $S_L$ and $S_{L+1}$ according to the charge conservation law. Specifically, the potentials of the source lines and the common electrode CE are changed in the charge recycle period without supplying charges from the power supply circuit 50.

In the drive period (TT2) after the charge recycle period, the source lines $S_L$ and $S_{L+1}$ are electrically connected with the outputs of the output buffers of the source line driver circuit 20 through the source output switch circuits $SSW_L$ and $SSW_{L+1}$, respectively. The source charge storage switch CSW and the common electrode charge storage switch VSW remain in a nonconducting state. The node short circuit switch HSW is set in a nonconducting state. Therefore, the source lines $S_L$ and $S_{L+1}$ are driven by the output buffers of the source line driver circuit 20 in the drive period. In this case, the output buffer of the source line driver circuit 20 charges and discharges the source line until each source line is set at a potential corresponding to the display data with respect to the potential set in the charge recycle period TT1. Accordingly, the voltage of the source line changed by the output buffer of the source line driver circuit 20 may be generally low in the drive period after the charge recycle period. Specifically, when setting the potential of the source line in the present horizontal scan period (select period of the pixel connected with the gate line $G_K$) based on the potential of the source line in the preceding horizontal scan period (select period of the pixel connected with the gate line $G_{K-1}$), the output buffer of the source line driver circuit 20 must charge and discharge the source line by ΔVs01, as shown in FIG. 10. On the other hand, it suffices that the output buffer of the source line driver circuit 20 charge and discharge the source line by ΔVs02 (ΔVs02<ΔVs01) by providing the charge recycle period, as shown in FIG. 10.

In the drive period (TT2) after the charge recycle period, the common electrode CE is electrically connected with the output of the common electrode voltage generation circuit 56 of the power supply circuit 50. Therefore, the common electrode voltage VCOM from the common electrode voltage generation circuit 56 is supplied to the common electrode CE in the drive period. In this case, the common electrode voltage generation circuit 56 charges and discharges the common electrode CE until the high-potential-side voltage VCOMH is reached with respect to the potential set in the charge recycle period TT1. Accordingly, the voltage of the common electrode CE changed by the common electrode voltage generation circuit 56 is reduced in the drive period after the charge recycle period. Specifically, when setting the potential of the common electrode CE in the present horizontal scan period (select period of the pixel connected with the gate line $G_K$) based on the potential of the common electrode CE in the preceding horizontal scan period (select period of the pixel connected with the gate line $G_{K-1}$), the common electrode voltage generation circuit 56 must charge and discharge the common electrode CE by ΔVc01, as shown in FIG. 10. On the other hand, it suffices that the common electrode voltage generation circuit 56 charge and discharge the common electrode CE by ΔVc02 (ΔVc02<ΔVc01) by providing the charge recycle period, as shown in FIG. 10.

3.2 Second Operation Mode

Figure 11:
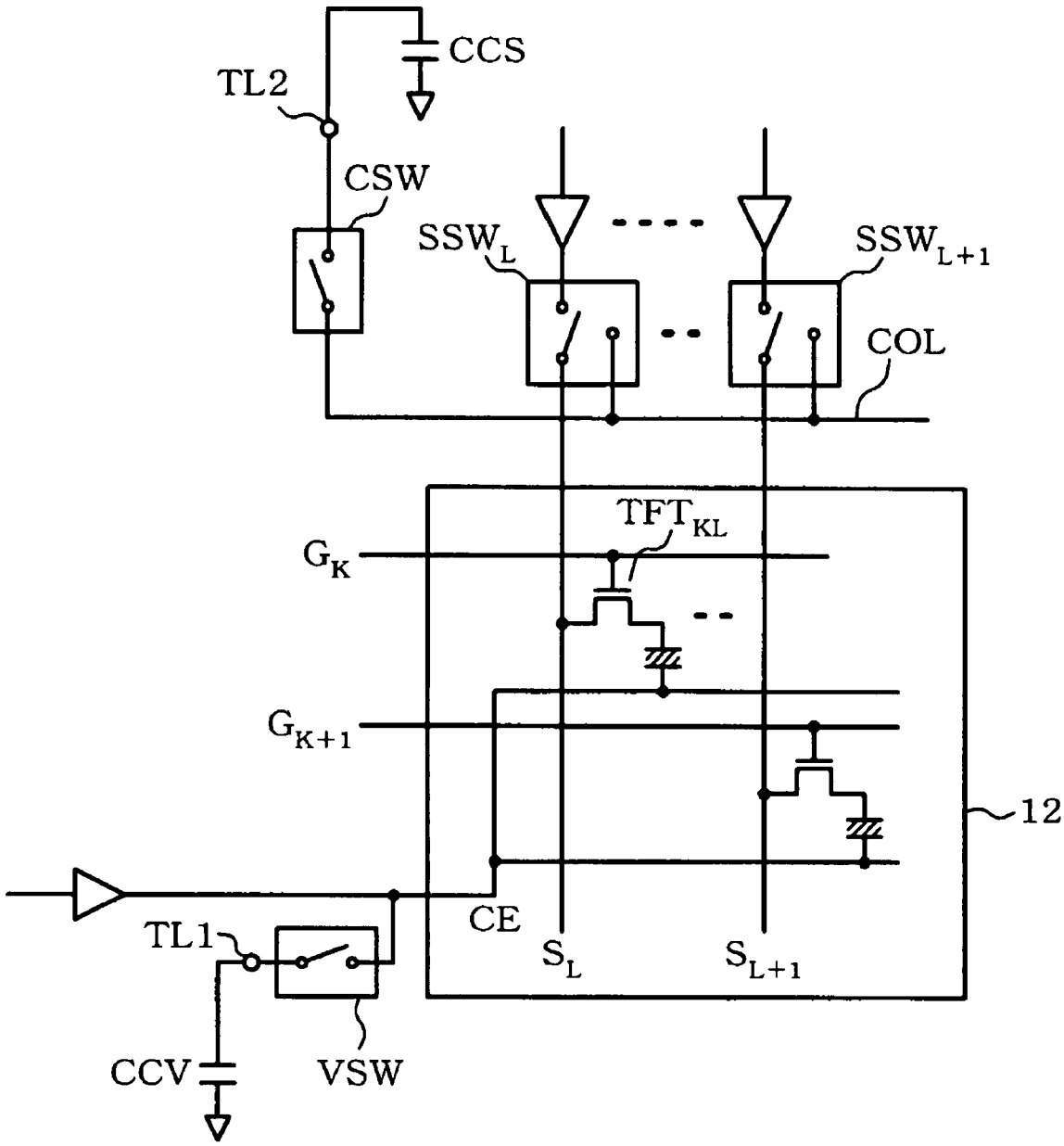
FIG. 11 is a fundamental configuration diagram of the liquid crystal device according to one embodiment of the invention in a second operation mode.

FIG. 11 is a fundamental configuration diagram of the liquid crystal device 10 according to this embodiment in a second operation mode.

In FIG. 11, the same sections as in FIG. 1 or 2 are indicated by the same symbols. Description of these sections is appropriately omitted. FIG. 11 shows an electric equivalent circuit of the pixel provided at the intersection of the gate line $G_K$ and the source line $S_L$ and an electric equivalent circuit of the pixel provided at the intersection of the gate line $G_{K+1}$ and the source line $S_{L+1}$. The electric equivalent circuits of other pixels are the same as those shown in FIG. 9. FIG. 11 shows the source output switch circuit of the source line driver circuit 20, the source charge storage switch CSW, the common electrode charge storage switch VSW, and the node short circuit switch HSW.

Figure 12:
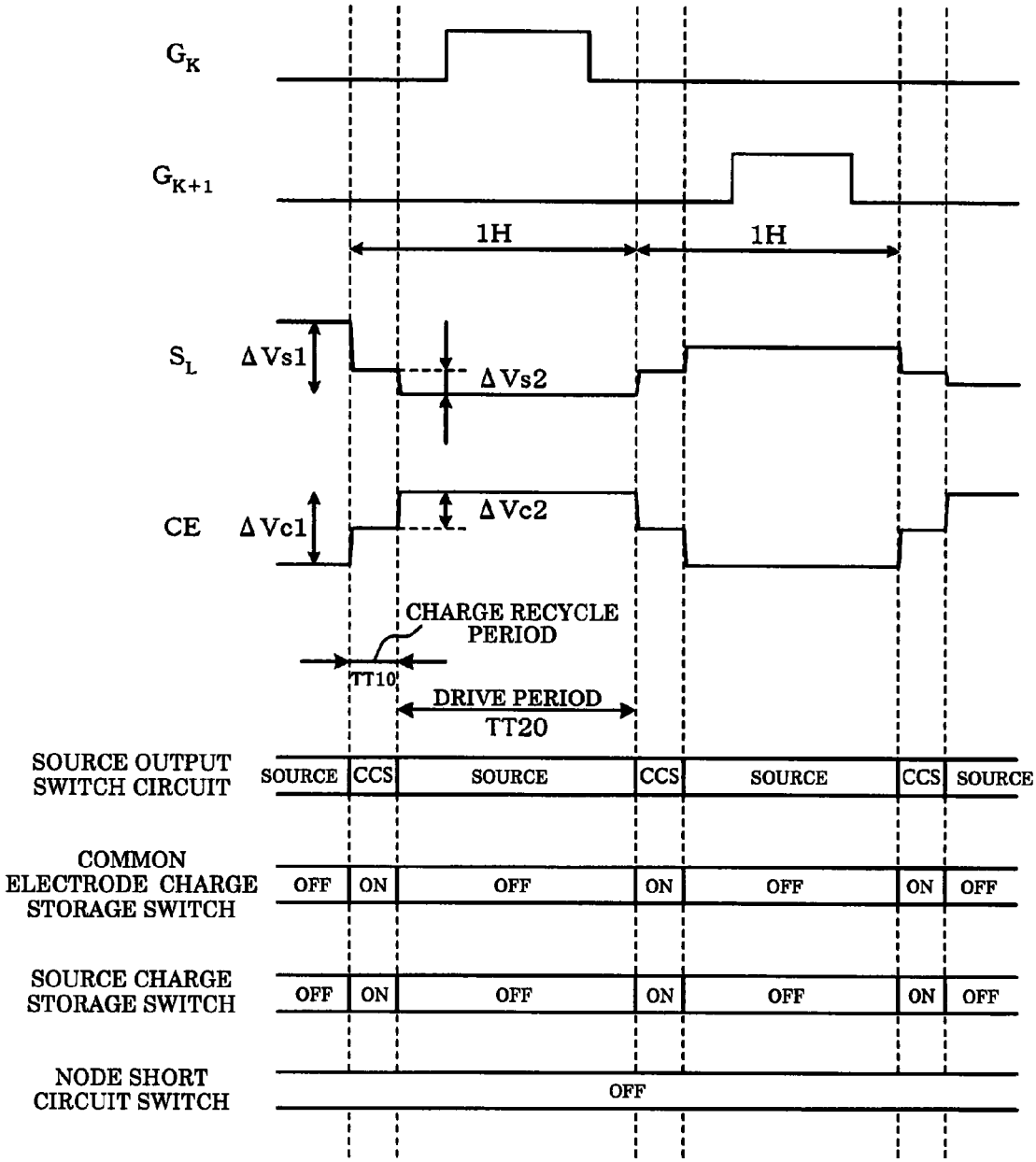
FIG. 12 is a waveform diagram of an operation example of the liquid crystal device shown in FIG. 11.

FIG. 12 is a waveform diagram of an operation example of the liquid crystal device 10 shown in FIG. 11.

FIG. 12 shows the changes in potentials of the gate lines $G_K$ and $G_{K+1}$, the source line $S_L$, and the common electrode CE. Note that the same waveforms apply to other gate lines and source lines. In FIG. 12, the scan voltage is applied to the gate line $G_K$ within one horizontal scan period (1H) which is a select period of the pixel connected with the gate line $G_K$, and the scan voltage is applied to the gate line $G_{K+1}$ within one horizontal scan period which is a select period of the pixel connected with the gate line $G_{K+1}$. Each horizontal scan period includes a charge recycle period provided in the first period and a drive period provided in the second period. The source output switch circuits $SSW_L$ and $SSW_{L+1}$, the common electrode charge storage switch VSW, and the source charge storage switch CSW are switched when the period transitions from the charge recycle period to the drive period and when the period transitions from the drive period to the charge recycle period. In the second operation mode, the node short circuit switch HSW is set in a nonconducting state.

In the charge recycle period (TT10), the source lines $S_L$ and $S_{L+1}$ are electrically connected with the common line COL including the second capacitor element connection node through the source output switch circuits $SSW_L$ and $SSW_{L+1}$, respectively. The source charge storage switch CSW is set in a conducting state, whereby the common line COL is electrically connected with one end of the second capacitor element CCS through the second capacitor element connection terminal TL2. Therefore, one end of the second capacitor element CCS and the source lines $S_L$ and $S_{L+1}$ are set at the same potential in the charge recycle period, whereby charges stored in parasitic capacitors of the source lines are supplied to one end of the second capacitor element CCS, or charges stored in the second capacitor element CCS are charged into parasitic capacitors of the source lines $S_L$ and $S_{L+1}$ according to the charge conservation law. Specifically, the potentials of the source lines are changed in the charge recycle period without supplying charges from the power supply circuit 50.

In the charge recycle period, since the output of the common electrode voltage generation circuit (not shown) is set in a high impedance state and the common electrode charge storage switch VSW is set in a conducting state, the common electrode CE is electrically connected with one end of the first capacitor element CCV through the first capacitor element connection terminal TL1. Therefore, one end of the first capacitor element CCV and the common electrode CE are set at the same potential in the charge recycle period, whereby charges stored in a parasitic capacitor of the common electrode CE are supplied to one end of the first capacitor element CCV, or charges stored in the first capacitor element CCV are charged into a parasitic capacitor of the common electrode CE. Specifically, the potential of the common electrode CE is changed in the charge recycle period without supplying charges from the power supply circuit 50.

In the drive period (TT20) after the charge recycle period, the source lines $S_L$ and $S_{L+1}$ are electrically connected with the outputs of the output buffers of the source line driver circuit 20 through the source output switch circuits $SSW_L$ and $SSW_{L+1}$, respectively. The source charge storage switch CSW is set in a nonconducting state. Therefore, the source lines $S_L$ and $S_{L+1}$ are driven by the output buffers of the source line driver circuit 20 in the drive period. In this case, the output buffer of the source line driver circuit 20 charges and discharges the source line until each source line is set at a potential corresponding to the display data with respect to the potential set in the charge recycle period TT10. Accordingly, the voltage of the source line changed by the output buffer of the source line driver circuit 20 may be generally low in the drive period after the charge recycle period. Specifically, when setting the potential of the source line in the present horizontal scan period (select period of the pixel connected with the gate line $G_K$) based on the potential of the source line in the preceding horizontal scan period (select period of the pixel connected with the gate line $G_{K-1}$), the output buffer of the source line driver circuit 20 must charge and discharge the source line by ΔVs1, as shown in FIG. 12. On the other hand, it suffices that the output buffer of the source line driver circuit 20 charge and discharge the source line by ΔVs2 (ΔVs2<ΔVs1) by providing the charge recycle period, as shown in FIG. 12.

In the drive period (TT20) after the charge recycle period, the common electrode charge storage switch VSW is set in a nonconducting state, and the common electrode CE is electrically connected with the output of the common electrode voltage generation circuit 56 of the power supply circuit 50. Therefore, the common electrode voltage VCOM from the common electrode voltage generation circuit 56 is supplied to the common electrode CE in the drive period. In this case, the common electrode voltage generation circuit 56 charges and discharges the common electrode CE until the high-potential-side voltage VCOMH is reached with respect to the potential set in the charge recycle period TT10. Accordingly, the voltage of the common electrode CE changed by the common electrode voltage generation circuit 56 is reduced in the drive period after the charge recycle period. Specifically, when setting the potential of the common electrode CE in the present horizontal scan period (select period of the pixel connected with the gate line $G_K$) based on the potential of the common electrode CE in the preceding horizontal scan period (select period of the pixel connected with the gate line $G_{K-1}$), the common electrode voltage generation circuit 56 must charge and discharge the common electrode CE by ΔVc1, as shown in FIG. 12. On the other hand, it suffices that the common electrode voltage generation circuit 56 charge and discharge the common electrode CE by ΔVc2 (ΔVc2<ΔVc1) by providing the charge recycle period, as shown in FIG. 12.

The charge recycle period and the drive period are also provided in the subsequent horizontal scan period, and the above-described operation is performed in each period. Since power consumption accompanying driving the source line in the charge recycle period depends on the voltage (i.e. display data) set by the source line driver circuit 20 in the drive period, the effect of reducing power consumption by recycling charges is reduced. On the other hand, since the common electrode CE is set at the high-potential-side voltage VCOMH or the low-potential-side voltage VCOML, power consumption can be reliably reduced using a simple configuration independent of the display data, whereby the effect of reducing power consumption by recycling charges is remarkably increased.

According to the first operation mode, since charges can be recycled without using the first and second capacitor elements CCS and CCV, as described above, the chip size and the mounting area of the display driver 60 can be reduced. On the other hand, since the voltage corresponding to the display data is applied to the source line, the effect of recycling charges varies depending on the display data.

According to the second operation mode, since the binary common electrode voltage is used, the effect of recycling charges of the common electrode CE is achieved, whereby the effect of reducing power consumption can be reliably obtained. On the other hand, since charges are recycled using the first or second capacitor element CCS or CCV, the chip size and the mounting area of the display driver 60 cannot be reduced.

According to this embodiment, since charges can be recycled in the above operation mode by merely providing the node short circuit switch HSW, it is possible to satisfy various users' demands using one type of display driver, whereby the manufacturing cost can be further reduced.

3.3 Specific Configuration Example

Figure 13:
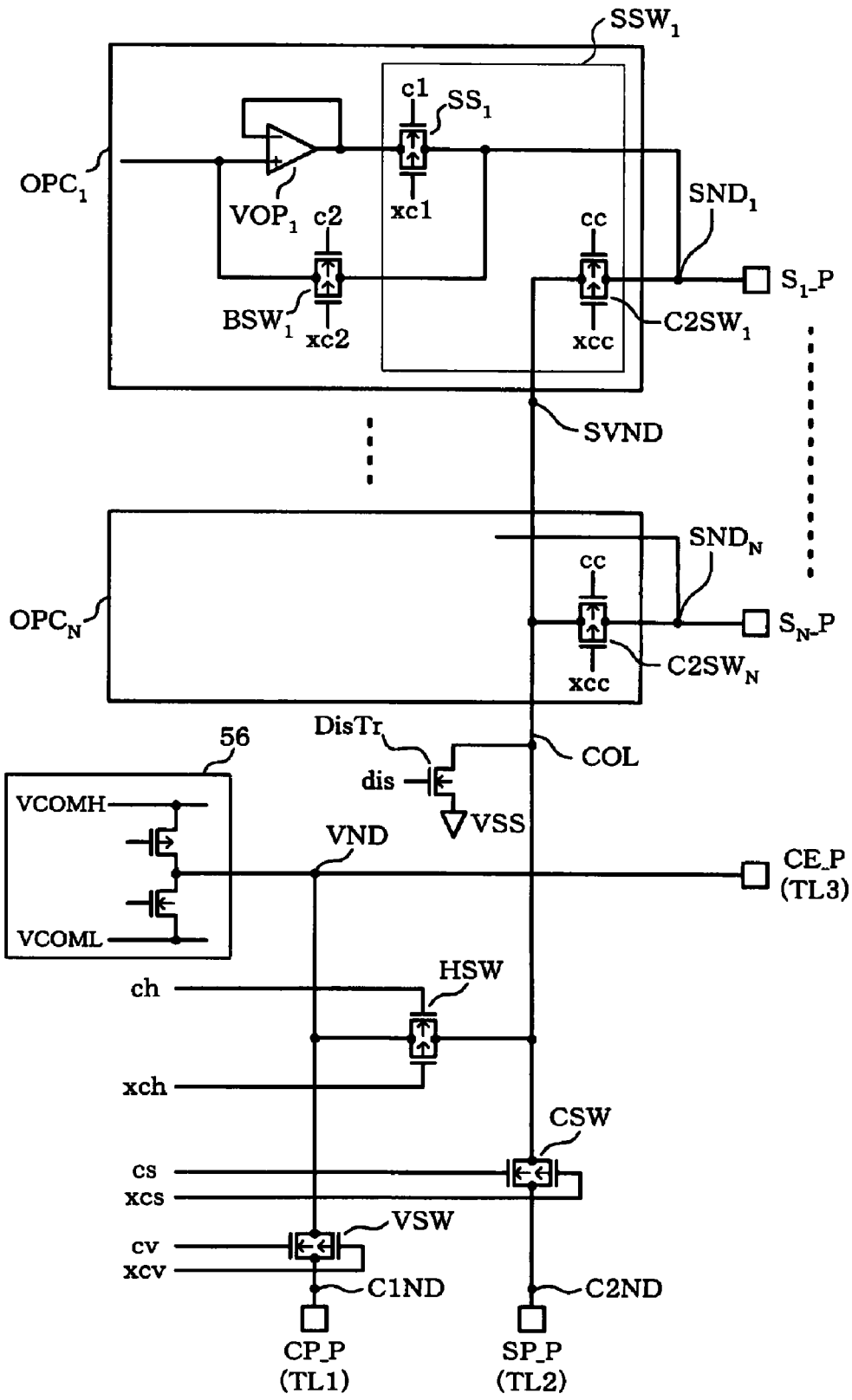
FIG. 13 is a view showing a configuration example of operational amplifier circuit blocks, a common line, and switches shown in FIG. 4.

FIG. 13 shows a configuration example of the operational amplifier circuit blocks $OPC_1$ to $OPC_N$, the common line COL, and the switches shown in FIG. 4.

FIG. 13 shows the connection relationship of the operational amplifier circuit blocks $OPC_1$ to $OPC_N$, the common line COL, the common electrode charge storage switch VSW, the source charge storage switch CSW, and the node short circuit switch HSW. In FIG. 13, the same sections as in FIG. 1, 2, 9, or 11 are indicated by the same symbols. Description of these sections is appropriately omitted.

Each of the operational amplifier circuit blocks $OPC_1$ to $OPC_N$ has the same configuration. The following description focuses on the operational amplifier circuit block $OPC_1$.

The operational amplifier circuit block OPC1 includes a voltage-follower-connected operational amplifier $VOP_1$ and a source output switch circuit $SSW_1$. The source output switch circuit $SSW_1$ includes a first source output switch $SS_1$ and a first source short circuit switch $C2SW_1$. The first source output switch $SS_1$ is ON/OFF-controlled using control signals c1 and xc1 (common control signals; hereinafter the same). The control signal xc1 is an inversion signal of the control signal c1. The first source short circuit switch $C2SW_1$ is ON/OFF controlled using control signals cc and xcc. The control signal xcc is an inversion signal of the control signal cc. The output of the operational amplifier $VOP_1$ is connected with the first source output node $SND_1$ through the first source output switch $SS_1$. The first source output node $SND_1$ is connected with a given source voltage output node SVND through the first source short circuit switch $C2SW_1$. The source voltage output node SVND is connected with a second capacitor element connection node C2ND through the source charge storage switch CSW. The source charge storage switch CSW is ON/OFF controlled using control signals cs and xcs. The control signal xcs is an inversion signal of the control signal cs.

As described above, the first source short circuit switch $C2SW_1$ is provided between the source voltage output node SVND and the first source output node $SND_1$. The source charge storage switch CSW is provided between the source voltage output node SVND and the second capacitor element connection node C2ND which can be connected with one end of the second capacitor element CCS.

A common electrode voltage output node VND which is the output of the common electrode voltage generation circuit 56 is electrically connected with a common electrode voltage output pad CE_P as a common electrode voltage output terminal TL3 which is electrically connected with the common electrode CE of the display panel 12. The common electrode voltage output node VND is connected with a first capacitor element connection node C1ND through the common electrode charge storage switch VSW. The common electrode charge storage switch VSW is ON/OFF controlled using control signals cv and xcv. The control signal xcv is an inversion signal of the control signal cv. The first capacitor element connection node C1ND is electrically connected with a first capacitor element connection pad CP_P as the first capacitor element connection terminal TL1.

The node short circuit switch HSW is provided between the common electrode voltage output node VND and the source voltage output node SVND (common line COL). The node short circuit switch HSW is ON/OFF controlled using control signals ch and xch. The control signal xch is an inversion signal of the control signal ch.

The common line COL including the source voltage output node SVND is similarly connected with the source short circuit switch of each operational amplifier circuit block. Specifically, the display driver 60 may include the common line COL which is electrically connected with the source voltage output node SVND and of which one end is electrically connected with the source charge storage switch CSW, and a second source short circuit switch $C2SW_2$ provided between a second source output node $SND_2$ to which the voltage output to the second source line $S_2$ is supplied and the common line COL. The first source short circuit switch $C2SW_1$ is provided between the first source output node $SND_1$ and the common line COL. The second source short circuit switch $C2SW_2$ is provided between the second source output node $SND_2$ and the common line COL.

The display driver 60 may include a discharge transistor DisTr. A control signal dis is supplied to the gate of the discharge transistor DisTr. A discharge voltage (e.g. system ground power supply voltage VSS) is supplied to the source of the discharge transistor DisTr, and the drain of the discharge transistor DisTr is electrically connected with the common line COL. The voltage of the common line COL is set at the discharge voltage using the control signal dis. The discharge transistor DisTr is used in common to discharge the first and second source lines.

In the select period of the pixel electrode of the display panel 12, the first and second source lines $S_1$ and $S_2$ can be discharged by turning ON the discharge transistor DisTr in a state in which the first and second source short circuit switches $C2SW_1$ and $C2SW_2$ are set in a conducting state. This makes it possible to achieve an OFF-write operation using an extremely simple configuration. The term "OFF-write operation" means applying a given OFF voltage to the source line in order to transition to a display OFF state.

The operational amplifier circuit block $OPC_1$ may also include a first bypass switch $BSW_1$. The first bypass switch $BSW_1$ is ON/OFF controlled using control signals c2 and xc2. The control signal xc2 is an inversion signal of the control signal c2. In the operational amplifier circuit block $OPC_1$, charges are recycled as described above in the first period of one horizontal scan period as the select period of the pixel, and the source line $S_1$ is drive-controlled using the first source output switch $SS_1$ and the first bypass switch $BSW_1$ in the drive period in the second period of the horizontal scan period.

Specifically, the first source output node $SND_1$ is driven by the operational amplifier $VOP_1$ in the first period of the drive period in a state in which the first source output switch $SS_1$ is set in a conducting state and the first bypass switch $BSW_1$ is set in a nonconducting state. In the second period of the drive period, the input voltage of the operational amplifier $VOP_1$ is supplied to the first source output node $SND_1$ in a state in which the first source output switch $SS_1$ is set in a nonconducting state and the first bypass switch $BSW_1$ is set in a conducting state. This allows the voltage applied to the first source output node $SND_1$ to be set at a high speed with high accuracy.

Figure 14:
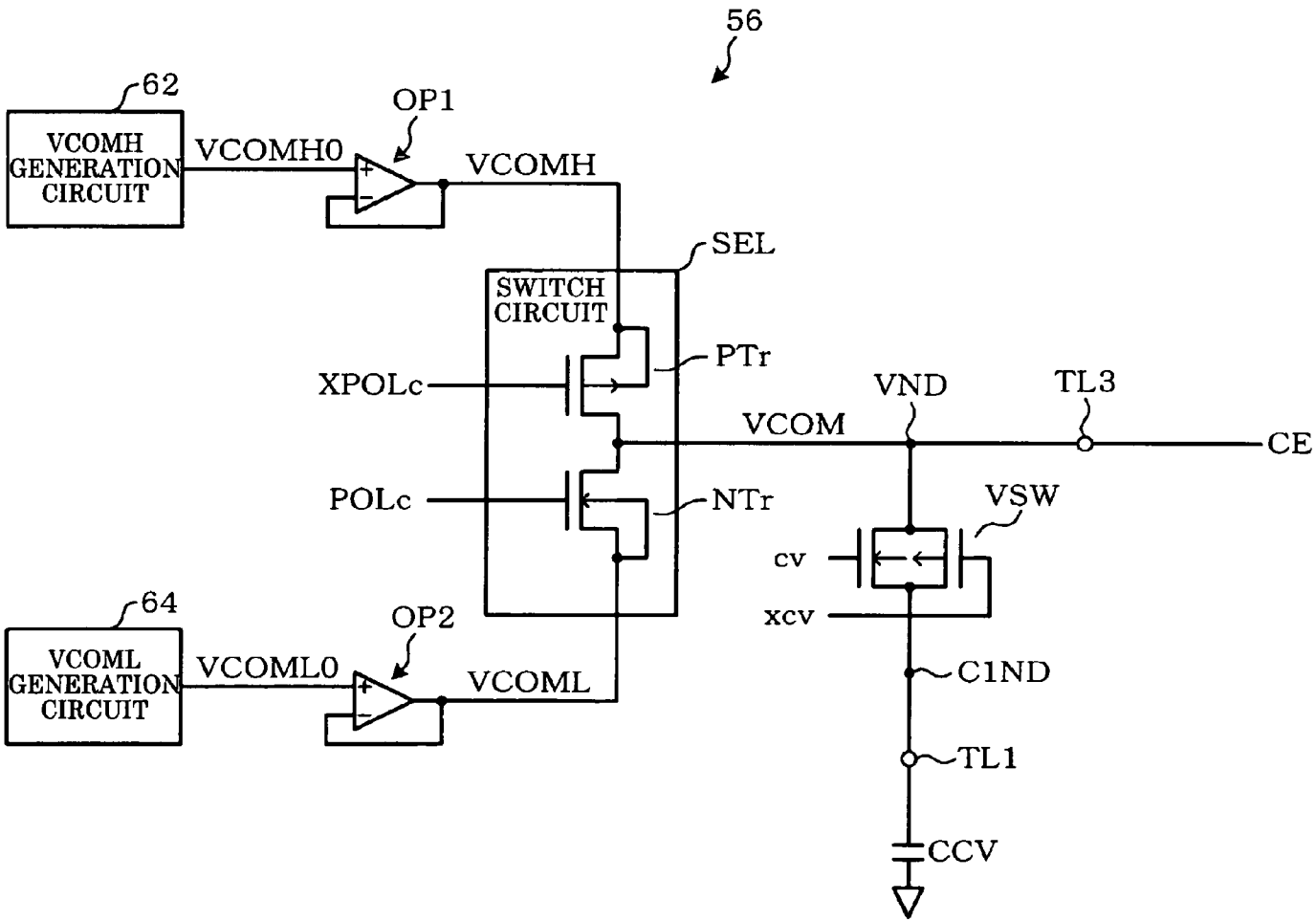
FIG. 14 is a view showing a configuration example of a common electrode voltage generation circuit shown in FIG. 6.

FIG. 14 shows a configuration example of the common electrode voltage generation circuit 56 shown in FIG. 6 and the common electrode charge storage switch VSW.

The common electrode voltage generation circuit 56 generates the common electrode voltage VCOM applied to the common electrode CE opposite to the pixel electrode of the display panel 12 (electro-optical device) through the liquid crystal element (electro-optical material). The common electrode voltage generation circuit 56 includes first and second operational amplifiers OP1 and OP2 which are voltage-follower-connected operational amplifiers, and a switch circuit SEL. The first operational amplifier OP1 outputs the high-potential-side voltage VCOMH of the common electrode voltage VCOM. The second operational amplifier OP2 outputs the low-potential-side voltage VCOML of the common electrode voltage VCOM. The switch circuit SEL outputs one of the high-potential-side voltage VCOMH and the low-potential-side voltage VCOML as the common electrode voltage VCOM at the polarity inversion timing at which the polarity of the voltage applied to the liquid crystal element (electro-optical material) is reversed. The first and second operational amplifiers OP1 and OP2 may operate as regulators.

The switch circuit SEL may include a P-type (first conductivity type) metal-oxide-semiconductor (MOS) transistor (hereinafter simply called "transistor") Otr and an N-type (second conductivity type) transistor NTr. The source of the transistor PTr is connected with the output of the first operational amplifier OP1. The drain of the transistor PTr is electrically connected with the common electrode CE. A control signal XPOLc is supplied to the gate of the transistor PTr. The source of the transistor NTr is connected with the output of the second operational amplifier OP2. The drain of the transistor NTr is electrically connected with the common electrode CE. A control signal POLc is supplied to the gate of the transistor NTr.

The control signals XPOLc and POLc are generated based on the polarity inversion signal POL specifying the polarity inversion timing. The switch circuit SEL outputs the high-potential-side voltage VCOMH or the low-potential-side voltage VCOML based on the control signals XPOLc and POLc. The switch circuit SEL sets the output in a high impedance state based on the control signals XPOLc and POLc.

The common electrode voltage generation circuit 56 may include a VCOMH generation circuit (common electrode high-potential-side voltage generation circuit) 62 and a VCOML generation circuit (common electrode low-potential-side voltage generation circuit) 64. The VCOMH generation circuit 62 can generate a voltage VCOMHO by a charge-pump operation based on the system ground power supply voltage VSS and the power supply voltage VDDHS, for example. The voltage VCOMHO is supplied to the input of the first operational amplifier OP1. The VCOML generation circuit 64 can generate a voltage VCOML0 by a charge-pump operation based on the system ground power supply voltage VSS and the power supply voltage VDDHS, for example. The voltage VCOML0 is supplied to the input of the second operational amplifier OP2.

When the common electrode voltage generation circuit 56 outputs the high-potential-side voltage VCOMH as the common electrode voltage VCOM using the switch circuit SEL, the common electrode voltage generation circuit 56 suspends or limits the operating current of the second operational amplifier OP2 using a control signal (not shown). When the common electrode voltage generation circuit 56 outputs the low-potential-side voltage VCOML as the common electrode voltage VCOM using the switch circuit SEL, the common electrode voltage generation circuit 56 suspends or limits the operating current of the first operational amplifier OP1 using a control signal (not shown).

According to this configuration, when applying one of the high-potential-side voltage VCOMH and the low-potential-side voltage VCOML of the common electrode voltage VCOM to the common electrode CE, since the operating current of the operational amplifier which outputs the other of the high-potential-side voltage VCOMH and the low-potential-side voltage VCOML can be suspended or limited, current consumption unnecessary for generating the common electrode voltage VCOM can be reduced.

The output of the switch circuit SEL is electrically connected with the common electrode voltage output node VND. The common electrode voltage output node VND is electrically connected with the first capacitor element connection node C1ND which can be connected with one end of the first capacitor element. The first capacitor element connection node C1ND is electrically connected with the common electrode CE of the display panel 12 through the common electrode voltage output terminal TL3.

3.3.1 Control Timing Example of First Operation Mode

Figure 15:
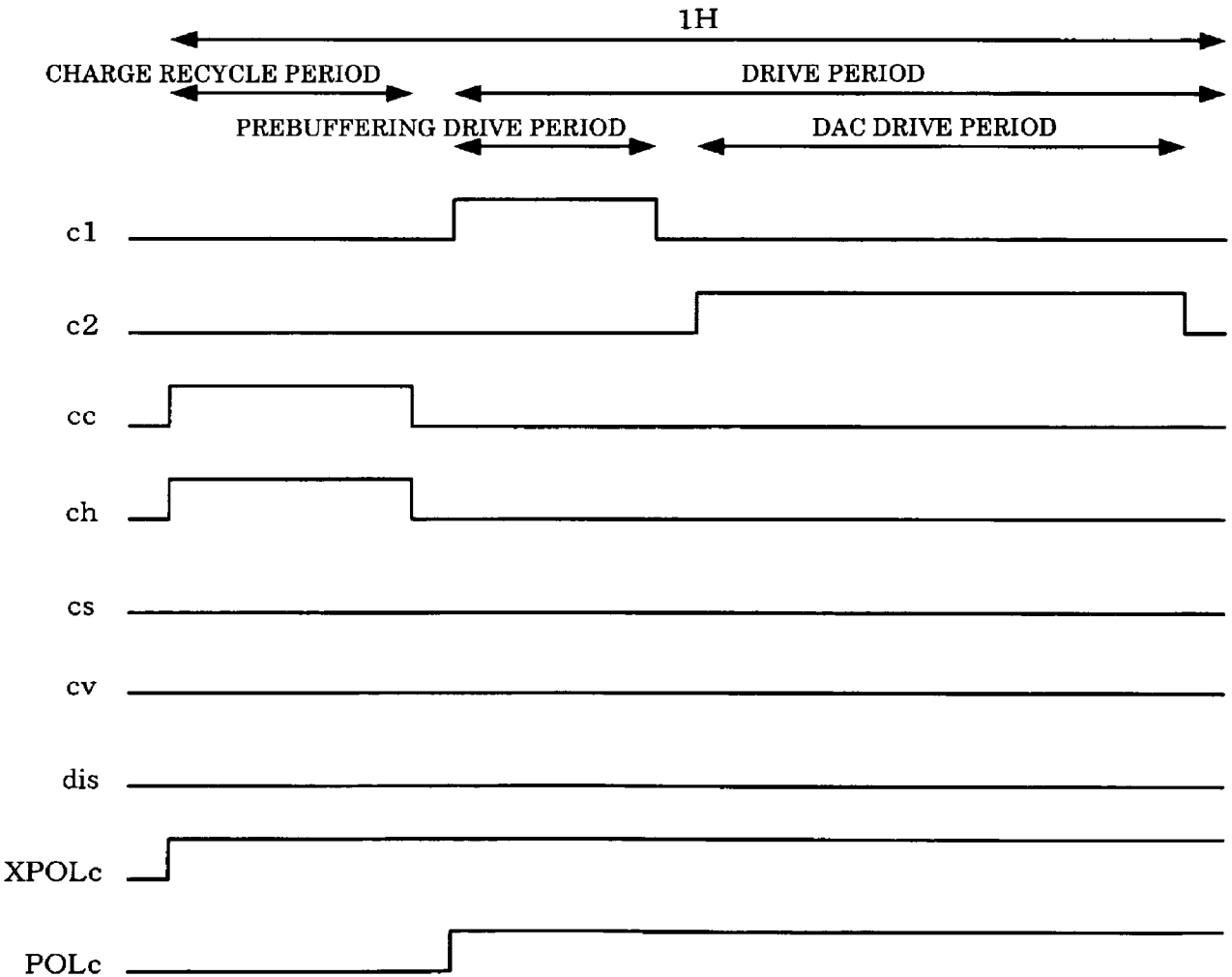
FIG. 15 is a timing diagram showing a control example of the operational amplifier circuit block and the switches in the first operation mode.

FIG. 15 is a timing diagram of a control example of the operational amplifier circuit block $OPC_1$ and the switches shown in FIG. 13 in the first operation mode.

In FIG. 15, each switch is turned ON (conducting state) when the control signals c1, c2, cc, cs, ch, and dis shown in FIG. 13 are set at the H level. In the example shown in FIG. 15, the control signal dis is always set at the L level. FIG. 15 illustrates only a control example of the operational amplifier circuit block $OPC_1$. Note that the operational amplifier circuit blocks $OPC_2$ to $OPC_N$ are controlled using the same control signals as the operational amplifier circuit block $OPC_1$.

In the charge recycle period in the first period of one horizontal scan period, the control signals cc and ch are set at the H level, and the control signals c1, c2, and cs are set at the L level. Therefore, the common electrode charge storage switch VSW and the source charge storage switch CSW are set in a nonconducting state, and the node short circuit switch HSW is set in a conducting state. Specifically, the node short circuit switch is set in a conducting state while the common electrode charge storage switch VSW and the source charge storage switch CSW are set in a nonconducting state. This allows the common line COL to be electrically connected with the common electrode voltage output node VND. Therefore, charges stored in the parasitic capacitor of the common line COL or the common electrode voltage output node VND are recycled, whereby the potentials of the common line COL and the common electrode voltage output node VND are changed. Since the source short circuit switch of each operational amplifier circuit block is also set in a conducting state, the first to Nth source lines $S_1$ to $S_N$ and the common electrode CE are set at the same potential.

Then, the common electrode CE is driven by supplying the common electrode voltage VCOM to the common electrode voltage output node VND, and the source line is driven by supplying a voltage corresponding to the display data to the source line as described below.

In a prebuffering drive period in the drive period after the charge recycle period, the control signals cc and ch are set at the L level, and the control signal c1 is set at the H level. The common electrode charge storage switch VSW and the source charge storage switch CSW are turned OFF (nonconducting state) in the drive period. This allows the first source output node $SND_1$ of which the potential has changed in the charge recycle period to be driven by the operational amplifier $VOP_1$. The data voltage selected by the DAC 28 is supplied to the operational amplifier $VOP_1$. Although the operational amplifier $VOP_1$ consumes an operating current, the operational amplifier $VOP_1$ can change the potential of the first source output node $SND_1$ at a high speed with a high drive capability.

In a DAC drive period in the drive period, the control signal c1 is set at the L level, and the control signal c2 is set at the H level. Therefore, the first source output node $SND_1$ is electrically disconnected from the output of the operational amplifier $VOP_1$, and the data voltage from the DAC 28 is directly supplied to the first source output node $SND_1$. This allows the first source output node $SND_1$ to be set at the accurate data voltage from the DAC 28. Since the operation of the operational amplifier $VOP_1$ can be suspended in the DAC drive period, power consumption can be reduced.

As described above, after setting the node short circuit switch in a conducting state while setting the common electrode charge storage switch VSW and the source charge storage switch CSW in a nonconducting state, the common electrode CE is driven by supplying the common electrode voltage VCOM to the common electrode voltage output node VND, and the source line is driven by supplying a voltage corresponding to the display data to the source line.

In more detail, after setting the outputs of the source line driver circuit 20 and the common electrode voltage generation circuit 56 in a high impedance state and electrically connecting the source voltage output node SVND and the common electrode voltage output node VND, the source voltage output node SVND is electrically disconnected from the common electrode voltage output node VND. The source line driver circuit 20 then supplies a voltage corresponding to the display data to the first or second source line $S_1$ or $S_2$, and the common electrode voltage generation circuit 56 supplies the common electrode voltage VCOM to the common electrode CE.

Figure 16:
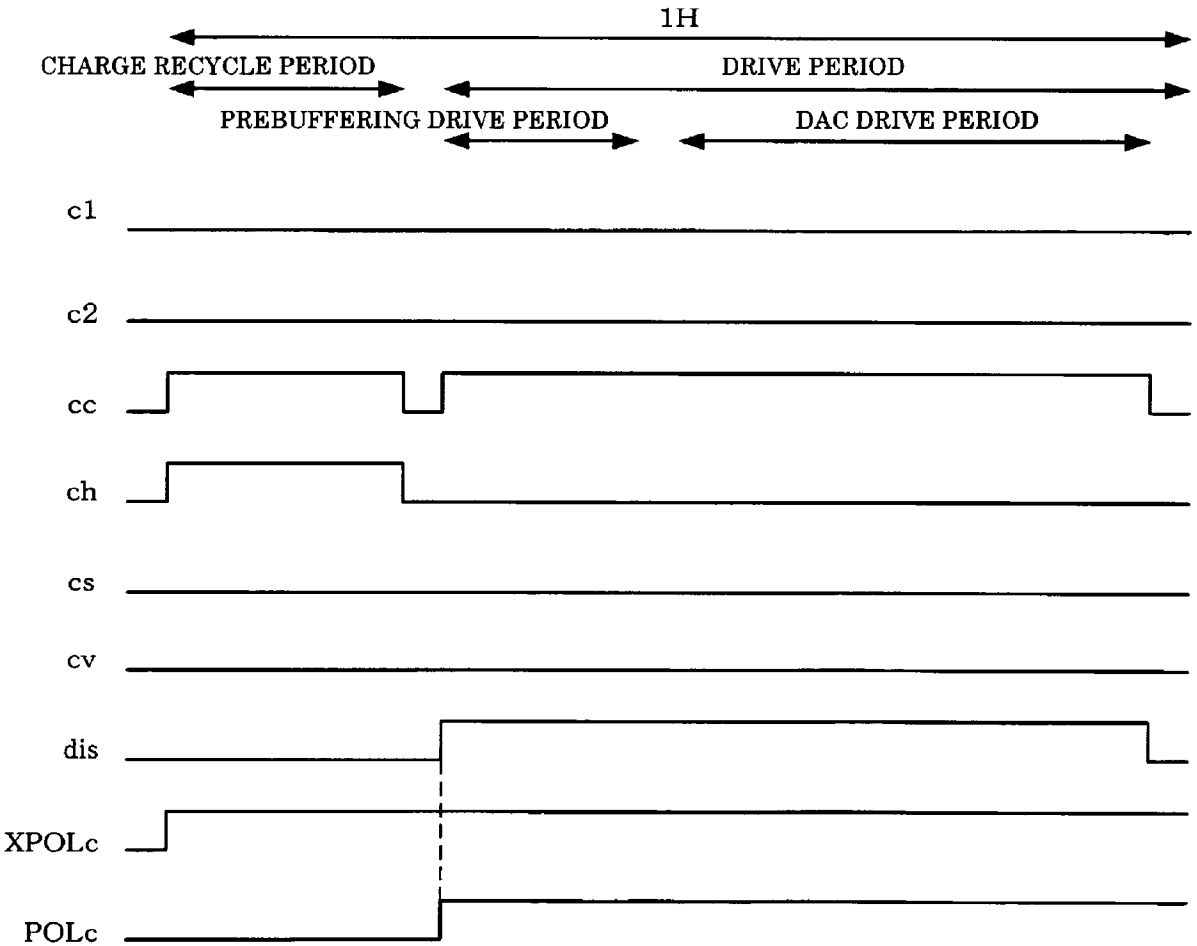
FIG. 16 is a timing diagram showing another control example of the operational amplifier circuit block and the switches in the first operation mode.

FIG. 16 is a timing diagram of another control example of the operational amplifier circuit block $OPC_1$ and the switches shown in FIG. 13 in the first operation mode.

FIG. 16 is a timing diagram of a control example of the OFF-write operation. Control in the charge recycle period and switch control of the source charge storage switch CSW are the same as in FIG. 15.

In the prebuffering period and the DAC drive period in the drive period, the control signal cc is set at the H level, and the control signal dis is set at the H level. This allows the common line COL to be set at the system ground power supply voltage VSS through the discharge transistor DisTr. This first source output node $SND_1$ of which the potential has changed in the charge recycle period is set at the system ground power supply voltage VSS through the first source short circuit switch $C2SW_1$ set in a conducting state. The voltage of the first source output node $SND_1$ is supplied to the first source line $S_1$, whereby an OFF-write control operation is performed. Therefore, it suffices to write the voltage of the first source output node SND1 supplied to the source line into the pixel electrode of the display panel 12 in the same manner as in the normal display operation.

The above-described OFF-write control operation is similarly performed in the operational amplifier circuit blocks $OPC_2$ to $OPC_N$. This makes it possible to perform the display OFF control operation using an extremely simple configuration without causing the DAC to supply a specific OFF voltage.

3.3.2 Control Timing Example of Second Operation Mode

Figure 17:
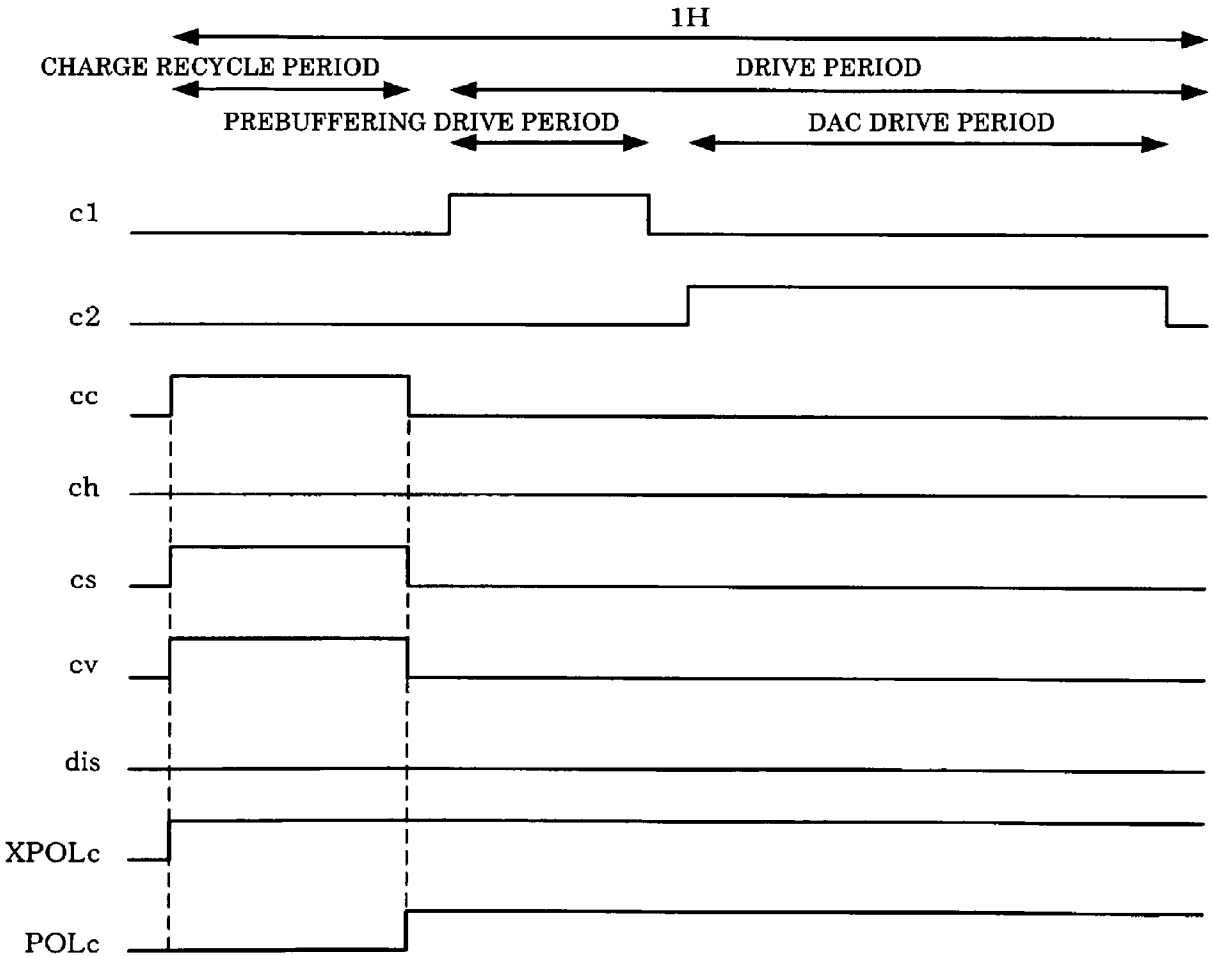
FIG. 17 is a timing diagram showing a control example of the operational amplifier circuit block and the switches in the second operation mode.

FIG. 17 is a timing diagram of a control example of the operational amplifier circuit block $OPC_1$ and the switches shown in FIG. 13 in the second operation mode.

In FIG. 17, each switch is turned ON (conducting state) when the control signals c1, c2, cc, cs, ch, and dis shown in FIG. 13 are set at the H level. In the example shown in FIG. 17, the control signal dis is always set at the L level. FIG. 17 illustrates only a control example of the operational amplifier circuit block $OPC_1$. Note that the operational amplifier circuit blocks $OPC_2$ to $OPC_N$ are controlled using the same control signals as the operational amplifier circuit block $OPC_1$.

In the charge recycle period in the first period of one horizontal scan period, the control signals cc, cs, and cv are set at the H level, and the control signals c1, c2, and ch are set at the L level. This causes the source charge storage switch CSW to be set in a conducting state. The first source output node $SND_1$ and one end of the second capacitor element CCS connected with the second capacitor element connection terminal TL2 are set at the same potential. This allows charges stored in the second capacitor element CCS to be recycled, whereby the potential of the first source output node $SND_1$ is changed. The common electrode voltage output node VND and one end of the first capacitor element CCV connected with the first capacitor element connection terminal TL1 are set at the same potential. This allows charges stored in the first capacitor element CCV to be recycled, whereby the potential of the common electrode voltage output node VND is changed.

The control signal cv is changed at the same timing as the control signal cc shown in FIG. 17. Therefore, the period in which the source voltage output node SVND is electrically connected with the second capacitor element connection node C2ND coincides with (overlap) the period in which the common electrode voltage output node VND is electrically connected with the first capacitor element connection node C1ND.

In the prebuffering drive period in the drive period, the control signals cc, cs, and cv are set at the L level, and the control signal c1 is set at the H level. The source charge storage switch CSW is turned OFF (nonconducting state) in the drive period. This allows the first source output node $SND_1$ of which the potential has changed in the charge recycle period to be driven by the operational amplifier $VOP_1$. The data voltage selected by the DAC 28 is supplied to the operational amplifier $VOP_1$. Although the operational amplifier $VOP_1$ consumes an operating current, the operational amplifier $VOP_1$ can change the potential of the first source output node $SND_1$ at a high speed with a high drive capability.

In the DAC drive period in the drive period, the control signal c1 is set at the L level, and the control signal c2 is set at the H level. Therefore, the first source output node $SND_1$ is electrically disconnected from the output of the operational amplifier $VOP_1$, and the data voltage from the DAC 28 is directly supplied to the first source output node $SND_1$. This allows the first source output node $SND_1$ to be set at the accurate data voltage from the DAC 28. Since the operation of the operational amplifier $VOP_1$ can be suspended in the DAC drive period, power consumption can be reduced.

As described above, the node short circuit switch HSW is set in a nonconducting state in the second operation mode. The common electrode voltage output node VND and the first capacitor element connection node C1ND are electrically connected through the common electrode charge storage switch VSW, and the common electrode CE is driven by supplying the common electrode voltage VCOM to the common electrode voltage output node VND. The source voltage output node SVND and the second capacitor element connection node C2ND are electrically connected through the source charge storage switch CSW, and the source line is driven by supplying a voltage corresponding to the display data to the source line in a state in which the source voltage output node SVND and the second capacitor element connection node C2ND are electrically disconnected using the source charge storage switch CSW.

In more detail, the first or second source output node $SND_1$ or $SND_2$ and the second capacitor element connection node C2ND are electrically connected in a state in which the output of the source line driver circuit 20 is set in a high impedance state, and the source line driver circuit 20 supplies a voltage corresponding to the display data to the first or second source line $S_1$ or $S_2$ in a state in which the first or second source output node $SND_1$ or $SND_2$ and the second capacitor element connection node C2ND are electrically disconnected. The common electrode voltage output node VND and the first capacitor element connection node C1ND are electrically connected through the common electrode charge storage switch VSW in a state in which the output of the common electrode voltage generation circuit 56 is set in a high impedance state, and the common electrode voltage generation circuit 56 supplies the common electrode voltage VCOM to the common electrode CE.

Figure 18:
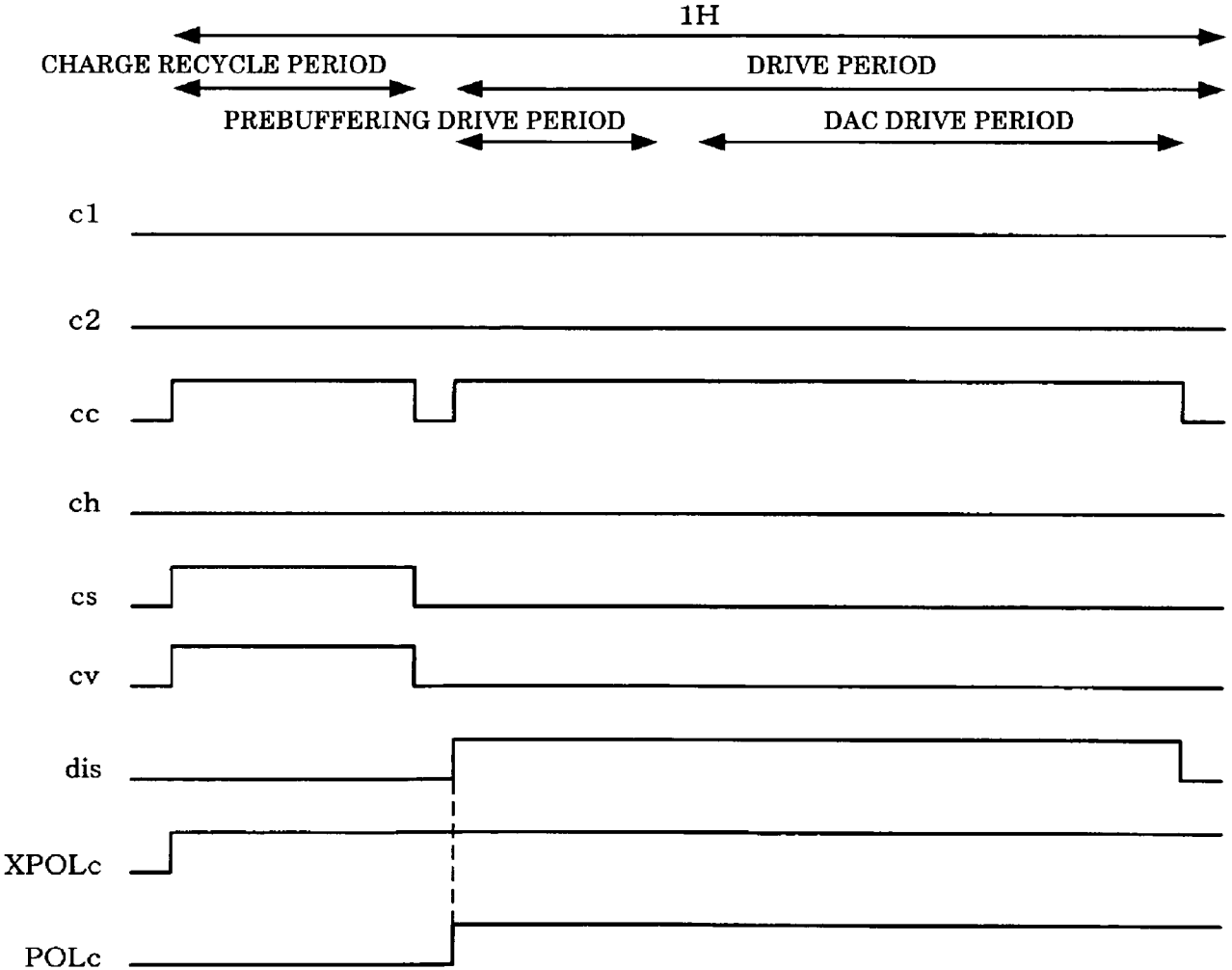
FIG. 18 is a timing diagram showing another control example of the operational amplifier circuit block and the switches in the second operation mode.

FIG. 18 is a timing diagram of another control example of the operational amplifier circuit block $OPC_1$ and the switches shown in FIG. 13 in the second operation mode.

FIG. 18 is a timing diagram of a control example of the OFF-write operation. Control in the charge recycle period and switch control of the source charge storage switch CSW are the same as in FIG. 17.

In the prebuffering period and the DAC drive period in the drive period, the control signal cc is set at the H level, and the control signal dis is set at the H level. This allows the common line COL to be set at the system ground power supply voltage VSS through the discharge transistor DisTr. This first source output node $SND_1$ of which the potential has changed in the charge recycle period is set at the system ground power supply voltage VSS through the first source short circuit switch $C2SW_1$ set in a conducting state. The voltage of the first source output node SND1 is supplied to the first source line $S_1$, whereby the OFF-write control operation is achieved. Therefore, it suffices to write the voltage of the first source output node $SND_1$ supplied to the source line into the pixel electrode of the display panel 12 in the same manner as in the normal display operation.

The above-described OFF-write control operation is similarly performed in the operational amplifier circuit blocks $OPC_2$ to $OPC_N$. This makes it possible to perform the display OFF control operation using an extremely simple configuration without causing the DAC to supply a specific OFF voltage.

3.3.3 Generation of Control Signals

The above control signals are generated by a control circuit (not shown) of the display driver 60.

Figure 19:
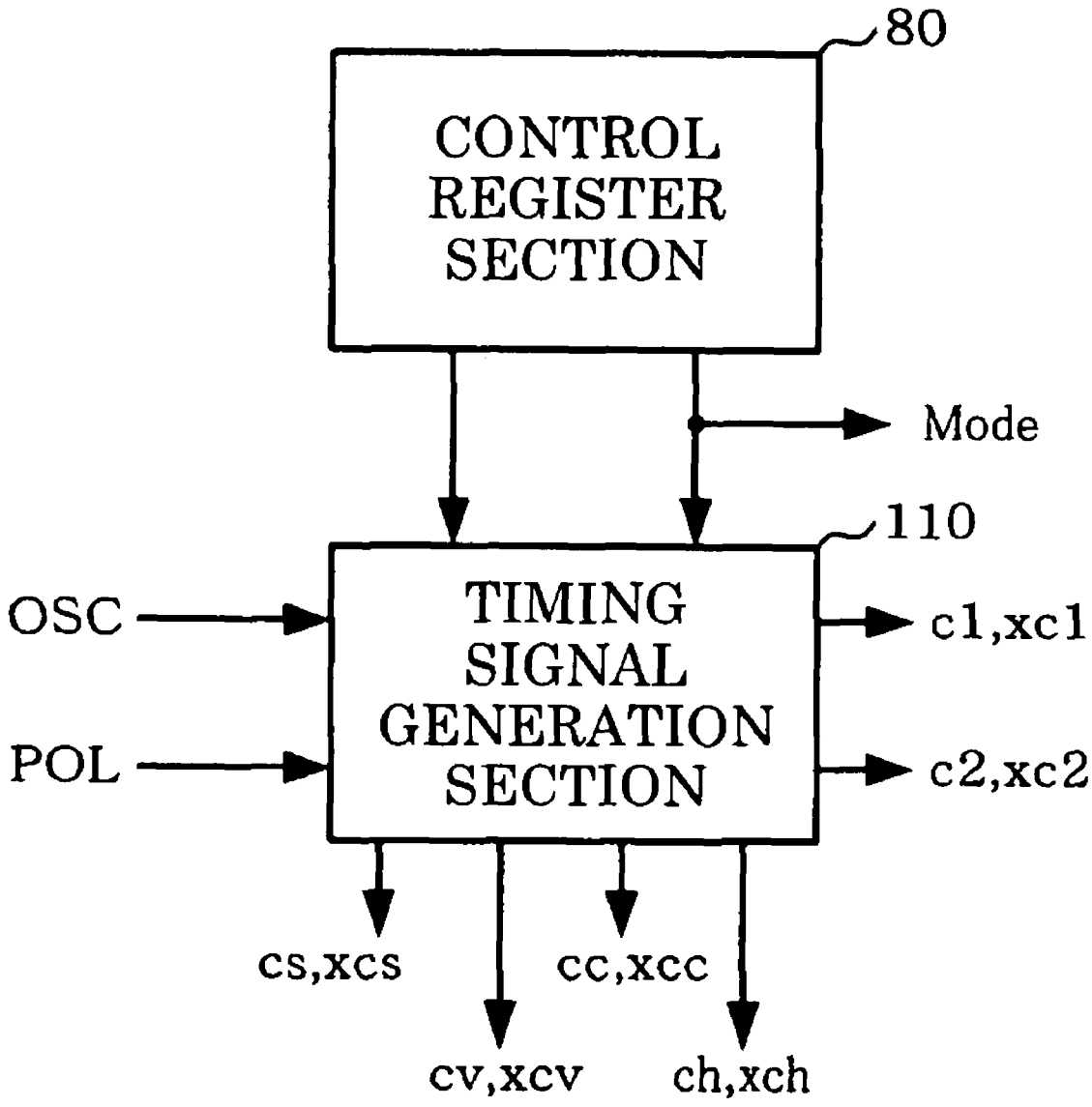
FIG. 19 is a view showing the main configuration of a control circuit of the display driver.

FIG. 19 shows the main configuration of the control circuit of the display driver 60.

In FIG. 19, the control circuit includes a control register section 80 and a timing generation section 110. The control register section 80 includes a plurality of control registers. The host or the display controller 40 sets a value in each control register.

The timing generation section 110 outputs various control signals based on the number of pulses of a reference clock signal OSC corresponding to the value set in each register of the control register section 80 according to the polarity of the voltage applied to the liquid crystal element specified by the polarity inversion signal POL. The reference clock signal OSC is generated by an oscillation circuit (not shown) provided in the display driver 60.

Figure 20:
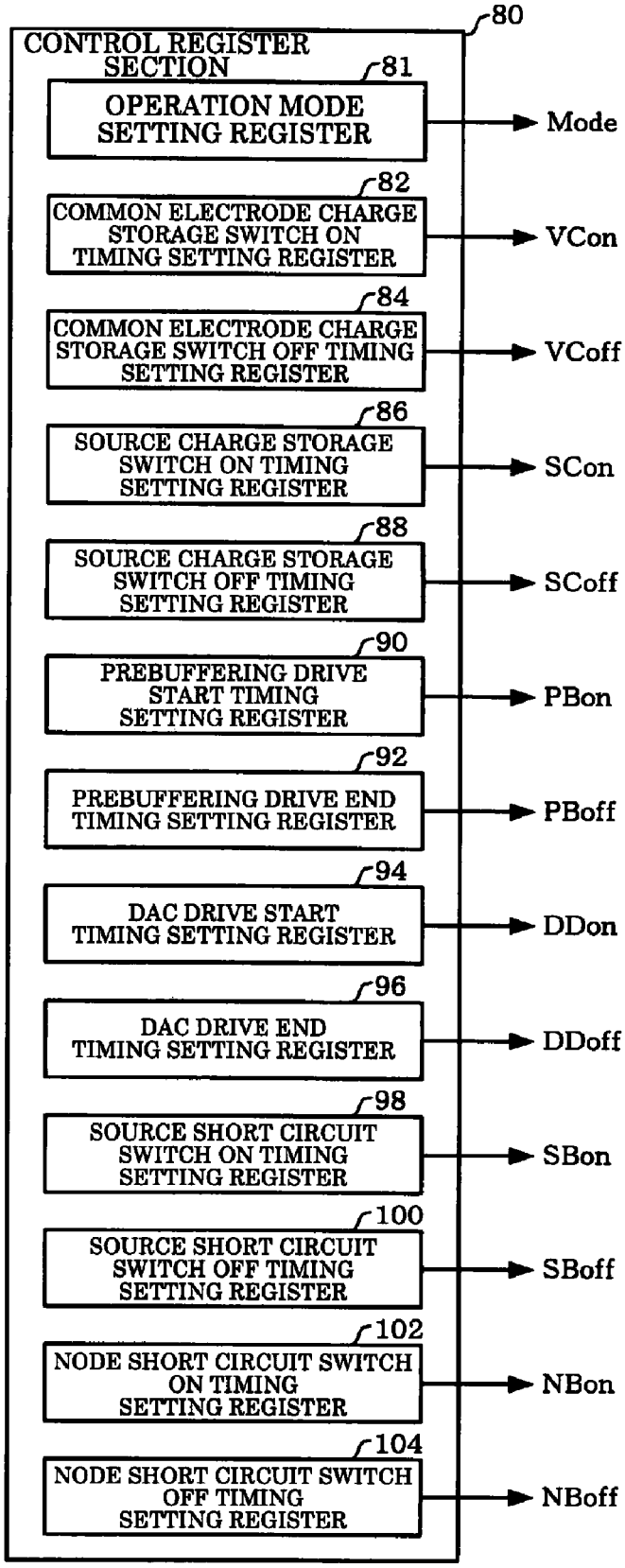
FIG. 20 is a view schematically showing the configuration of a control register section shown in FIG. 19.

FIG. 20 schematically shows the configuration of the control register section 80 shown in FIG. 19.

The control register section 80 includes an operation mode setting register 81, a common electrode charge storage switch ON timing setting register 82, a common electrode charge storage switch OFF timing setting register 84, a source charge storage switch ON timing setting register 86, a source charge storage switch OFF timing setting register 88, a prebuffering drive start timing setting register 90, a prebuffering drive end timing setting register 92, a DAC drive start timing setting register 94, a DAC drive end timing setting register 96, a source short circuit switch ON timing setting register 98, a source short circuit switch OFF timing setting register 100, a node short circuit switch ON timing setting register 102, and a node short circuit switch OFF timing setting register 104.

The control data corresponding to the first or second operation mode is set in the operation mode setting register 81. Each section of the display driver 60 performs the charge recycle control corresponding to the first or second operation mode based on a control signal Mode corresponding to the control data set in the operation mode setting register 81.

The number of pulses Vcon of the reference clock signal OSC corresponding to the ON timing of the common electrode charge storage switch VSW with respect to the start timing of the horizontal scan period (scan period in a broad sense) is set in the common electrode charge storage switch ON timing setting register 82. The number of pulses Vcoff of the reference clock signal OSC corresponding to the OFF timing of the common electrode charge storage switch VSW with respect to the start timing of the horizontal scan period is set in the common electrode charge storage switch OFF timing setting register 84. The timing generation section 110 generates the control signals cv and xcv based on the control signal Mode and the number of pulses Vcon and Vcoff.

The number of pulses Scon of the reference clock signal OSC corresponding to the ON timing of the source charge storage switch CSW with respect to the start timing of the horizontal scan period is set in the source charge storage switch ON timing setting register 86. The number of pulses Scoff of the reference clock signal OSC corresponding to the OFF timing of the source charge storage switch CSW with respect to the start timing of the horizontal scan period is set in the source charge storage switch OFF timing setting register 88. The timing generation section 110 generates the control signals cs and xcs based on the control signal Mode and the number of pulses Scon and Scoff.

The number of pulses PBon of the reference clock signal OSC corresponding to the ON timing of the first to Nth source output switches $SS_1$ to $SS_N$ with respect to the start timing of the horizontal scan period is set in the prebuffering drive start timing setting register 90. The number of pulses PBoff of the reference clock signal OSC corresponding to the OFF timing of the first to Nth source output switches $SS_1$ to $SS_N$ with respect to the start timing of the horizontal scan period is set in the prebuffering drive end timing setting register 92. The timing generation section 110 generates the control signals c1 and xc1 based on the control signal Mode and the number of pulses PBon and PBoff.

The number of pulses DDon of the reference clock signal OSC corresponding to the ON timing of the first to Nth bypass switches $BSW_1$ to $BSW_N$ with respect to the start timing of the horizontal scan period is set in the DAC drive start timing setting register 94. The number of pulses DDoff of the reference clock signal OSC corresponding to the OFF timing of the first to Nth bypass switches $BSW_1$ to $BSW_N$ with respect to the start timing of the horizontal scan period is set in the DAC drive end timing setting register 96. The timing generation section 110 generates the control signals c2 and xc2 based on the control signal Mode and the number of pulses DDon and DDoff.

The number of pulses SBon of the reference clock signal OSC corresponding to the ON timing of the first to Nth source short circuit switches $C2SW_1$ to $C2SW_N$ with respect to the start timing of the horizontal scan period is set in the source short circuit switch ON timing setting register 98. The number of pulses SBoff of the reference clock signal OSC corresponding to the OFF timing of the first to Nth source short circuit switches $C2SW_1$ to $C2SW_N$ with respect to the start timing of the horizontal scan period is set in the source short circuit switch OFF timing setting register 98. The timing generation section 110 generates the control signals cc and xcc based on the control signal Mode and the number of pulses SBon and SBoff.

The number of pulses NBon of the reference clock signal OSC corresponding to the ON timing of the node short circuit switch HSW with respect to the start timing of the horizontal scan period is set in the node short circuit switch ON timing setting register 102. The number of pulses NBoff of the reference clock signal OSC corresponding to the OFF timing of the node short circuit switch HSW with respect to the start timing of the horizontal scan period is set in the node short circuit switch OFF timing setting register 102. The timing generation section 110 generates the control signals ch and xch based on the control signal Mode and the number of pulses NBon and NBoff.

Figure 21:
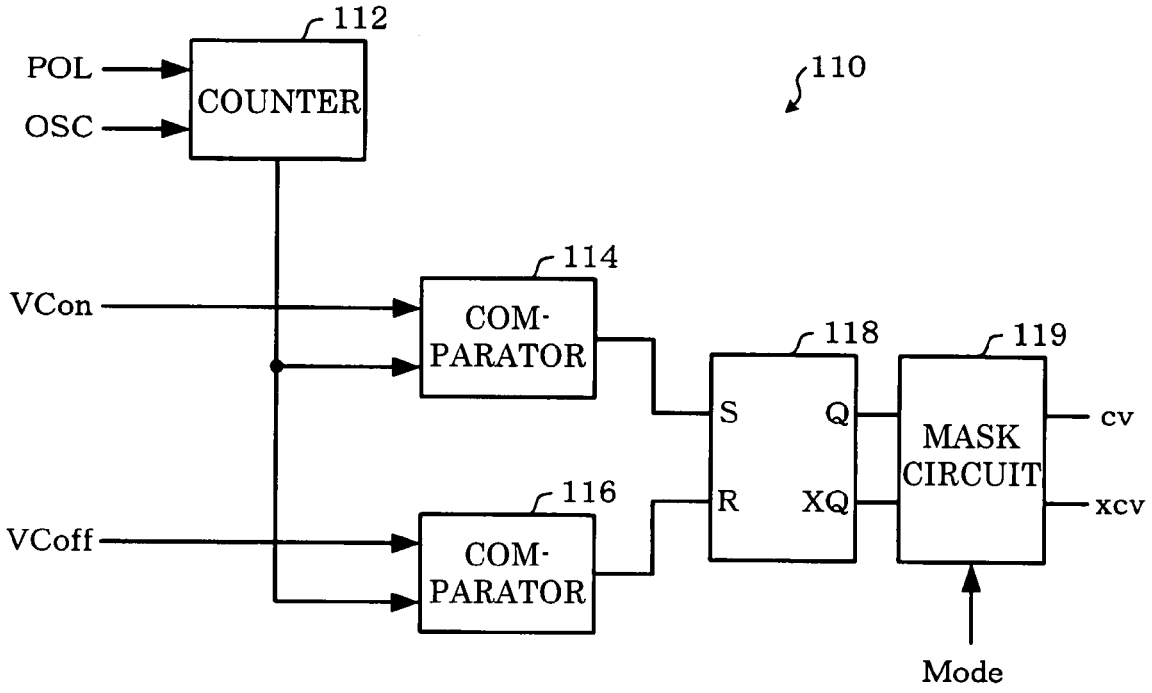
FIG. 21 is a view showing an example of a circuit which generates control signals in a timing generation section.

FIG. 21 shows an example of a circuit which generates the control signals cv and xcv in the timing generation section 110.

The timing generation section 110 includes a counter 112, comparators 114 and 116, and a set-reset flip-flop 118.

The counter 112 counts up in synchronization with the reference clock signal OSC based on the change point of the polarity inversion signal POL. The comparator 114 compares the count value of the counter 112 with the number of pulses Vcon set in the common electrode charge storage switch ON timing setting register 82, and outputs a pulse when these values coincide. The comparator 116 compares the count value of the counter 112 with the number of pulses Vcoff set in the common electrode charge storage switch OFF timing setting register 84, and outputs a pulse when these values coincide. The set-reset flip-flop 118 is set by the pulse from the comparator 114, and reset by the pulse from the comparator 116.

A data output signal and an inversion data output signal of the set-reset flip-flop 118 are input to a mask circuit 119, for example. The mask circuit 190 masks the data output signal and the inversion data output signal of the set-reset flip-flop 118 based on the control signal Mode, and outputs the control signals cv and xcv. Specifically, the control signal cv is generated as shown in FIG. 15 or 16 when the first operation mode is designated using the control signal Mode, and the control signal is generated as shown in FIG. 17 or 18 when the second operation mode is designated using control signal Mode. The control signal cv may be generated corresponding to the control signal Mode in various ways. The method of generating the control signal cv is not limited to that shown in FIG. 21.

Although FIG. 21 illustrates the control signals cv and xcv, the control signals c1, xc1 , c2, xc2, cc, xcc, cs, xcs, ch, and xch may be generated in the same manner as the control signals cv and xcv.

Figure 22:
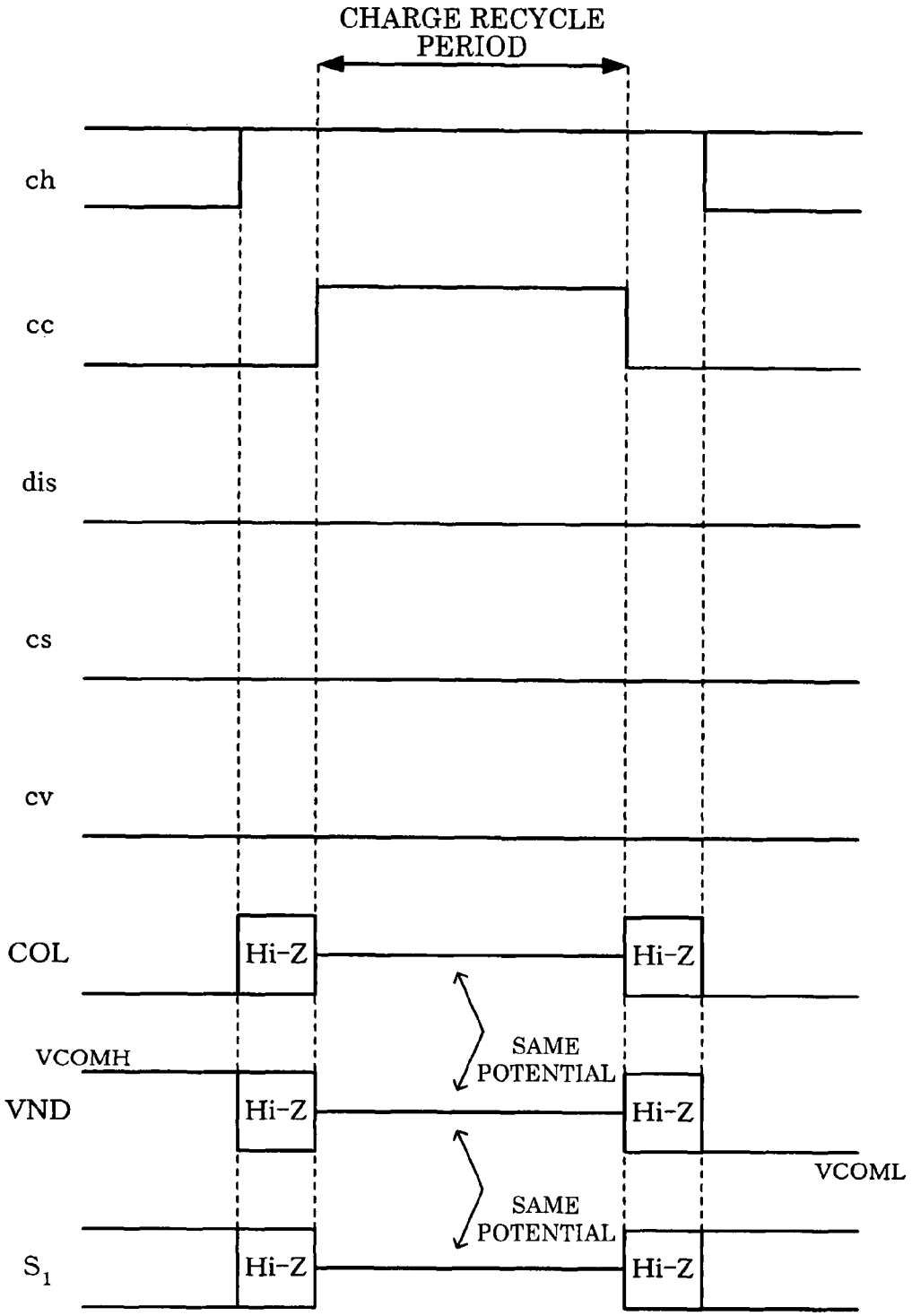
FIG. 22 is an example of a timing diagram of a control example of control signals, a common line, a common electrode, and a first source line in the first operation mode.

FIG. 22 shows an example of a timing diagram of the control signals ch, cc, cs, and cv, the common line COL, the common electrode CE, and the first source line $S_1$ in the first operation mode.

The charge recycle period can be provided by controlling the change timings of the control signals ch and cc using the control registers as described above. In this case, the control signal dis is set at the L level.

This allows charges to flow between the first to Nth source lines $S_1$ to $S_N$ and the common electrode CE through the common line COL, whereby the potentials of the first to Nth source lines $S_1$ to $S_N$ and the common electrode CE can be changed without supplying charges from the power supply circuit.

The control signal cc is then set at the L level and the drive period commences.

Figure 23:
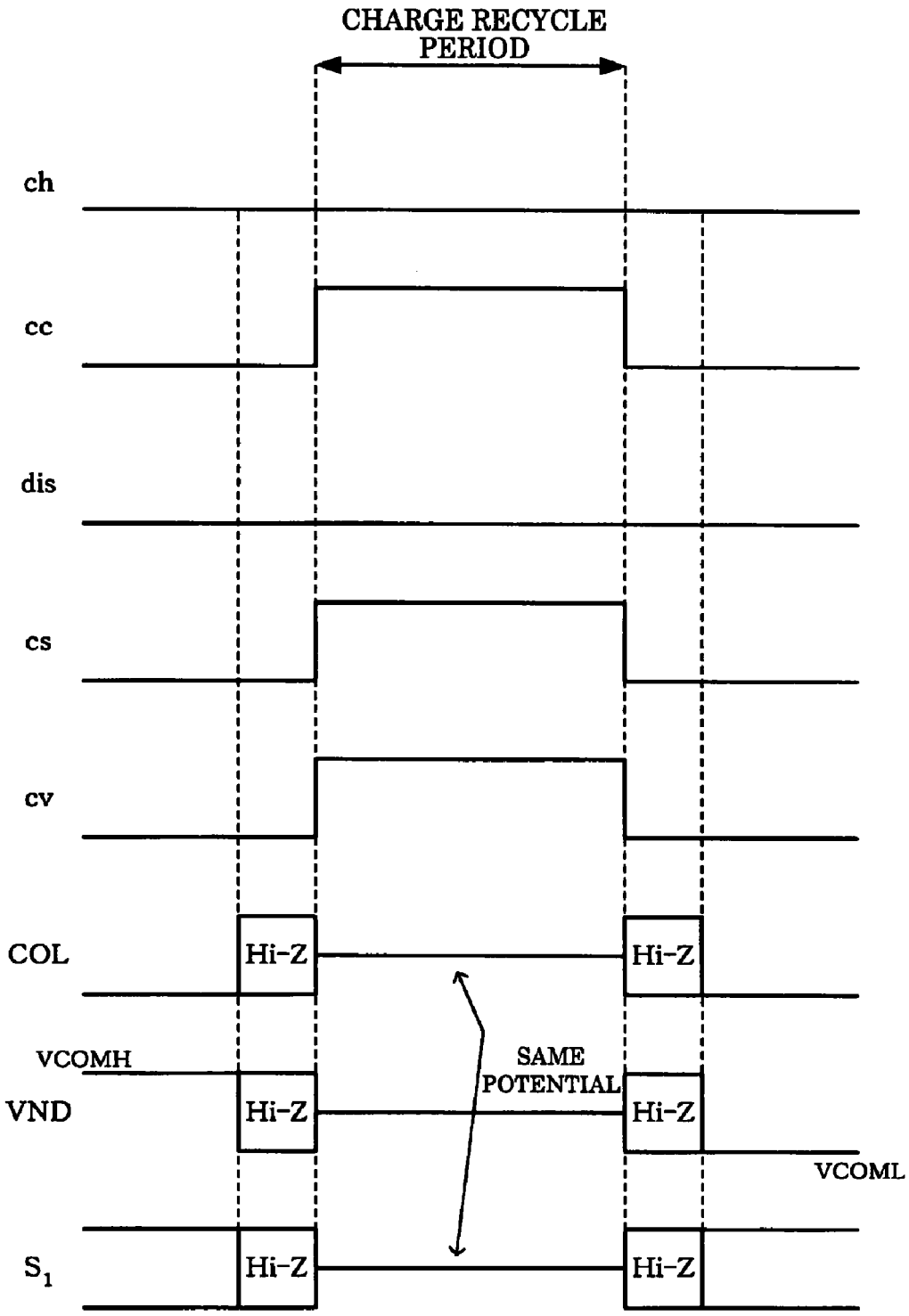
FIG. 23 is an example of a timing diagram of a control example of control signals, a common line, a common electrode, and a first source line in the second operation mode.

FIG. 23 shows an example of a timing diagram of the control signals ch, cc, cs, and cv, the common line COL, the common electrode CE, and the first source line $S_1$ in the second operation mode.

The charge recycle period can be provided by causing the control signals cc, cs, and cv to change at almost the same timing using the control registers as described above. In this case, the control signal dis is set at the L level.

This allows charges to flow between the common line COL and the second capacitor element CCS, whereby the potentials of the common line COL and the first source line $S_1$ can be changed without supplying charges from the power supply circuit. Likewise, charges flow between the common electrode voltage output node VND and the first capacitor element CCV, whereby the potential of the common electrode voltage output node VND can be changed without supplying charges from the power supply circuit.

The control signals cc, cs, and cv are then set at the L level and the drive period commences.

Figure 24:
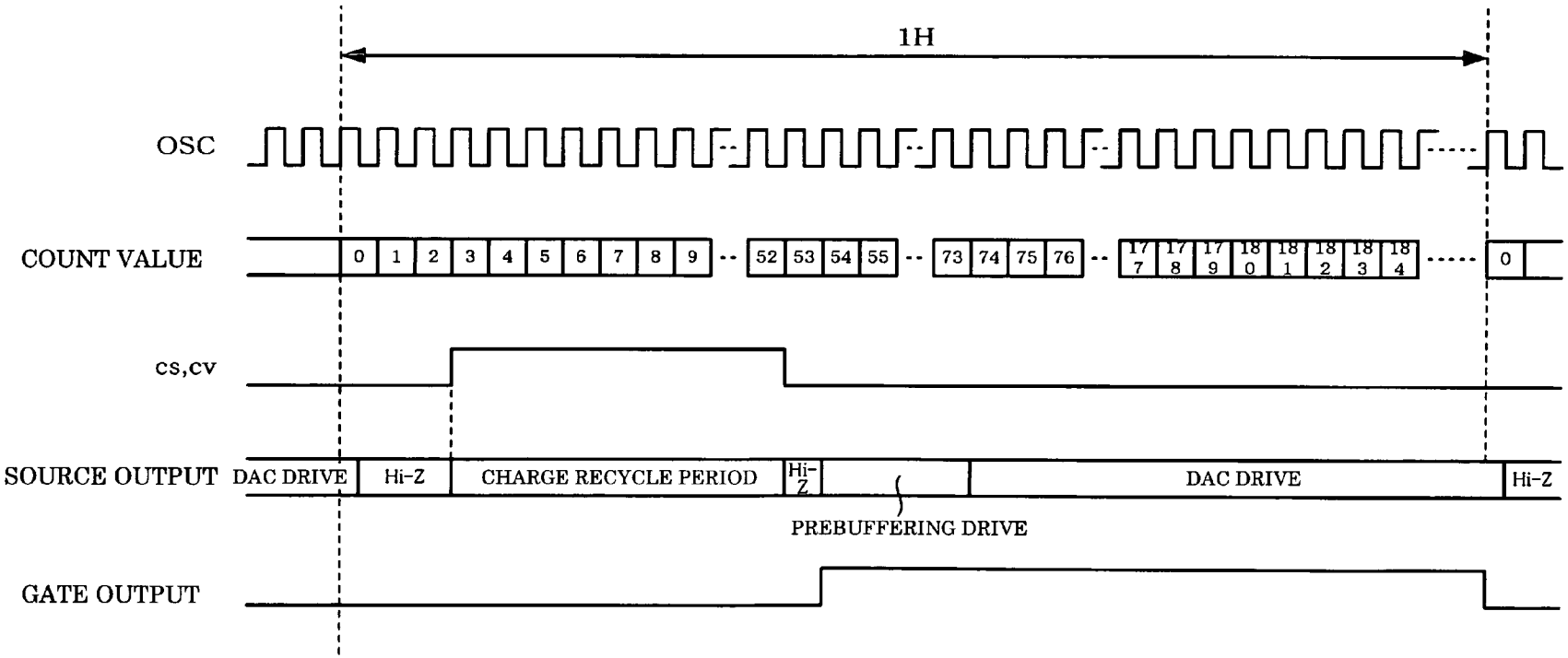
FIG. 24 is a timing diagram of an operation example of the display driver according to one embodiment of the invention.

FIG. 24 is a timing diagram of an operation example of the display driver 60 according to this embodiment.

In FIG. 24, the display driver 60 is set in the second operation mode. In this embodiment, the reference clock signal OSC may be used as a dot clock signal. The display data of one pixel or one dot is supplied to the display driver 60 from the display controller 40 in units of dot clock signals.

For example, the count value of the counter 112 shown in FIG. 1 starts to be incremented at the timing shown in FIG. 24. The control signals Cs and cv change at the count values corresponding to the values set in the control registers of the control register section 80 shown in FIG. 20, for example.

The source output then changes as described above. A high impedance period is provided between the DAC drive period and the charge recycle period and between the charge recycle period and the prebuffering drive period, respectively. This suppresses occurrence of a shoot-through current when the period transitions.

The timing of the gate output can also be changed by the value set in the control register.

As described above, the display driver 60 may include the control register in which the control data is set. The common electrode charge storage switch VSW, the source charge storage switch CSW, the first source short circuit switch $C2SW_1$, or the second source short circuit switch $C2SW_2$ is switch-controlled based on the control data.

The above description illustrates an example in which each switch is switch-controlled based on the control data set in the control register. Note that the invention is not limited thereto. For example, the display driver 60 may include an external setting terminal, and the common electrode charge storage switch VSW, the source charge storage switch CSW, the first source short circuit switch $C2SW_1$, or the second source short circuit switch $C2SW_2$ may be switch-controlled based on the state of a signal supplied to the external setting terminal. Specifically, the control signal for each switch may be supplied through the external setting terminal or may be generated based on a signal input to the external setting terminal.

4. Transistor Structure of Switch

In this embodiment, the transistors forming the common electrode charge storage switch VSW, the source charge storage switch CSW, the node short circuit switch HSW, the first to Nth source short circuit switches $C2SW_1$ to $C2SW_N$, the first to Nth bypass switches $BSW_1$ to $BSW_N$, the first to Nth source output switches $SS_1$ to $SS_N$ and the discharge transistor DisTr have different structures. Specifically, the chip area of the display driver 60 can be minimized and the manufacturing cost can be reduced by allowing the transistors forming the above switches or the discharge transistor DisTr to have different structures.

For example, the transistors forming the common electrode charge storage switch VSW, the source charge storage switch CSW, the node short circuit switch HSW, the first to Nth source short circuit switches $C2SW_1$ to $C2SW_N$, and the first to Nth bypass switches $BSW_1$ to $BSW_N$ and the discharge transistor DisTr excluding the transistors forming the first to Nth source output switches $SS_1$ to $SS_N$ are formed using a triple-well structure. On the other hand, the transistors forming the first to Nth source output switches $SS_1$ to $SS_N$ are formed using a twin-well structure.

Each of the first to Nth source output switches $SS_1$ to $SS_N$ is realized using a transfer gate including a P-type transistor and an N-type transistor.

Figure 25A:
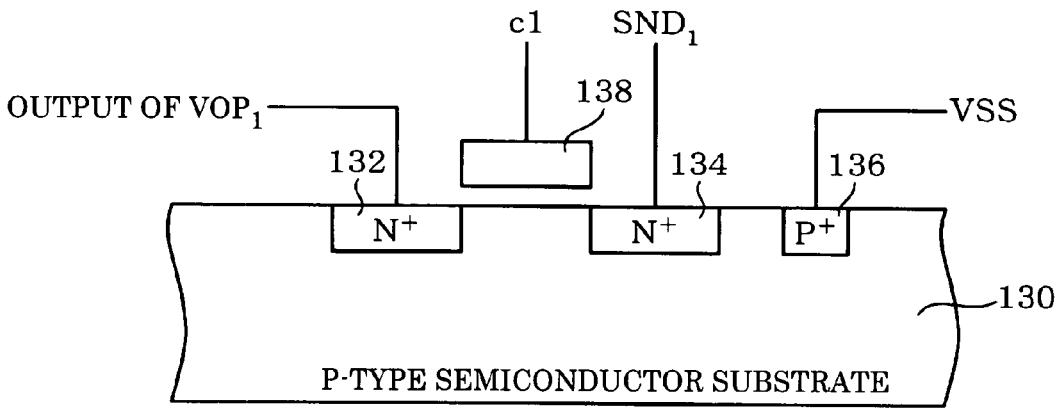
FIGS. 25A and 25B are schematic cross-sectional views of transistors having a twin-well structure forming a first source output switch.
Figure 25B:
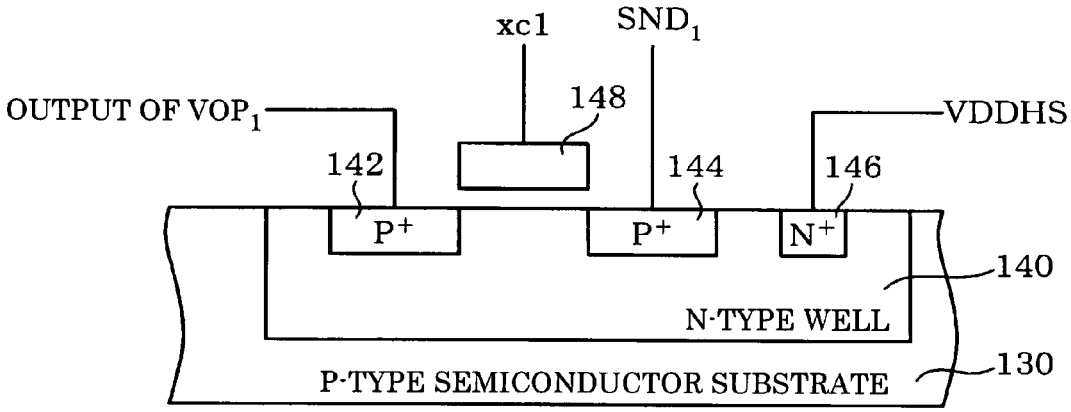

FIGS. 25A and 25B schematically show cross-sectional views of transistors having a twin-well structure forming the first source output switch $SS_1$. FIG. 25A is a cross-sectional view of an N-type transistor, and FIG. 25B is a cross-sectional view of a P-type transistor. FIGS. 25A and 25B show cross-sectional views of the transistors formed on a P-type semiconductor substrate. Note that the transistors may be formed on an N-type semiconductor substrate.

In FIG. 25A, high-concentration impurity diffusion layers 132 and 134 containing N-type impurities are formed in a P-type semiconductor substrate 130 as a drain region and a source region, respectively. A high-concentration impurity diffusion layer 136 containing P-type impurities is also formed in the P-type semiconductor substrate 130. A gate electrode 138 is provided over the P-type semiconductor substrate 130 through a gate insulating film in the region between the impurity diffusion layers 132 and 134. The system ground power supply voltage VSS, which is the lowest potential of the source line driver circuit 20, is supplied to the impurity diffusion layer 136 as a substrate potential. A channel region is formed by applying the control signal c1 to the gate electrode 138 in a state in which the voltage of the first source output node $SND_1$ is supplied to the impurity diffusion layer 132 and the output voltage of the operational amplifier $VOP_1$ is supplied to the impurity diffusion layer 134.

In FIG. 25B, an N-type well containing N-type impurities (low-concentration impurity layer; hereinafter the same) 140 is formed in the P-type semiconductor substrate 130. High-concentration impurity diffusion layers 142 and 144 containing P-type impurities are formed in the N-type well 140 as a drain region and a source region, respectively. A high-concentration impurity diffusion layer 146 containing N-type impurities is also formed in the N-type well 140. A gate electrode 148 is provided over the N-type well 140 through a gate insulating film in the region between the impurity diffusion layers 142 and 144. The power supply voltage VDDHS, which is the highest potential of the source line driver circuit 20, is supplied to the impurity diffusion layer 146. A channel region is formed by applying the control signal xc1 to the gate electrode 148 in a state in which the voltage of the first source output node $SND_1$ is supplied to the impurity diffusion layer 142 and the output voltage of the operational amplifier $VOP_1$ is supplied to the impurity diffusion layer 144.

The common electrode charge storage switch VSW is realized using a transfer gate including a P-type transistor and an N-type transistor.

Figure 26:
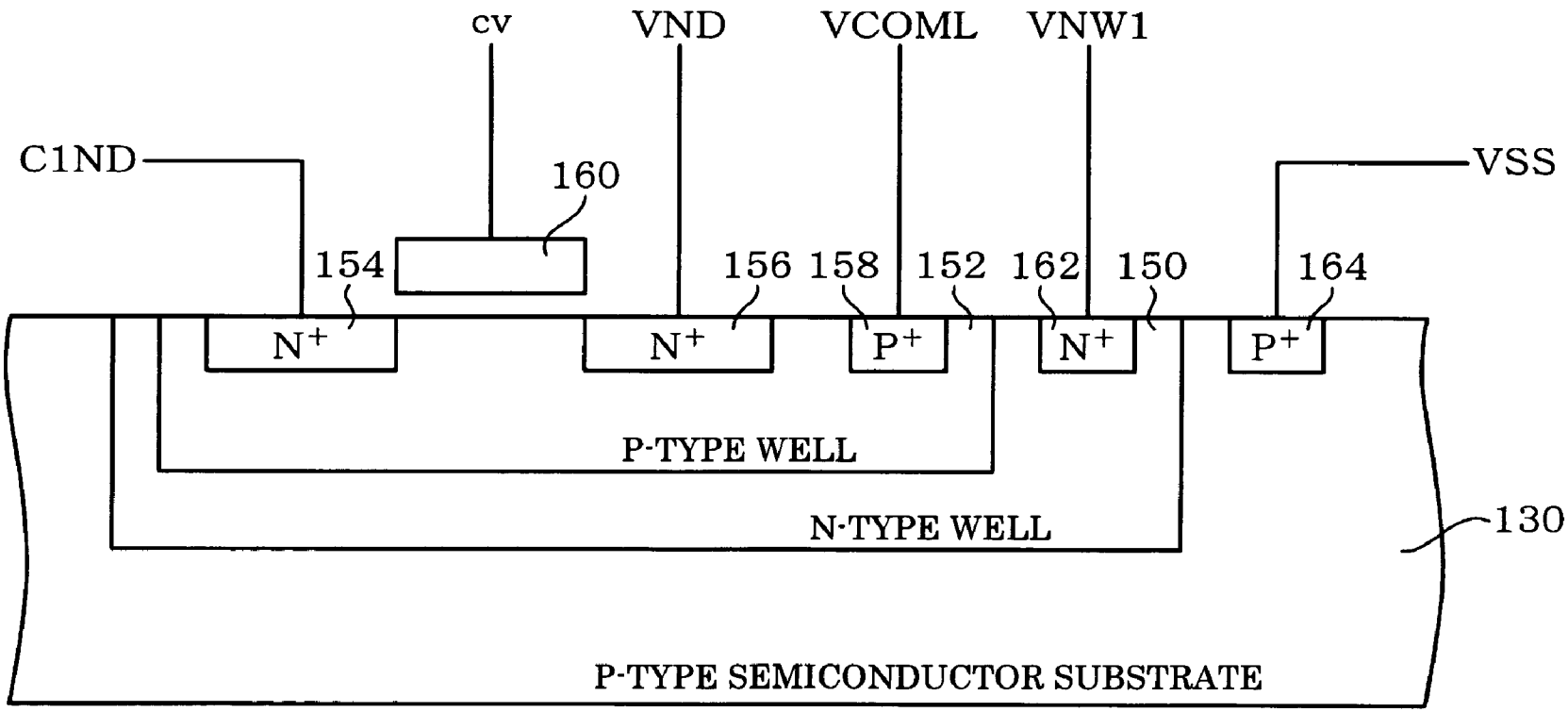
FIG. 26 is a schematic cross-sectional view of a transistor having a triple-well structure forming a common electrode charge storage switch.

FIG. 26 schematically shows a cross-sectional view of an N-type transistor having a triple-well structure forming the common electrode charge storage switch VSW.

In FIG. 26, the same sections as in FIG. 25A are indicated by the same symbols. Description of these sections is appropriately omitted.

In the triple-well structure, an N-type well 150 containing N-type impurities is formed in the P-type semiconductor substrate 130. A P-type well 152 containing P-type impurities is formed in the N-type well 150. High-concentration impurity diffusion layers 154 and 156 containing N-type impurities are formed in the P-type well 152 as a drain region and a source region, respectively. A high-concentration impurity diffusion layer 158 containing P-type impurities is also formed in the P-type well 152. A gate electrode 160 is provided over the P-type well 152 through a gate insulating film in the region between the impurity diffusion layers 154 and 156. The low-potential-side voltage VCOML is supplied to the impurity diffusion layer 158 as a substrate potential. A channel region is formed by applying the control signal cv to the gate electrode 160 in a state in which the voltage of the first capacitor element connection node C1ND is supplied to the impurity diffusion layer 154 and the voltage of the common electrode voltage output node VND is supplied to the impurity diffusion layer 156. Specifically, the low-potential-side voltage VCOML is supplied to the impurity layer in which the channel region is formed.

A well voltage VNW1 is supplied to the N-type well 150 through a high-concentration impurity diffusion layer 162 containing N-type impurities. The system ground power supply voltage VSS is supplied to the P-type semiconductor substrate 130 through a high-concentration impurity diffusion layer 164 containing P-type impurities. It suffices that the well voltage VNW1 be higher in potential than the system ground power supply voltage VSS and the low-potential-side voltage VCOML. For example, the high-potential-side power supply voltage VDD may be used as the well voltage VNW1.

In a P-type transistor having a triple-well structure, the high-potential-side voltage VCOMH is supplied as the substrate potential to the impurity layer in which the channel region is formed.

Specifically, when the common electrode charge storage switch VSW includes an N-type first transistor (first transistor of first conductivity type), and a transistor having a twin-well structure such as the transistor forming the first source output switch $SS_1$ is an N-type transistor, the substrate potential of the first transistor is caused to differ from the substrate potential of the transistor having a twin-well structure such as the transistor forming the first source output switch $SS_1$, as described above.

Since the transistor having a triple-well structure increases the layout area in comparison with the transistor having a twin-well structure, the chip area of the display driver 60 can be minimized by forming the transistors as described above.

4.1 Arrangement of Transistors Forming Switches

In this embodiment, each section of the display driver 60 is formed on a narrow chip in order to minimize the mounting area of the display panel 12 and the display driver 60 taking into consideration the point in which the display driver 60 is disposed along one side of the display panel 12. Therefore, elements generally disposed in the circuit block are disposed in a pad arrangement region such as an output-side I/F region provided on the side on which the signals are output to the display panel 12. In this case, the chip area can be reduced by disposing the transistors forming the source line driver circuit 20 in the pad arrangement region.

However, the number of output lines of the source line driver circuit 20 is generally very large. Therefore, when disposing the transistors forming the operational amplifiers and the like included in the source line driver circuit 20 in the pad arrangement region, a number of signal lines must be provided in the pad arrangement region, whereby the area of the wiring region increases. As a result, the width of the chip in a direction D2 cannot be reduced.

Therefore, this embodiment employs a method in which the transistors forming the switches controlled using common control signals in the source line driver circuit 20 are disposed in the pad arrangement region.

Figure 27:
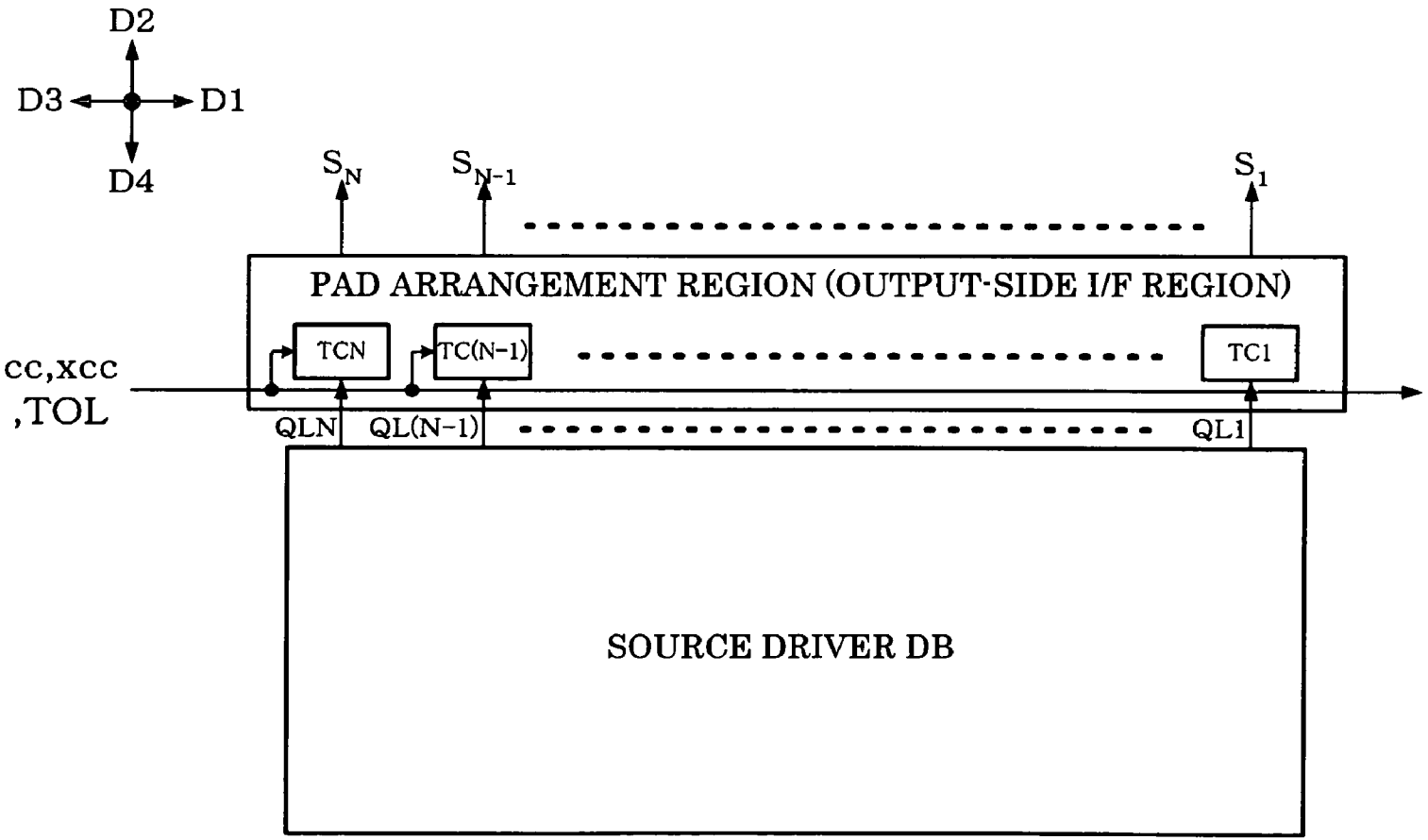
FIG. 27 is a layout view of a chip on which the display driver is formed.

FIG. 27 is a layout view of the chip on which the display driver 60 according to this embodiment is formed.

The source line driver circuit 20 of the display driver 60 includes a source driver block DB for driving the source lines $S_1, S_2, \ldots, S_{N-1}$, and $S_{N-1}$. The source line driver circuit 20 of the display driver 60 includes a plurality of control transistors TC1 to TCN and a pad arrangement region (output-side I/F region).

The control transistors TC1 to TCN are respectively provided corresponding to output lines QL1 to QLN of the source driver block DB, and are controlled using the control signal on a common control signal line. The control transistor may be an N-type (first conductivity type in a broad sense) transistor or a P-type (second conductivity type in a broad sense) transistor. Or, the control transistor may be a circuit combining an N-type transistor and a P-type transistor such as a transfer gate transistor.

Source driver pads (metal pads) for electrically connecting the source lines of the display panel with output lines QL1, QL2, QL3, QL4, . . . of the source driver block DB are disposed in the pad arrangement region. A pad other than the source driver pad or a dummy pad may be disposed in the pad arrangement region. Or, an electrostatic discharge protection element or a power supply protection circuit described later may be disposed in the pad arrangement region. The pad arrangement region is a region between the side (boundary or edge) of the circuit block and the long side of the chip of the display driver 60, for example. The pad arrangement region is an output-side I/F region, for example. It suffices that at least the center position (pad center) of the pad be disposed in the pad arrangement region.

In this embodiment, the control transistors TC1, TC2, TC3, . . . are disposed in the pad arrangement region, as shown in FIG. 27. Specifically, the control transistors TC1, TC2, TC3, . . . as shown in FIG. 27 are disposed in the pad arrangement region without disposing the transistors forming the differential section and the driver section of the operational amplifier of the data driver in the pad arrangement region.

For example, an output transistor forming the driver section of the operational amplifier is controlled using an input signal which is input to the gate of the output transistor and differs in units of source outputs. Therefore, when disposing such an output transistor in the pad arrangement region, the width of the chip of the display driver 60 in the direction D2 may be increased due to the input signal wiring region.

On the other hand, the control transistors TC1, TC2, TC3, . . . are controlled using the control signal which is common to the source outputs and transmitted through the common control signal line instead of the signal which differs in units of source outputs. Therefore, since the area of the wiring region is not increased to a large extent even if the control transistors TC1, TC2, TC3, . . . are disposed in the pad arrangement region, the width of the chip of the display driver 60 in the direction D2 can be reduced.

Figure 28:
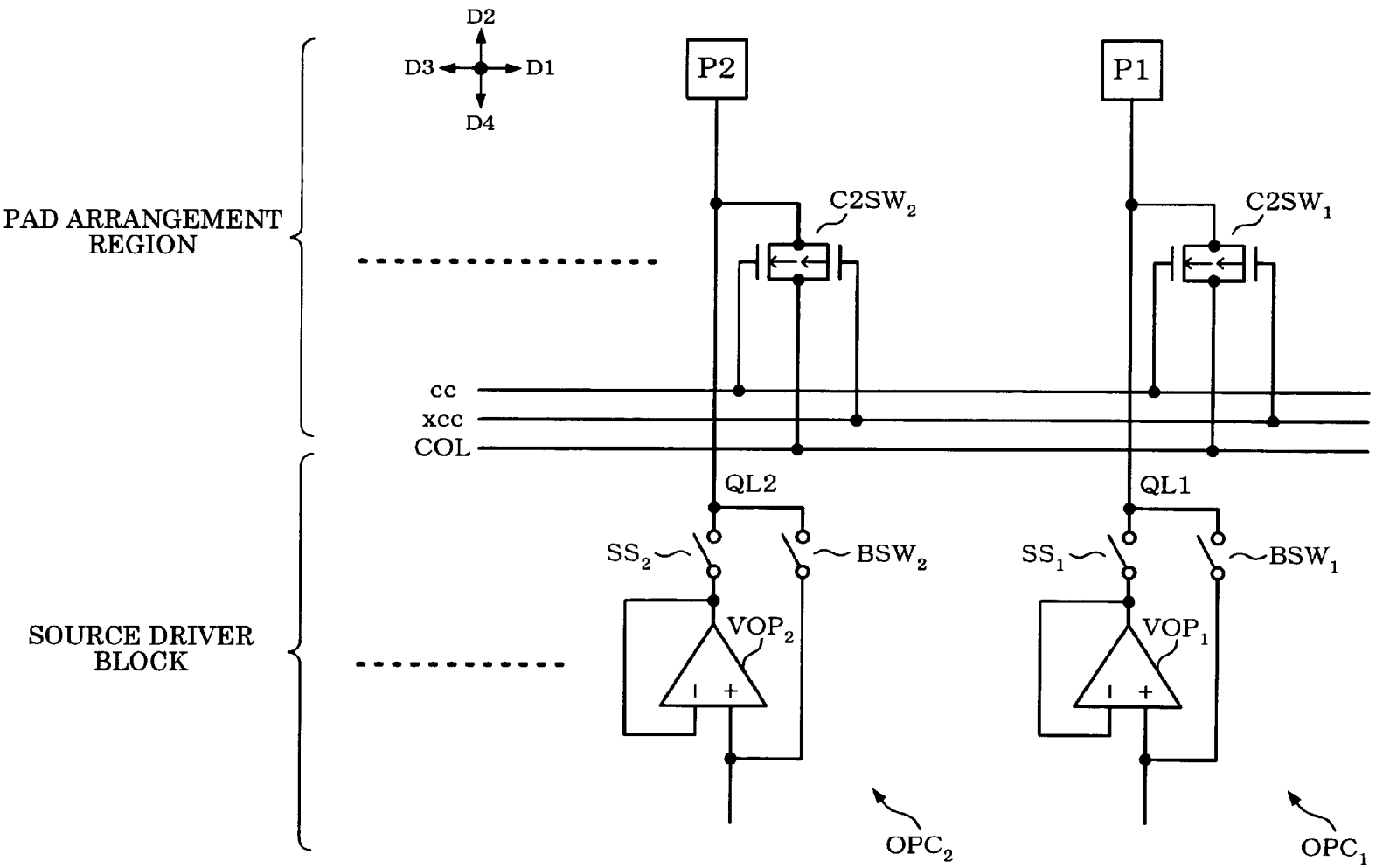
FIG. 28 is a view showing a configuration example of the operational amplifier circuit block of the source line driver circuit.

FIG. 28 shows a configuration example of the operational amplifier circuit blocks $OPC_1$ and $OPC_2$ of the source line driver circuit 20.

In FIG. 28, the sections shown in FIG. 13 are indicated by the same symbols. Description of these sections is appropriately omitted. The operational amplifier $VOP_1$ of the operational amplifier circuit block $OPC_1$ provided corresponding to the pad P1 performs impedance conversion of the data signal output to the source line. Specifically, the operational amplifier $VOP_1$ performs impedance conversion of the output signal from the DAC in the preceding stage, and outputs the data signal to the source line to drive the source line.

In FIG. 28, the common line COL is disposed in the pad arrangement region in the same direction (direction D1 or direction D3) as the control signal line. The first source short circuit switch $C2SW_1$ shown in FIG. 13 is employed as the control transistor TC1. The output line QL1 and the common line are electrically connected when the control signals cc and xcc on the control signal lines have become active. The second source short circuit switch $C2SW_2$ shown in FIG. 13 is employed as the control transistor TC2. The output line QL2 and the common line are electrically connected when the control signals cc and xcc on the control signal lines have become active. The remaining source short circuit switches operate in the same manner as described above.

In this embodiment, the control transistors TC1 and TC2 as shown in FIG. 28 are disposed in the pad arrangement region. In more detail, the control transistors TC1 and TC2 are respectively disposed in the lower layer of (under) the pads P1 and P2 so that at least part (part or all) of the control transistors TC1 and TC2 overlaps the pads (metal pads) P1 and P2 in a plan view. In other words, the pads P1 and P2 (source driver pads) are disposed in the upper layer of the control transistors TC1 and TC2 so that the pads P1 and P2 partially or entirely overlap the control transistors TC1 and TC2.

When disposing the transistor in the lower layer of the pad, the threshold voltage of the transistor may change due to stress applied to the pad during wire bonding or bump mounting. Moreover, the capacitance of the interlayer dielectric of the transistor may change from the capacitance during design. Therefore, the characteristics of the transistor on the wafer may differ from the characteristics after mounting. In order to solve the above problems, transistors for outputting an analog voltage such as the transistors (analog circuits) forming the differential sections (differential stage) and the driving sections (driving stage) of the operational amplifiers VOP1 and VOP2 are disposed in the source driver block instead of disposing the transistors in the lower layer of the pads.

On the other hand, transistors functioning as digital switches and outputting a digital voltage such as the control transistors TC1 and TC2 are disposed in the lower layer of the pads. This prevents occurrence of the above problems and reduces the layout area of the chip of the display driver 60, whereby the width of the chip of the display driver 60 in the direction D2 can be further reduced. For example, since the number of output lines of the source driver is very large, the area is remarkably reduced.

The gates of the output transistors forming the driver sections of the operational amplifiers $VOP_1$ and $VOP_2$ are controlled using different gate control signals in the operational amplifier circuit block $OPC_1$ and $OPC_2$. Therefore, when disposing these output transistors in the pad arrangement region, it is necessary to provide gate control signal lines in the same number as the source lines in the pad arrangement region, whereby the area of the wiring region is increased.

On the other hand, the control transistors TC1 and TC2 shown in FIG. 28 are controlled using the control signal transmitted through the common control signal line. Therefore, when disposing the control transistors TC1 and TC2 in the pad arrangement region, it suffices to provide the common control signal line in the pad arrangement region. Since the output lines QL1 and QL2 are connected with the pads P1 and P2 through connection lines, the area of the wiring region is increased to only a small extent by disposing the control transistors TC1 and TC2 under the connection lines and connecting the drains of the control transistors TC1 and TC2 with the connection lines. Therefore, an increase in the area of the wiring region due to the control transistors TC1 and TC2 is minimized.

Figure 29:
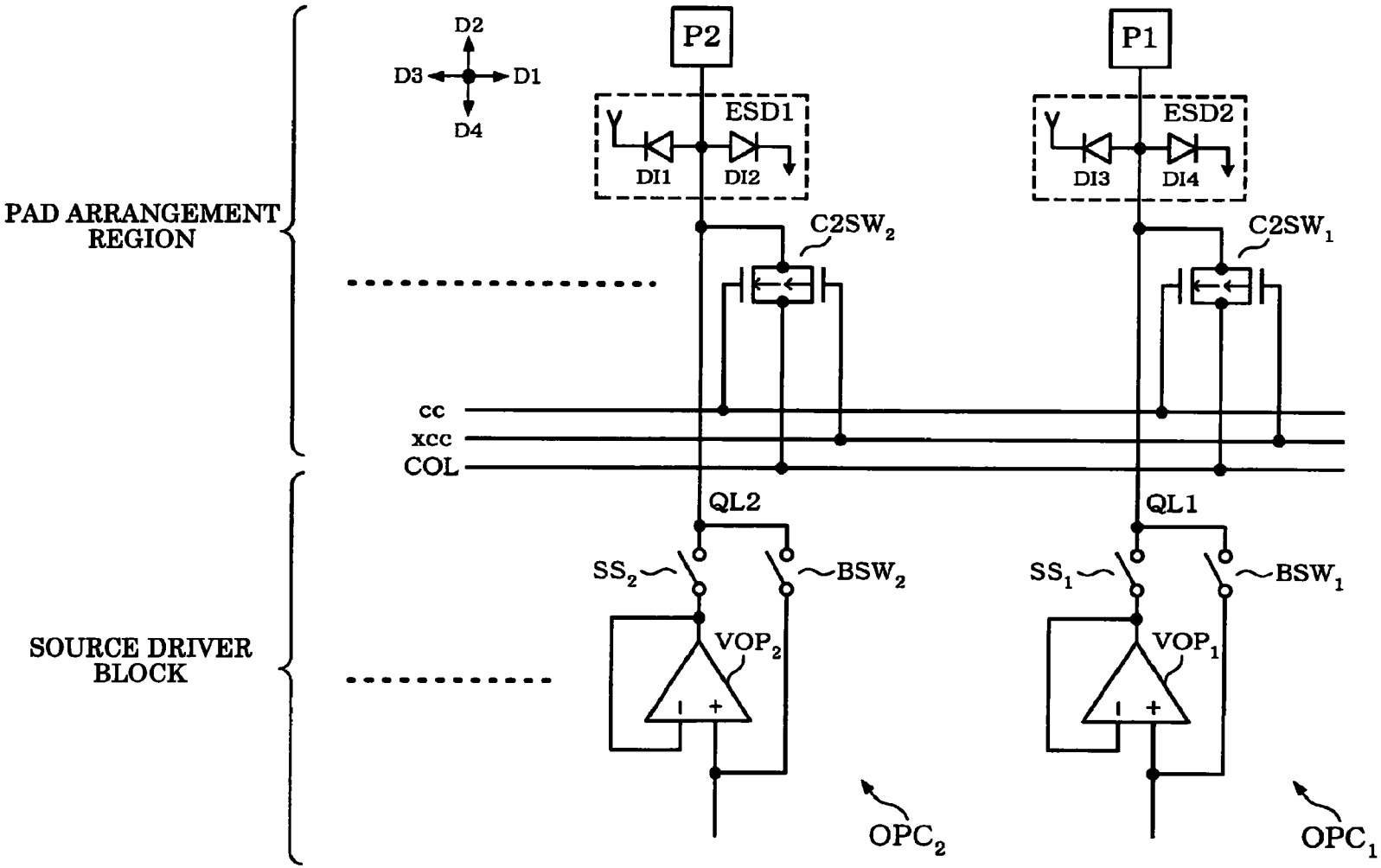
FIG. 29 is another view showing a configuration example of the operational amplifier circuit block of the source line driver circuit.

In FIG. 29, a first electrostatic discharge protection element ESD1 is provided corresponding to the pad P1, and a second electrostatic discharge protection element ESD2 is provided corresponding to the pad P2. The first electrostatic discharge protection element ESD1 includes a first diode DI1 provided between the high-potential-side power supply (VDDHS) and the output line QL1 of the source driver block, and a second diode DI2 provided between the low-potential-side power supply (VSS) and the output line QL1. The second electrostatic discharge protection element ESD2 includes a third diode DI3 provided between the high-potential-side power supply and the output line QL2 of the source driver block, and a fourth diode DI4 provided between the low-potential-side power supply and the output line QL2. The diodes DI1 to DI4 may be Zener diodes formed at the boundary between the diffusion region and the well region or the like, or may be GCD transistor diodes formed by connecting the source and the gate of the transistor.

In this embodiment, the electrostatic discharge protection elements ESD1 and ESD2 are also disposed in the pad arrangement region. In more detail, the electrostatic discharge protection elements ESD1 and ESD2 are disposed in the lower layer of the pads P1 and P2 so that the electrostatic discharge protection elements ESD1 and ESD2 at least partially overlap the pads P1 and P2. This enables the width of the chip of the display driver 60 in the direction D2 can be further reduced.

4.2 Layout of Pad Arrangement Region

Figure 30:
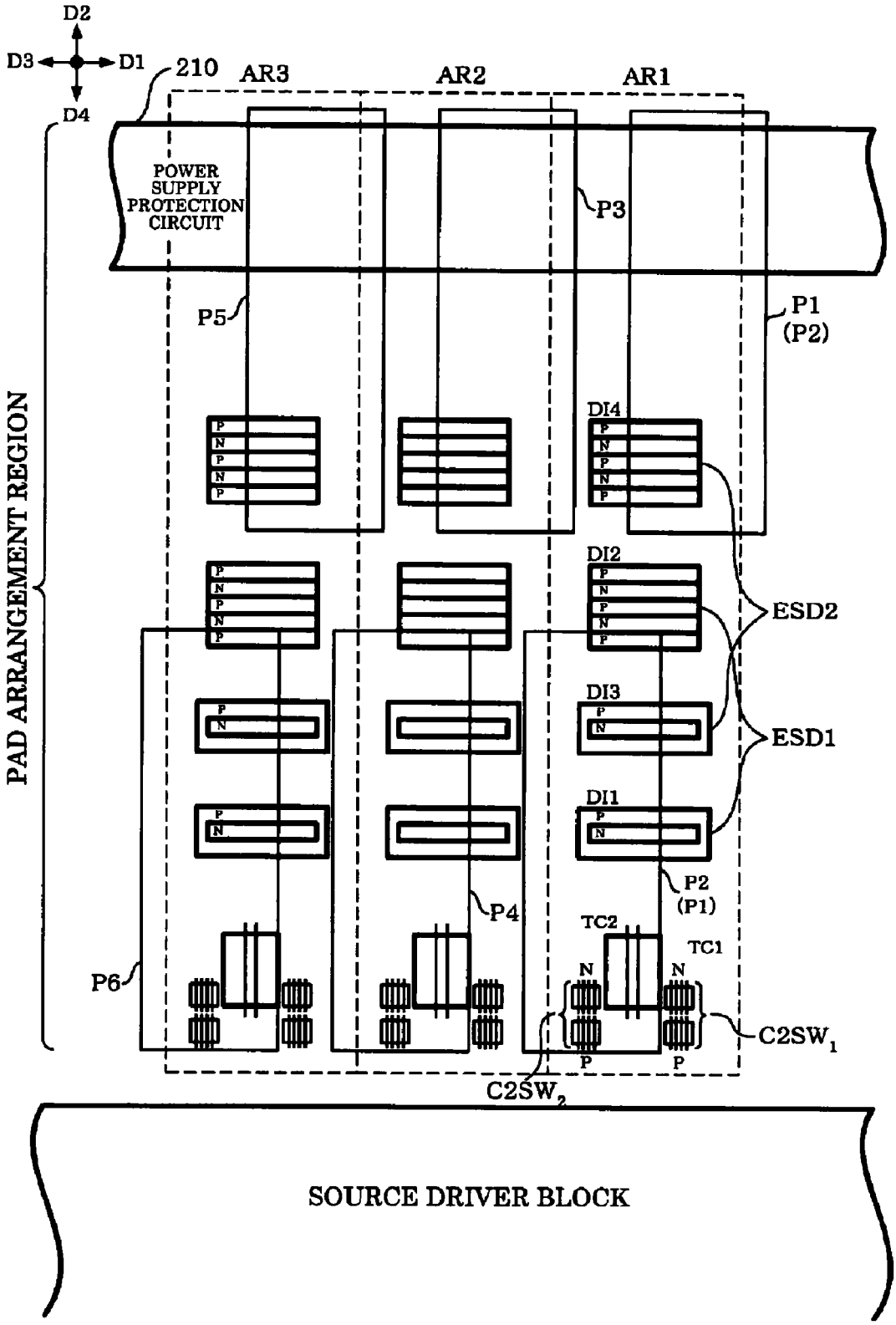
FIG. 30 is a view showing a layout example of a pad arrangement region.
Figure 31A:
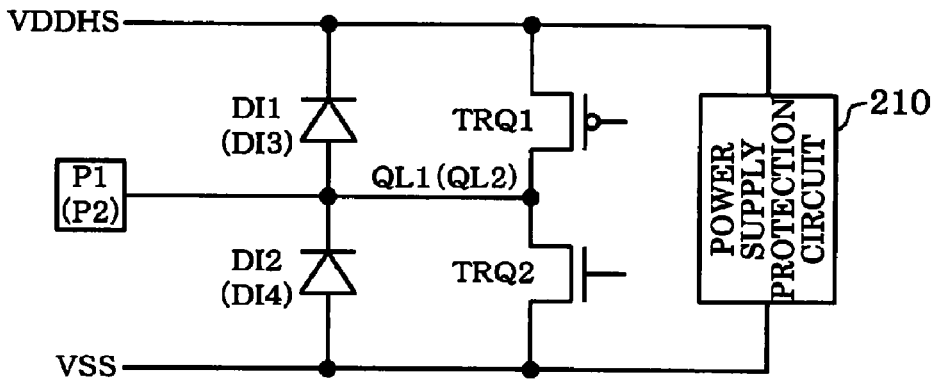
FIG. 31A is a view showing an example of an electrostatic discharge protection element and the like provided between power supplies.

FIG. 30 shows a layout example of the pad arrangement region. FIG. 31A shows an example of the electrostatic discharge protection element and the like provided between the power supplies VDDHS and VSS. In FIG. 31A, the diode DI1 (DI3) is provided between the output line QL1 (QL2) connected with the pad P1 (P2) and the power supply VDDHS. The diode DI2 (DI4) is provided between the output line QL1 (QL2) and the power supply VSS. The diodes DI1 and DI2 allow charges to be removed toward the power supply VDD2 or VSS when an electrostatic voltage is applied to the pad P1, whereby the transistors TRQ1 and TRQ2 (e.g. output transistors of the driver sections of the operational amplifiers) can be protected against static electricity.

In FIG. 31A, a power supply protection circuit 210 is provided between the high-potential-side power supply VDDHS and the low-potential-side power supply VSS. The power supply protection circuit 210 functions as a voltage clamp circuit which clamps a voltage at a specific voltage value when a high voltage equal to or higher than a given voltage is applied between the high-potential-side power supply VDDHS and the low-potential-side power supply VSS. As the power supply protection circuit 210, a silicon controlled rectifier (SCR), a bipolar transistor, a plurality of diodes reverse-connected in series, or the like may be used.

Figure 31B:
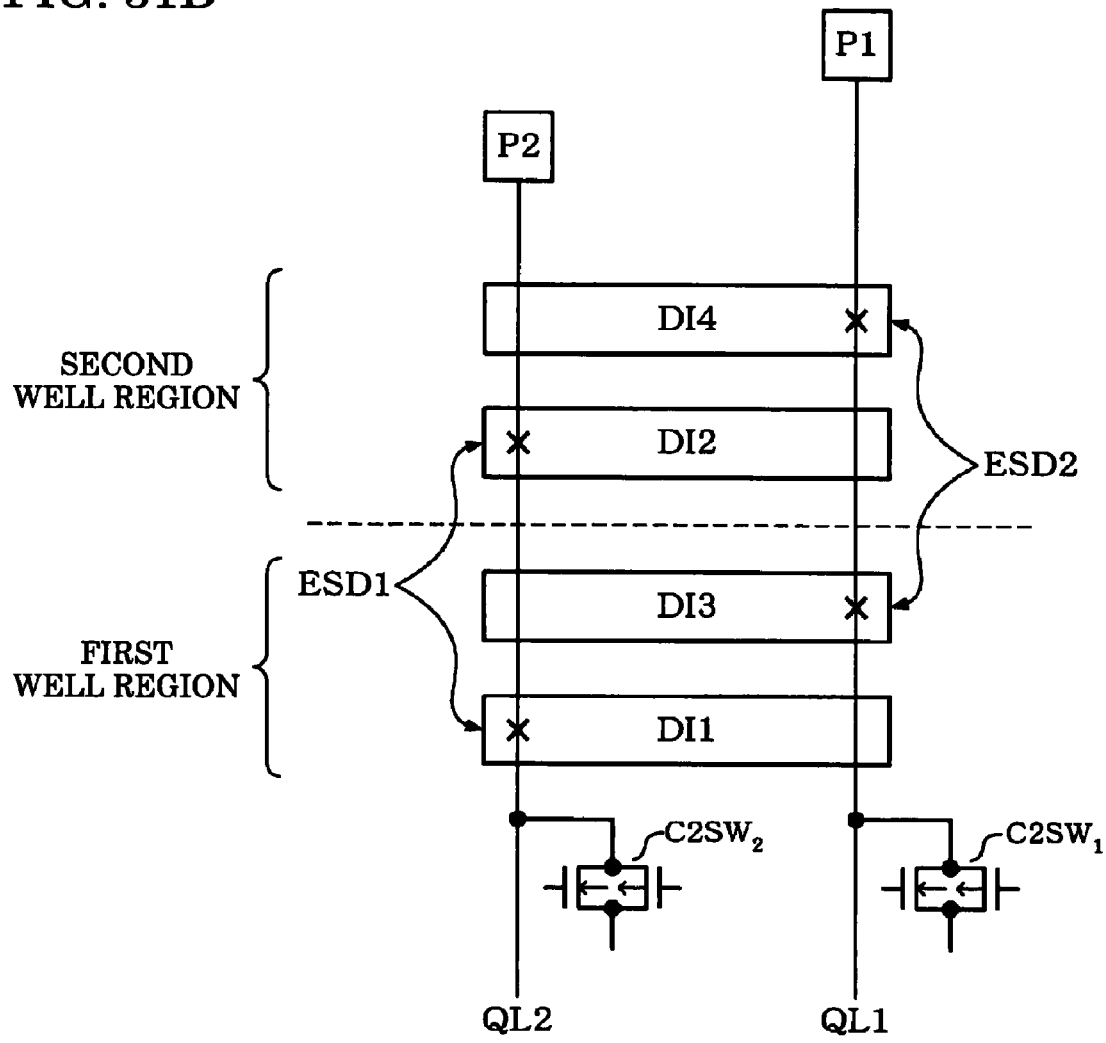
FIG. 31B is a view showing the connection relationship of pads, diodes, and control transistors shown in FIG. 30.

FIG. 31B shows the connection relationship of the pads P1 and P2, the diodes DI1 to DI4 forming the electrostatic discharge protection elements ESD1 and ESD2, and the control transistors TC1 and TC2 shown in FIG. 30. As shown in FIG. 31B, the diodes DI1 and DI2 forming the electrostatic discharge protection element ESD1 and the control transistor TC1 are connected with the pad P1. The diodes DI3 and DI4 forming the electrostatic discharge protection element ESD2 and the control transistors TC2, TCN2, and TCP2 are connected with the pad P2. The diodes DI1 and DI3 are formed in a first well region, and the diodes DI2 and DI4 are formed in a second well region formed separately from the first well region.

In FIG. 30, the direction in which the source lines (output lines) of the display panel are arranged is the direction D1, and the direction perpendicular to the direction D1 is the direction D2. As shown in FIG. 30, the control transistors TC1 and TC2 described with reference to FIG. 29 are disposed on the direction D2 side of the source driver block. The electrostatic discharge protection elements ESD1 (diodes DI1 and DI2) and ESD2 (diodes DI3 and DI4) are disposed on the direction D2 side of the control transistors TC1 and TC2. Specifically, the control transistors TC1 and TC2 are disposed between the source driver block and the electrostatic discharge protection elements ESD1 and ESD2. In FIG. 30, the control transistors TC1 and TC2 and the electrostatic discharge protection elements ESD1 and ESD2 are disposed in the lower layer of (under) the pads P1 and P2 so that the control transistors TC1 and TC2 and the electrostatic discharge protection elements ESD1 and ESD2 partially overlap the pads P1 and P2 in a plan view. According to this arrangement, since the control transistors TC1 and TC2 are disposed near the source driver block, the output lines from the source driver block can be connected with the control transistors TC1 and TC2 through short paths, whereby the layout efficiency and the wiring efficiency can be increased. According to this arrangement, the electrostatic discharge protection elements ESD1 and ESD2 are disposed near the pads P1 and P2 in comparison with the control transistors TC1 and TC2. Therefore, when an electrostatic voltage is applied to the pads P1 and P2, static electricity is discharged by the electrostatic discharge protection elements ESD1 and ESD2 and is applied to the control transistors TC1 and TC2 after a delay. This prevents a situation in which the control transistors TC1 and TC2 are destroyed due to static electricity.

A method may be employed in which the electrostatic withstand voltage is increased by increasing the drain area of the control transistors TC1 and TC2. However, this method results in an increase in the width of the pad arrangement region in the direction D2, whereby the width of the integrated circuit device in the direction D2 is also increased.

According to the arrangement shown in FIG. 30, since the electrostatic withstand voltage can be increased without increasing the drain area of the control transistors TC1 and TC2 to a large extent, the width of the integrated circuit device in the direction D2 can be reduced.

In FIG. 30, the pad arrangement region has a plurality of arrangement areas AR1, AR2, AR3, . . . arranged along the direction D3. Two (K in a broad sense; K is an integer of two or more) source driver pads P1 and P2 (centers of pads) arranged along the direction D2 are disposed in the arrangement area AR1 (each arrangement area). Two (K) electrostatic discharge protection elements ESD1 and ESD2 respectively connected with the pads P1 and P2 are also disposed in the arrangement area AR1. The control transistors TC1 and TC2 are also disposed in the arrangement area AR1.

In FIG. 30, two pads are disposed in each arrangement area in a staggered arrangement. For example, the pads P1 and P2 arranged along the direction D2 disposed so that the centers of the pads P1 and P2 are displaced along the direction D3. Specifically, when the direction D3 is the X axis, the pads P1 and P2 differ in the X coordinate.

A number of pads can be disposed along the direction D3 (direction D1) by disposing the pads P1 and P2 in a staggered arrangement, whereby a number of data signals from the source driver block can be output to the source lines through the pads.

When the pad pitch is reduced by disposing the pads in a staggered arrangement, the width of the arrangement area AR1 in the direction D3 (direction D1) is reduced. In FIG. 30, the arrangement area AR1 is formed while incorporating a pair of pads P1 and P2. Therefore, the width of the arrangement area AR1 in the direction D3 (direction D1) can be increased to a certain extent. This allows the electrostatic discharge protection elements ESD1 and ESD2 and the control transistors TC1 and TC2 to be disposed in the arrangement area AR1.

In FIG. 30, the first electrostatic discharge protection element ESD1 of the two (K) electrostatic discharge protection elements disposed in the arrangement area AR1 includes the first and second diodes DI1 and DI2, and the second electrostatic discharge protection element ESD2 includes the third and fourth diodes DI3, and DI4. The diodes DI1, DI2, DI3, and DI4 are disposed in the arrangement area AR1 along the direction D2. The width of the arrangement area AR1 in the direction D1 can be reduced by stacking the diodes DI1 to DI4 along the direction D2.

As a method of a comparative example, a method may be considered in which the diodes DI1 and DI2 are stacked along the direction D1 and the diodes DI3 and DI4 are stacked along the direction D1 on the upper side of the diodes DI1 and DI2. According to this method, since the diodes are stacked along the direction D3 (direction D1) and the P-type well region and the N-type well region are arranged along the direction D1, the width of the arrangement area AR1 in the direction D1 is increased.

In FIG. 30, the diodes DI1 to DI4 are stacked along the direction D2, and the P-type well region and the N-type well region are formed along the direction D2. Specifically, the first well region (N-type) in which the diodes DI1 and DI3 are formed is formed separately along the direction D2 from the second well region (P-type) in which the diodes DI2 and DI4 are formed. Therefore, the width of the arrangement area AR1 in the direction D1 can be reduced, whereby a narrow pad pitch can be dealt with.

In FIG. 30, the power supply protection circuit 210 provided between the high-potential-side power supply and the low-potential-side power supply is disposed on the direction D2 side of the electrostatic discharge protection elements ESD1 and ESD2. Specifically, since the power supply protection circuit 210 must immediately clamp a voltage upon application of a high voltage to protect the transistors in the circuit block, the circuit scale of the power supply protection circuit 210 is generally large. On the other hand, the power supply protection circuit 210 need not be provided corresponding to each output pad of the source driver, differing from the electrostatic discharge protection elements ESD1 and ESD2.

In FIG. 30, the power supply protection circuit 210 is formed along the periphery of the chip of the display driver 60 on the direction D2 side of the electrostatic discharge protection elements ESD1 and ESD2. A plurality of power supply protection circuits 210, each of which is disposed in units of a plurality of pads, can be formed by effectively utilizing the lower layer region of the pads. Therefore, the electrostatic withstand voltage can be increased while minimizing an increase in the chip area of the display driver 60.

In this embodiment, a source line discharge transistor SdisTr may be provided for each source output instead of the discharge transistor DisTr connected with the common line COL.

Figure 32:
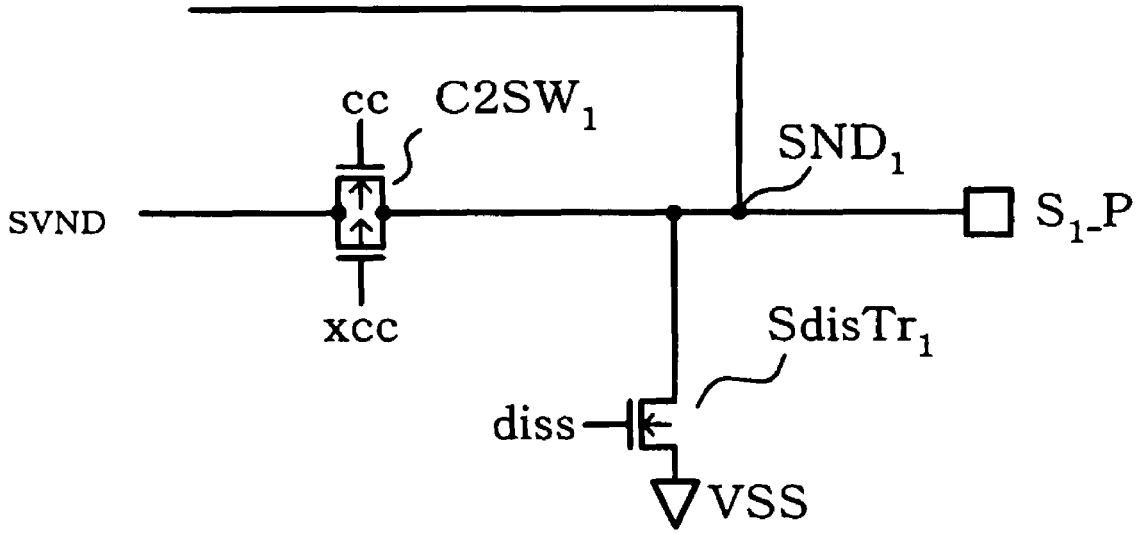
FIG. 32 is a view illustrative of a source line discharge transistor.

FIG. 32 is a view illustrative of the source line discharge transistor.

In FIG. 32, the same sections as in FIG. 13 are indicated by the same symbols. Description of these sections is appropriately omitted. The drain of a first source line discharge transistor $SdisTr_1$ is connected with the first source output node $SND_1$ to which the voltage applied to the first source line $S_1$ is supplied. A discharge voltage such as the system ground power supply voltage VSS is supplied to the source of the first source line discharge transistor $SdisTr_1$. A control signal diss generated by the control circuit (not shown) is supplied to the gate of the first source line discharge transistor $SdisTr_1$. The first source short circuit switch $C2SW_1$ is provided between the first source output node $SND_1$ and the source voltage output node SVND.

The drain of the source line discharge transistor is connected with each of the second to Nth source output nodes $SND_2$ to $SND_N$ in source output units in the same manner as in FIG. 32. The first to Nth source line discharge transistors $SdisTr_1$ to $SdisTr_N$ are ON/OFF-controlled using a single control signal diss or control signals controlled in source line units.

The source short circuit switches and the source line discharge transistors provided in source output units may be disposed in the pad arrangement region, as shown in FIG. 32.

Figure 33:
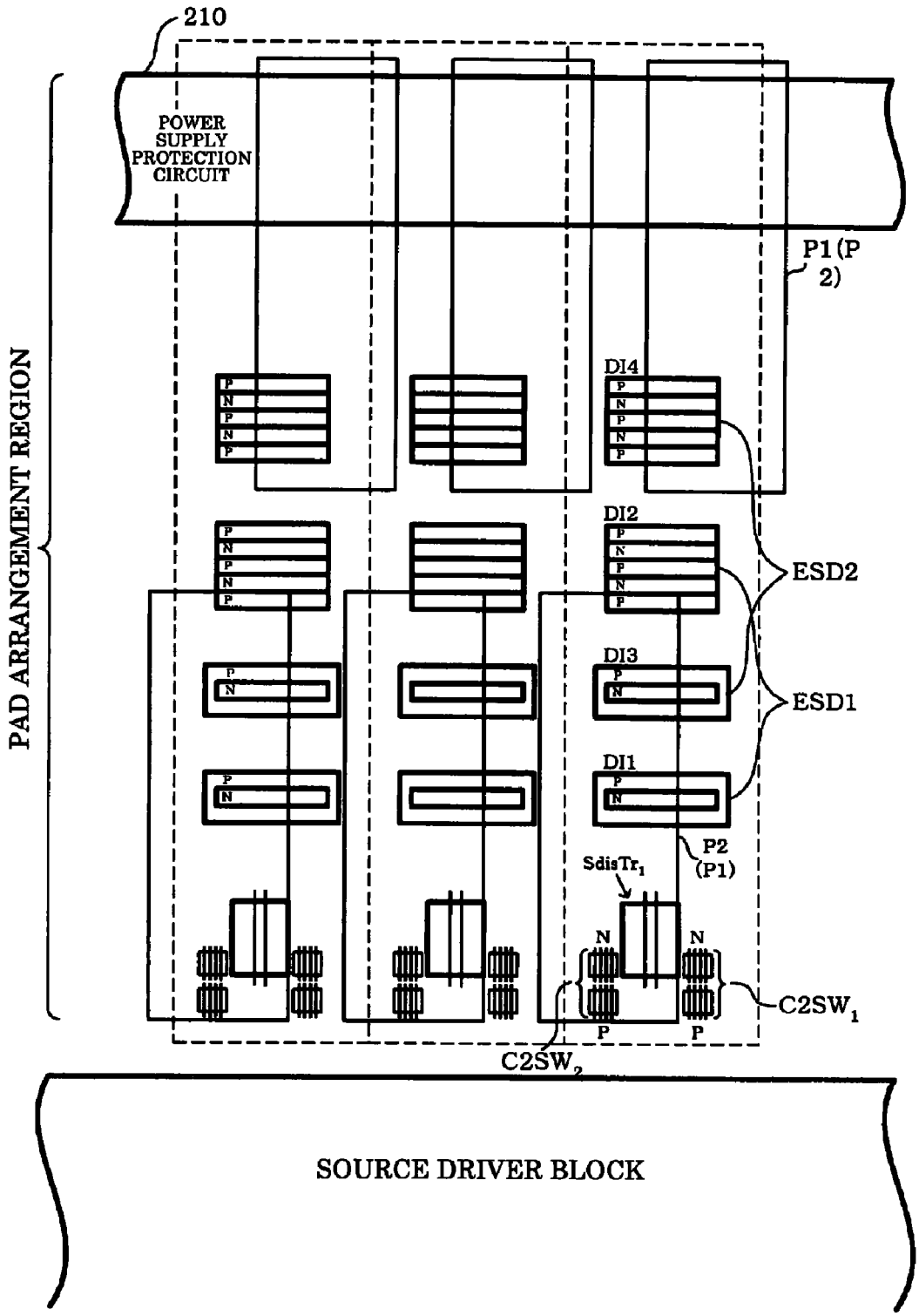
FIG. 33 is a view showing a layout example of a first source short circuit switch and a first source line discharge transistor in the pad arrangement region.

FIG. 33 shows a layout example of the first source short circuit switch $C2SW_1$ and the first source line discharge transistor $SdisTr_1$ in the pad arrangement region.

In FIG. 33, the same sections as in FIG. 30 are indicated by the same symbols. Description of these sections is appropriately omitted. As shown in FIG. 33, the first source line discharge transistor $SdisTr_1$ is disposed in the lower layer of the pad P2 (P1) as a first source line connection pad $S_1_P$ connected with the first source line $S_1$. In more detail, the first source line discharge transistor $SdisTr_1$ is disposed so that the active region of the first source line discharge transistor $SdisTr_1$ is disposed in the lower layer of the pad P2, and the pad P2 and the active region at least partially overlap in a plan view.

In FIG. 33, the first source short circuit switch $C2SW_1$ is formed in the region near the pad P2. Since it suffices that the first source line discharge transistor $SdisTr_1$ and the first source short circuit switch $C2SW_1$ function as digital switches, as described above, the width of the chip of the display driver 60 in the direction D2 can be further reduced without causing the characteristics to deteriorate.

In this embodiment, the common electrode charge storage switch CVW may be disposed in the region near the first capacitor element connection pad PD1 as the first capacitor element connection terminal TL1 as described below.

Figure 34:
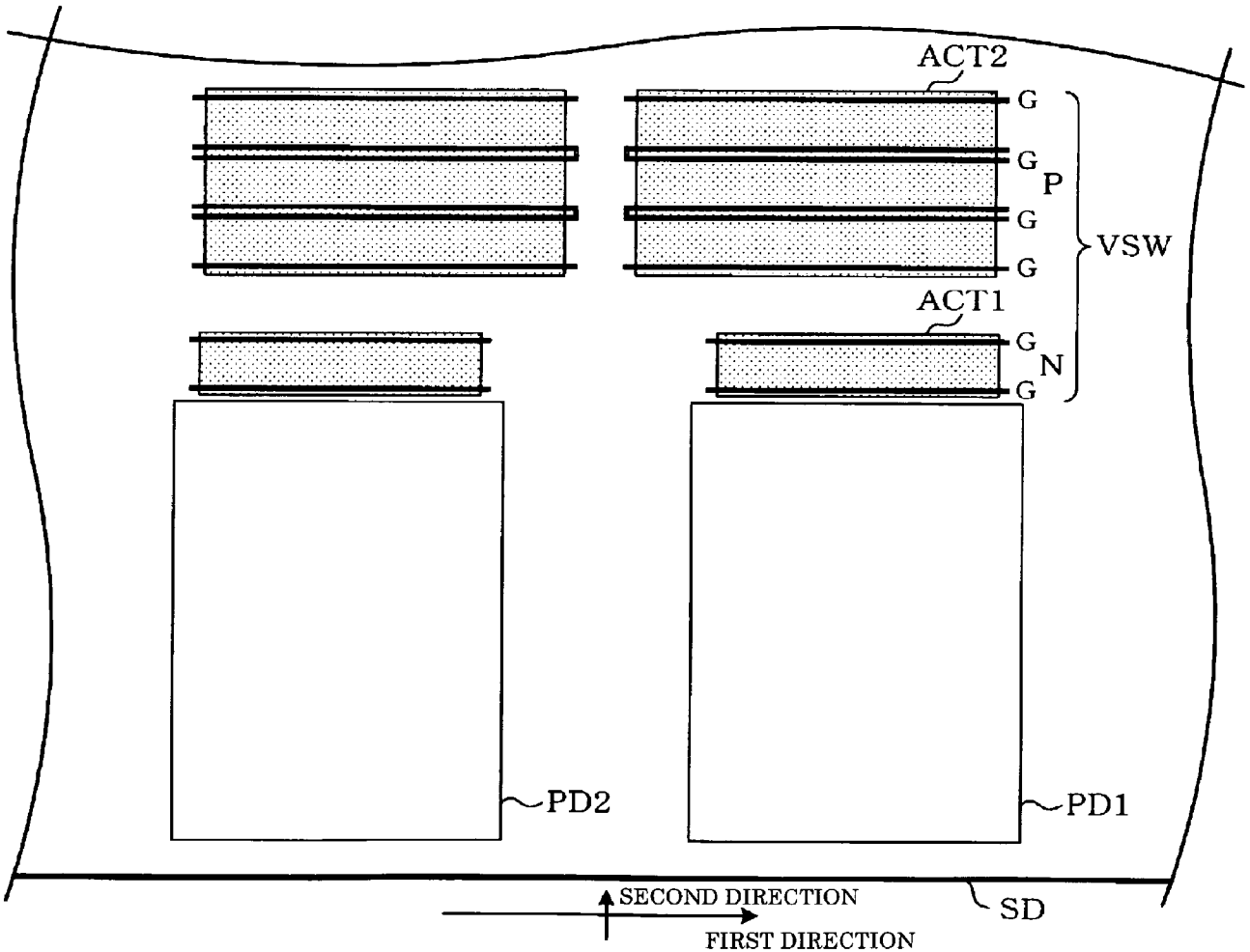
FIG. 34 is a view showing a layout arrangement example of a common electrode charge storage switch formed in a region near a first capacitor element connection pad.

FIG. 34 shows a layout arrangement example of the common electrode charge storage switch CVW formed in the region near the first capacitor element connection pad PD1.

In FIG. 34, the interconnect layer is omitted, and only the active region, the gate electrode, and the metal pads forming the pads are illustrated for convenience. The first capacitor element connection pad PD1 electrically connected with the first capacitor element connection node and the common electrode connection pad PD2 electrically connected with the common electrode voltage output node are disposed in the pad arrangement region provided on the end SD of the long side of the chip of the display driver 60. The common electrode connection pad PD2 and the first capacitor element connection pad PD1 are adjacently disposed along the first direction. The common electrode charge storage switch VSW is disposed adjacent to the first capacitor element connection pad PD1 along the second direction which intersects the first direction. The first capacitor element connection pad PD1 is electrically connected with the N-type transistor and the P-type transistor forming the common electrode charge storage switch VSW through an interconnect layer (not shown).

In FIG. 34, the N-type transistor forming the common electrode charge storage switch VSW is formed in the region in which the gate electrode (indicated by G in FIG. 34) is disposed on an active region ACT1. In FIG. 34, the P-type transistor forming the common electrode charge storage switch VSW is formed in the region in which the gate electrode (indicated by G in FIG. 34) is disposed on an active region ACT2.

The common electrode charge storage switch VSW may be formed so that the formation region of the common electrode charge storage switch VSW at least partially overlaps the first capacitor element connection pad PD1 (metal pad) in a plan view.

Figure 35:
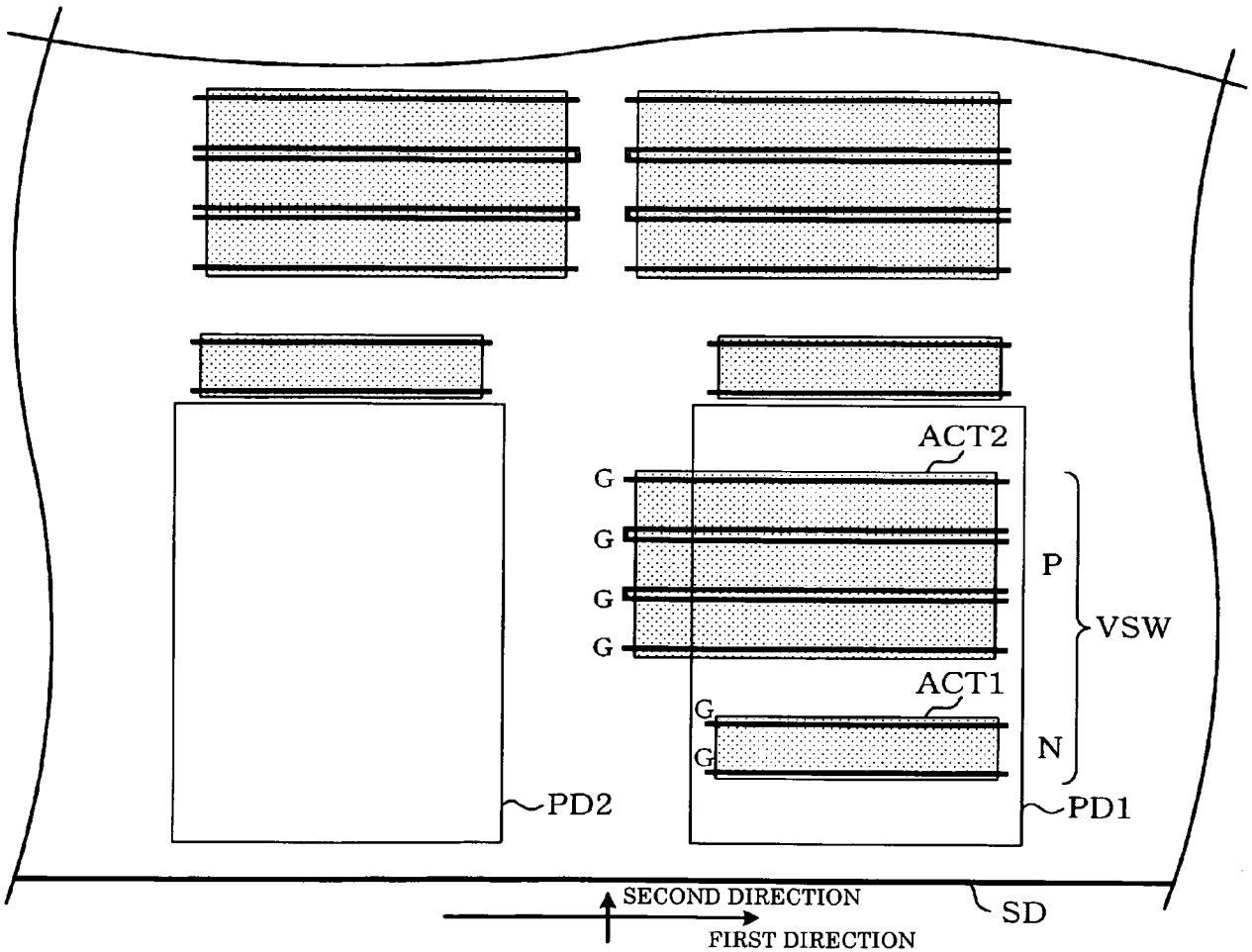
FIG. 35 is a view showing another layout arrangement example of the common electrode charge storage switch formed in a region near the first capacitor element connection pad.

FIG. 35 shows another layout arrangement example of the common electrode charge storage switch CVW formed in the region near the first capacitor element connection pad PD1.

In FIG. 35, the same sections as in FIG. 34 are indicated by the same symbols. Description of these sections is appropriately omitted. In FIG. 35, the common electrode connection pad PD2 and the first capacitor element connection pad PD1 are adjacently disposed. The common electrode charge storage switch VSW is disposed in the lower layer of the first capacitor element connection pad PD1 (or the common electrode charge connection pad PD2).

The length of the connection line between the first capacitor element connection pad PD1 and the common electrode charge storage switch CVW can be reduced by disposing the common electrode charge storage switch CVW as shown in FIG. 34 or 35. As a result, current consumption based on charges supplied to and discharged from the first capacitor element CCV with a large capacitance can be reduced. Moreover, since an increase in the chip area of the display driver 60 can be suppressed even if the size of the transistor forming the common electrode charge storage switch CVW is increased, current consumption based on charges supplied to and discharged from the first capacitor element CCV can be further reduced by reducing the on-resistance of the common electrode charge storage switch CVW.

As described above, while the effect of recycling charges using the second capacitor element CCS varies depending on the display data, the effect of recycling charges using the first capacitor element CCV when applying the high-potential-side voltage VCOMH or the low-potential-side voltage VCOML is significantly high. Therefore, a reduction in chip area and the effect of recycling charges can be maximized by disposing the common electrode charge storage switch CVW near or in the lower layer of the first capacitor element connection pad PD1 as the first capacitor element connection terminal TL1.

5. Modification

In this embodiment, the display driver 60 which drives the display panel 12 shown in FIG. 1 or 2 has been described above. Note that the invention is not limited thereto.

Figure 36:
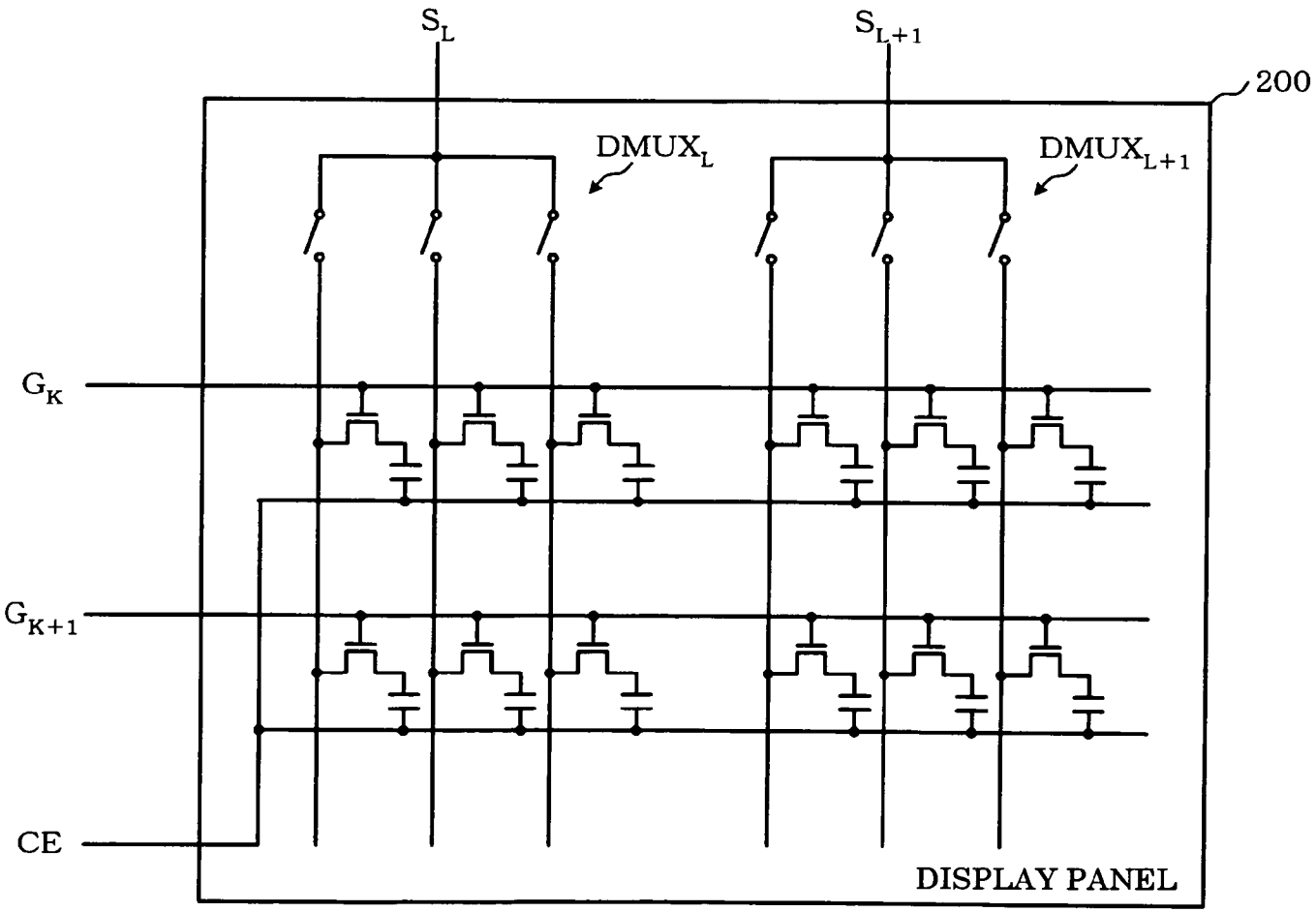
FIG. 36 is a view showing an outline of another configuration example of a display panel.

FIG. 36 shows an outline of another configuration example of a display panel.

In FIG. 36, the same sections as in FIG. 1 or 2 are indicated by the same symbols. Description of these sections is appropriately omitted. A display panel 200 shown in FIG. 36 includes demultiplexers in units of source outputs driven by the display driver. Specifically, the display panel 200 includes a demultiplexer $DMUX_L$ corresponding to the source line $S_L$ and a demultiplexer $DMUX_{L+1}$ corresponding to the source line $S_{L+1}$. The demultiplexer DMUX divides each source output into three color component source lines. In the display panel 200, the source of the thin film transistor TFT is connected with each color component source line. Therefore, when outputting the data voltage corresponding to the display data of three dots to each source output by time division, the demultiplexer DMUX can separate the time-division multiplexed data voltage and output the separated data voltage to each color component source line.

Figure 37:
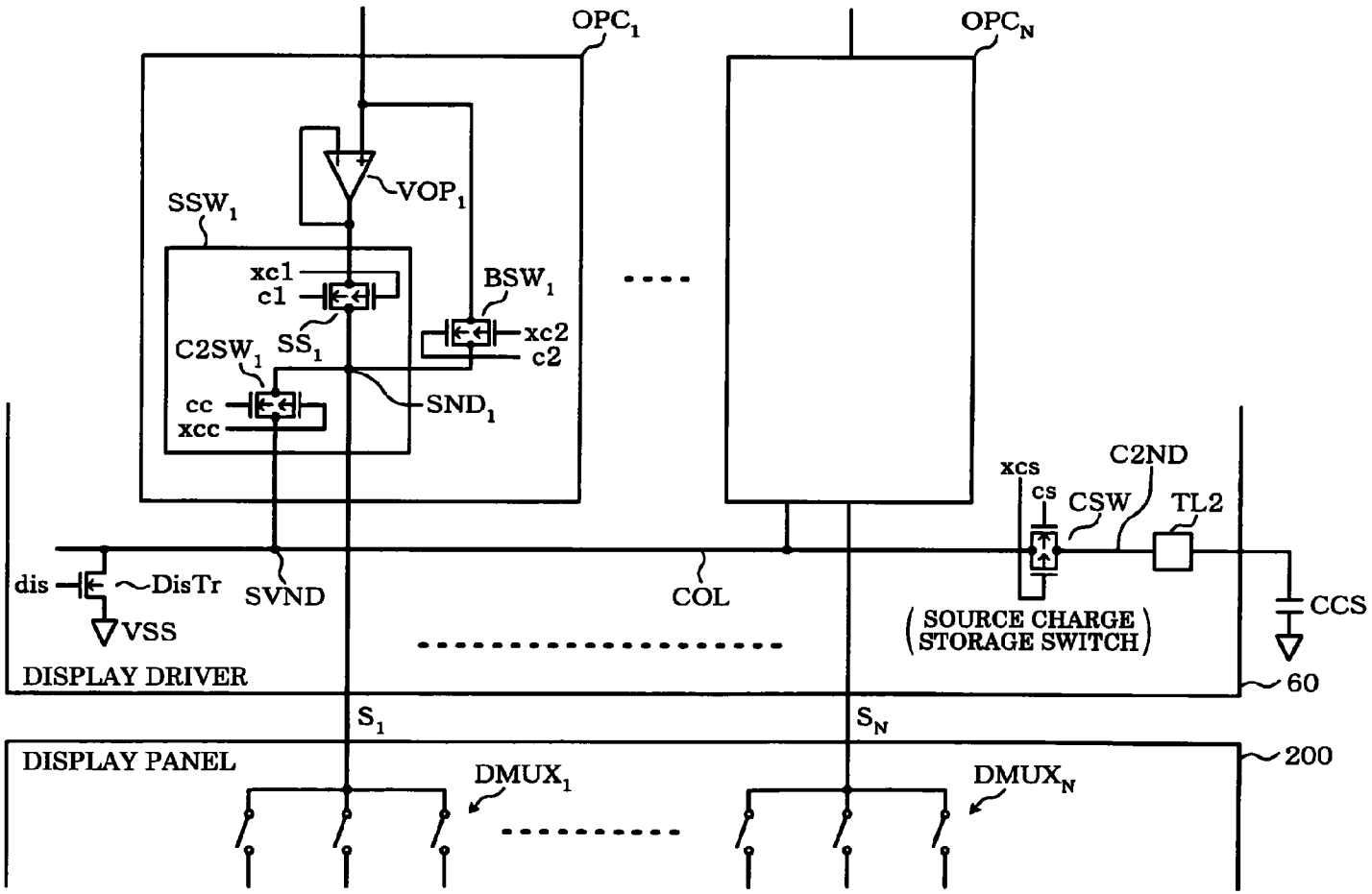
FIG. 37 is a view showing the main configuration of a display driver which drives the display panel shown in FIG. 36.

FIG. 37 shows the main configuration of the display driver which drives the display panel shown in FIG. 36.

In FIG. 37, the same sections as in FIG. 13 are indicated by the same symbols. Description of these sections is appropriately omitted. In the display driver shown in FIG. 37, the data voltage of three dots is time-division multiplexed and input to each operational amplifier block. Each of the demultiplexers $DMUX_1$ to $DMUX_N$ can separate each source output by supplying a time-division multiplex timing signal to the display panel 200.

Figure 38:
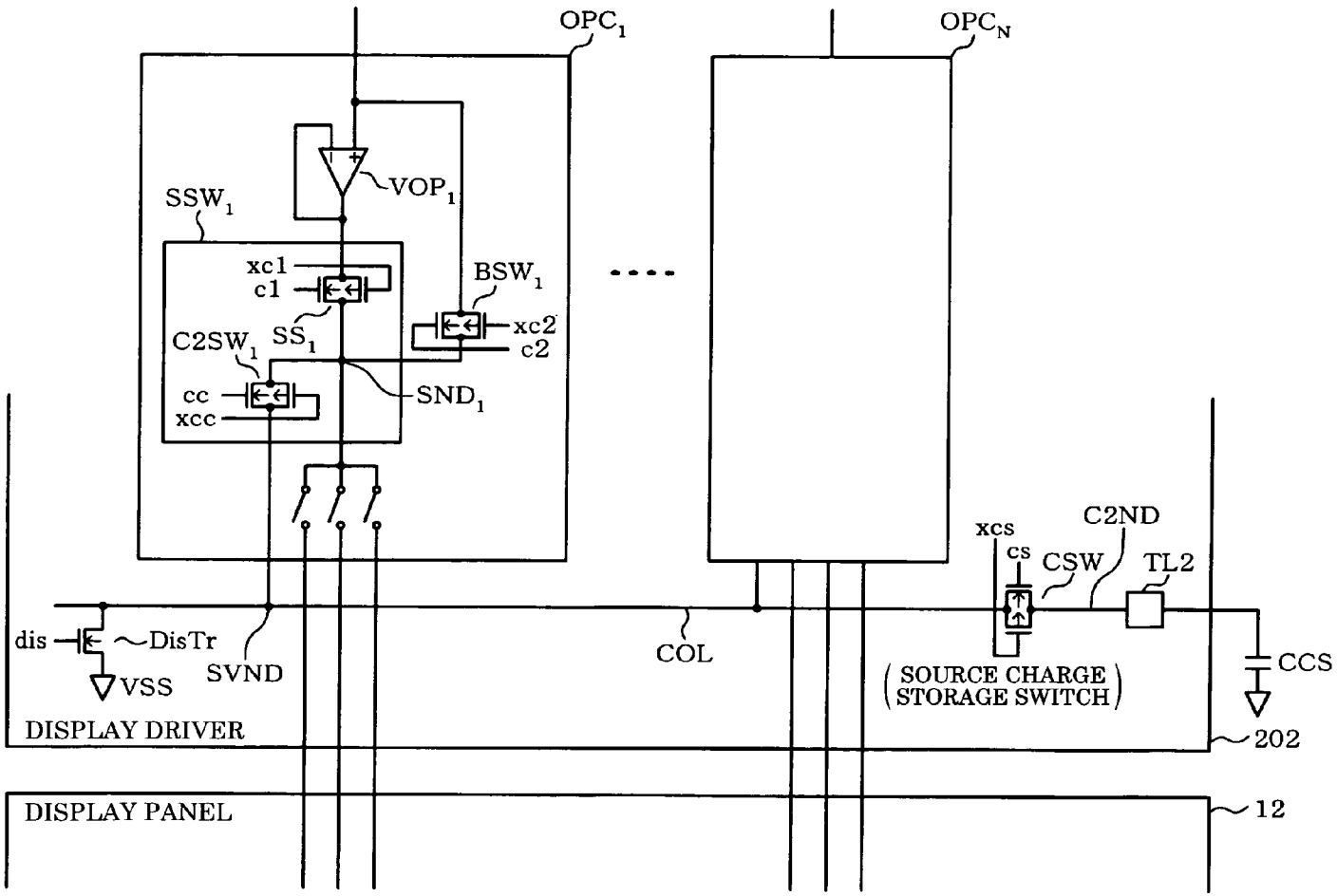
FIG. 38 shows another main configuration of a display driver which drives the display panel shown in FIG. 36.

The demultiplexers $DMUX_1$ to $DMUX_N$ shown in FIG. 36 may be provided in the display driver, as shown in FIG. 38. Specifically, a display driver 202 includes demultiplexers for separating the time-division multiplexed voltage of each source output node into a plurality of output voltages, and supplies each of the output voltages to each source line of the display panel. In this case, since it is unnecessary to supply the time-division multiplex timing signal of the data voltage to the display panel, the mounting area can be reduced.

6. Electronic Instrument

Figure 39:
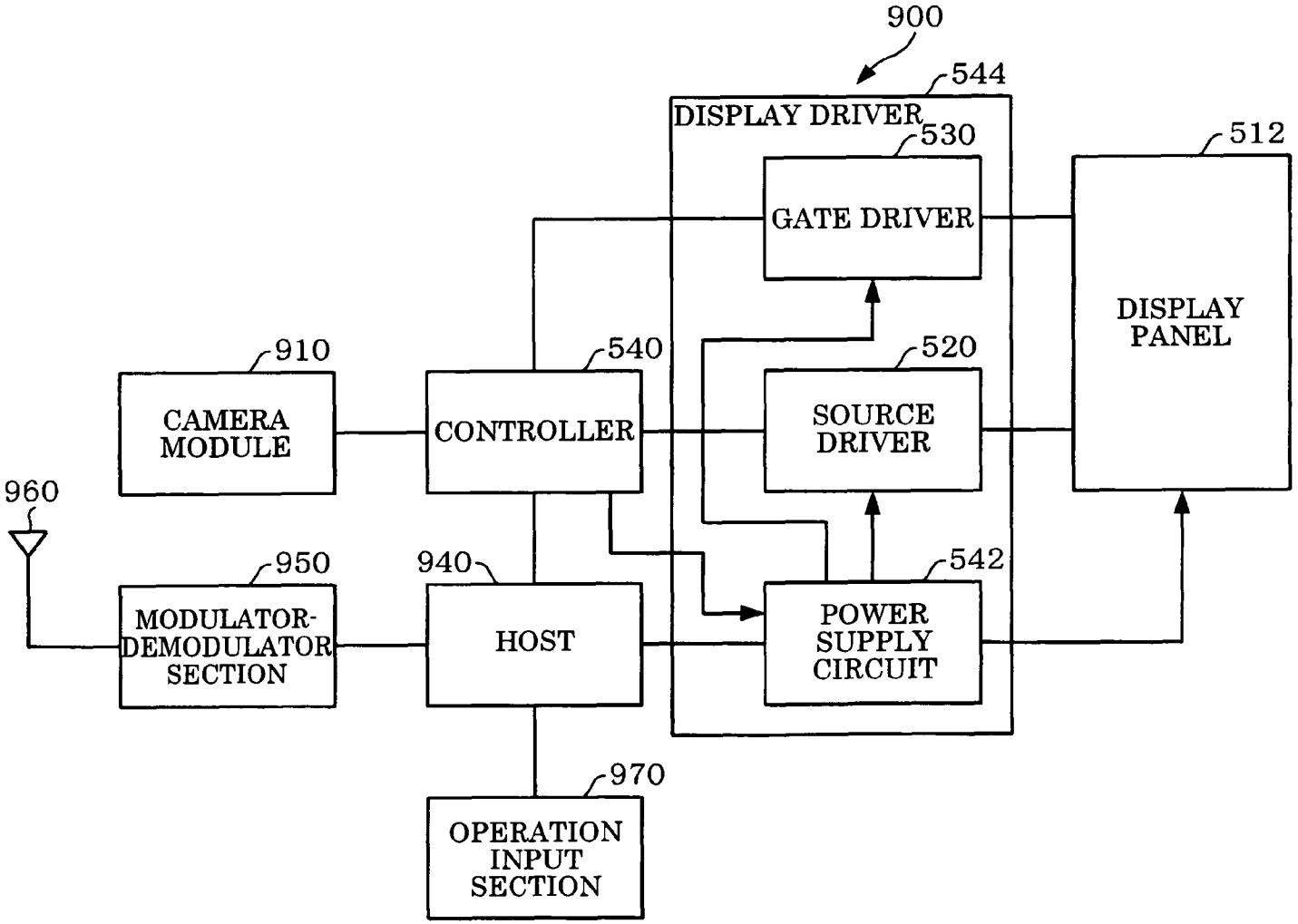
FIG. 39 is a block diagram showing a configuration example of an electronic instrument according to one embodiment of the invention.

FIG. 39 is a block diagram of a configuration example of an electronic instrument according to one embodiment of the invention. FIG. 39 is a block diagram of a configuration example of a portable telephone as an example of the electronic instrument.

A portable telephone 900 includes a camera module 910. The camera module 910 includes a CCD camera and supplies data of an image captured using the CCD camera to the display controller 540 in a YUV format. The display controller 540 has the functions of the display controller 40 shown in FIG. 1 or 2.

The portable telephone 900 includes a display panel 512. The display panel 512 is driven by a source driver 520 and a gate driver 530. The display panel 512 includes a plurality of gate lines, a plurality of source lines, and a plurality of pixels. The display panel 512 has the functions of the display panel 12 shown in FIG. 1 or 2.

The display controller 540 is connected with the source driver 520 and the gate driver 530, and supplies grayscale data in an RGB format to the source driver 520.

A power supply circuit 542 is connected with the source driver 520 and the gate driver 530, and supplies driving power supply voltages to the source driver 520 and the gate driver 530. The power supply circuit 542 has the function of the power supply circuit 50 shown in FIG. 1 or 2. The portable telephone 900 includes the source driver 520, the gate driver 530, and the power supply circuit 542 as a display driver 544. The display driver 544 drives the display panel 512.

A host 940 is connected with the display controller 540. The host 940 controls the display controller 540. The host 940 demodulates grayscale data received through an antenna 960 using a modulator-demodulator section 950, and supplies the demodulated grayscale data to the display controller 540. The display controller 540 causes the source driver 520 and the gate driver 530 to display an image on the display panel 512 based on the grayscale data. The source driver 520 has the function of the source line driver circuit 20 shown in FIG. 1 or 2. The gate driver 530 has the function of the gate line driver circuit 30 shown in FIG. 1 or 2.

The host 940 modulates grayscale data generated by the camera module 910 using the modulator-demodulator section 950, and directs transmission of the modulated data to another communication device through the antenna 960.

The host 940 transmits and receives grayscale data, captures an image using the camera module 910, and displays an image on the display panel 512 based on operation information from an operation input section 970.

The invention is not limited to the above embodiments. Various modifications and variations may be made within the spirit and scope of the invention. For example, the invention may be applied not only to drive the above liquid crystal display panel, but also to drive an electroluminescent display device, a plasma display device, and the like.

Some of the requirements of any claim of the invention may be omitted from a dependent claim which depends on that claim. Some of the requirements of any independent claim of the invention may be allowed to depend on any other independent claim.

Although only some embodiments of the invention are described in detail above, those skilled in the art would readily appreciate that many modifications are possible in the embodiments without materially departing from the novel teachings and advantages of the invention. Accordingly, such modifications are intended to be included within the scope of the invention.

What is claimed is:

1. A display driver for driving an electro-optical device, the display driver comprising:

a common electrode charge storage switch provided between a first capacitor element connection node to which one end of a first capacitor element can be connected and a common electrode voltage output node to which a voltage of a common electrode opposite to a pixel electrode of the electro-optical device through an electro-optical material is supplied;

a source charge storage switch provided between a second capacitor element connection node to which one end of a second capacitor element can be connected and a source voltage output node to which a voltage of a source line of the electro-optical device is supplied; and a node short circuit switch provided between the common electrode voltage output node and the source voltage output node, the display driver selecting one of a first operation mode and a second operation mode and carrying out the first operation mode or the second operation mode, in the first operation mode, after setting the node short circuit switch in a conducting state while setting the common electrode charge storage switch and the source charge storage switch in a nonconducting state during a first part of the first operation mode, the common electrode being driven during a second part of the first operation mode by supplying the common electrode voltage to the common electrode voltage output node and the source line being driven by supplying a voltage corresponding to a display data to the source line through an output buffer when the common electrode charge storage switch and the source charge storage switch remain in the nonconducting state and the node short circuit switch is set in a nonconducting state, the first part and the second part of the first operation mode being consecutively performed and consecutively repeated, and in the second operation mode, after electrically connecting the common electrode voltage output node and the first capacitor element connection node using the common electrode charge storage switch and electrically connecting the source voltage output node and the second capacitor element connection node using the source charge storage switch while the node short circuit switch is set in the nonconducting state during a first part of the second operation mode, the common electrode being driven during a second part of the second operation mode by supplying the common electrode voltage to the common electrode voltage output node and the source line being driven by supplying the voltage corresponding to the display data to the source line through the output buffer when the node short circuit switch remains in the nonconducting state, the common electrode voltage output node and the first capacitor element connection node are electrically disconnected using the common electrode charge storage switch, and the source voltage output node and the second capacitor element connection node are electrically disconnected using the source charge storage switch, the first part and the second part of the second operation mode being consecutively performed and consecutively repeated.

2. The display driver as defined in claim 1, in the second mode, a period in which the source voltage output node is electrically connected with the second capacitor element connection node coinciding with a period in which the common electrode voltage output node is electrically connected with the first capacitor element connection node.

3. The display driver as defined in claim 1, comprising:

an operation mode setting register in which control data corresponding to at least one of the first operation mode or the second operation mode is set, the at least one of the first operation mode and the second operation mode corresponding to the control data being designated.

4. The display driver as defined in claim 1, comprising:

an external setting terminal, the first operation mode or the second operation mode corresponding to a state of a signal supplied to the external setting terminal being designated.

5. The display driver as defined in claim 1, comprising:

a demultiplexer that separates a time-division multiplexed voltage of a source output node into a plurality of output voltages, one of the plurality of output voltages being supplied to one of a plurality of color component source lines of the electro-optical device.

6. The display driver as defined in claim 1, comprising:

a source output switch circuit connected to the source line and provided between the source line and the output buffer, in the first operation mode, when the node short circuit switch is in the conducting state, the source output switch circuit connecting the source line with the source voltage output node, and when the node short circuit switch is in the nonconducting state, the source output switch circuit connecting the source line with the output buffer, and in the second operation mode, when the source charge storage switch is in the conducting state, the source output switch circuit connecting the source line with the source voltage output node, and when the source charge storage switch is in the nonconducting state, the source output switch circuit connecting the source line with the output buffer.

7. The display driver as defined in claim 1, the display driver carrying out the first operation mode during a first period of time and the second operation mode during a second period of time.

* * * * *